US007226711B2

(12) United States Patent
Amamiya et al.

(10) Patent No.: US 7,226,711 B2
(45) Date of Patent: Jun. 5, 2007

(54) ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE AND ELECTROPHOTOGRAPHIC APPARATUS

(75) Inventors: Shoji Amamiya, Kashiwa (JP); Koichi Nakata, Toride (JP); Tatsuya Ikezue, Toride (JP); Takahiro Mitsui, Kashiwa (JP); Akira Shimada, Sunto-gun (JP); Hiroki Uematsu, Abiko (JP); Shuji Ishii, Kashiwa (JP); Akio Maruyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/236,691

(22) Filed: Sep. 28, 2005

(65) Prior Publication Data
US 2006/0019185 A1 Jan. 26, 2006

Related U.S. Application Data

(63) Continuation of application No. PCT/JP05/06431, filed on Mar. 25, 2005.

(30) Foreign Application Priority Data

Mar. 26, 2004 (JP) ..... 2004-092099
Apr. 27, 2004 (JP) ..... 2004-131660
Oct. 22, 2004 (JP) ..... 2004-308308

(51) Int. Cl.
*G03G 5/047* (2006.01)
*G03G 5/147* (2006.01)

(52) U.S. Cl. ..... 430/58.7; 430/58.05; 430/66; 430/132; 430/133

(58) Field of Classification Search ..... 430/66, 430/67, 58.05, 58.7, 132, 133
See application file for complete search history.

(56) References Cited

U.S. PATENT DOCUMENTS 4,933,247 A * 6/1990 Osawa et al. ..... 430/66

(Continued)

FOREIGN PATENT DOCUMENTS

| | | |
|---|---|---|
| EP | 001172701 | 1/2002 |
| JP | 61-63850 | 4/1986 |
| JP | 04-175767 | 6/1992 |

(Continued)

OTHER PUBLICATIONS

Diamond, Arthur S & David Weiss (eds.) Handbook of Imaging Materials. New York: Marcel-Dekker, Inc. (Nov. 2001) pp. 145-164.*

*Primary Examiner*—Christopher RoDee
(74) *Attorney, Agent, or Firm*—Fitzpatrick, Cella, Harper & Scinto

(57) ABSTRACT

An object of the present invention is to improve a phenomenon of the life-shortening of the endurance life due to scratch occurring when recesses of a fixed dimple shape are formed on the surface of the surface layer, in order to inhibit the chattering and folding back of a cleaning blade and the fracture of an edge, which occurs because friction between the surface layer of the surface of an electrophotographic photosensitive member and an abutting member is high; and particularly to improve the above described problems, from initial printing through printing on many sheets, which become particularly remarkable when using an electrophotographic photosensitive member with the use of a curable resin that is improved so as to have a high elastic deformation rate for the surface layer, in order to improve the strength of the surface layer, for the purpose of increasing the durability of an electrophotographic photosensitive member. An electrophotographic photosensitive member for achieving the object, which has a support and an organic photosensitive layer, is characterized in that the electrophotographic photosensitive member has dimple-shaped concavities formed on the surface of the surface layer of the electrophotographic photosensitive member, and further has the recesses with the same pattern as that on the surface of the surface layer, formed on the interface created between the surface layer of the organic photosensitive member and the layer directly under the surface layer (a subsurface layer).

31 Claims, 6 Drawing Sheets

U.S. PATENT DOCUMENTS

| | | | | |
|---|---|---|---|---|
| 4,952,473 | A * | 8/1990 | Suzuki | 430/67 |
| 5,242,773 | A | 9/1993 | Iino | 430/58 |
| 5,242,776 | A * | 9/1993 | Doi et al. | 430/67 |
| 5,381,211 | A * | 1/1995 | Godlove | 430/66 |
| 2002/0045116 | A1 | 4/2002 | Morikawa | 430/66 |

FOREIGN PATENT DOCUMENTS

| | | |
|---|---|---|
| JP | 05-88392 | 4/1993 |
| JP | 06-138685 | 5/1994 |
| JP | 2000-147813 | 5/2000 |
| JP | 2002-82465 | 3/2002 |

* cited by examiner

ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE AND ELECTROPHOTOGRAPHIC APPARATUS

This application is a continuation of International Application No. PCT/JP2005/006431, filed Mar. 25, 2005, which claims the benefit of Japanese Patent Applications No. 2004-092099, filed Mar. 26, 2004, No. 2004-131660 filed Apr. 27, 2004 and No. 2004-308308 filed Oct. 22, 2004.

BACKGROUND OF THE INVENTION

1. Field of the Invention

The present invention relates to an electrophotographic photosensitive member, a method for manufacturing the electrophotographic photosensitive member, a process cartridge and an electrophotographic apparatus comprising such an electrophotographic photosensitive member.

2. Description of the Related Arts

Among electrophotographic photosensitive members, so-called an organic electrophotographic photosensitive member is widespread which is an electrophotographic photosensitive member having a photosensitive layer (an organic photosensitive layer) made of an organic material for a photoconductive material (a charge-generating material or a charge-transporting material) arranged on a cylindrical support, because of having the advantages of a low price, high productivity and the like. Among the organic electrophotographic photosensitive members, an electrophotographic photosensitive member having a so-called multilayer-type photosensitive layer is in the mainstream, which is a photosensitive layer having both a charge-generating layer containing a charge-generating material, such as a photoconductive dye or a photoconductive pigment, and a charge-transporting layer containing a charge-transporting material, such as a photoconductive polymer or a photoconductive low-molecular-weight compound, layered one on another, because of having advantages of high sensitivity and high durability.

The surface of an electrophotographic photosensitive member directly receives an electrical external force and/or a mechanical external force such as electrification (primary electrification), exposure (image exposure), development with a toner, the transfer of a toner to a transfer material such as paper, the cleaning of a remaining toner after transferring, so that the electrophotographic photosensitive member is required to have durability to the external forces. Specifically, the electrophotographic photosensitive member is required to have durability to scratches and abrasion occurring on the surface due to the external forces, or equivalently, scratch resistance and abrasion resistance.

One of a technology for improving the scratch resistance and abrasion resistance of the surface of an organic electrophotographic photosensitive member is, for instance, Japanese Patent Application Laid-Open No. H02-127652 that discloses an electrophotographic photosensitive member which uses a cured layer with the use of a curable resin for a binder resin, as a surface layer (a layer located on the outermost surface of an electrophotographic photosensitive member, or equivalently, a layer farthest isolated from a support).

In addition, Japanese Patent Application Laid-Open No. H05-216249 and Japanese Patent Application Laid-Open No. H07-072640 discloses an electrophotographic photosensitive member using a charge-transporting cured layer formed by curing and polymerizing a monomer having a carbon-to-carbon double bond and a charge-transportable monomer having a carbon-to-carbon double bond with heat or light energy, as a surface layer.

Furthermore, Japanese Patent Application Laid-Open No. 2000-066424 and Japanese Patent Application Laid-Open No. 2000-066425 discloses an electrophotographic photosensitive member which uses a charge-transporting cured layer formed by curing and polymerizing a hole-transportable compound having a chain-polymerizable functional group in the same molecule with the energy of electron beams, as a surface layer.

As described above, in recent years, as a technology of improving the scratch resistance and the abrasion resistance of the surface of an organic electrophotographic photosensitive member, a technology of forming the surface layer of an electrophotographic photosensitive member with a cured layer and thereby increasing the mechanical strength of the surface layer has been established.

As described above, an electrophotographic photosensitive member is used in an electrophotographic image-forming process comprising an electrification step, an exposure step, a development step, a transferring step and a cleaning step.

Out of an electrophotographic image-forming process, the cleaning step of cleaning the surface of the electrophotographic photosensitive member by removing a toner remaining in the electrophotographic photosensitive member after the transferring step, so-called a remaining toner after transferring, is an important step for obtaining a clear image.

As a cleaning method, a method of scraping a remaining toner after transfer by abutting a cleaning blade with an electrophotographic photosensitive member so as not to make a gap between the cleaning blade and the electrophotographic photosensitive member, and preventing the passing of a toner is in a mainstream, because of having the advantages of an inexpensive cost and an easiness of designing.

Particularly, when forming images in full colors, desired colors are reproduced by superimposing a plurality of toners such as magenta, cyan, yellow and black, and a larger amount of toners is used than when forming images in monochrome, so that a cleaning method of using a cleaning blade is most suitable.

However, a cleaning method of using a cleaning blade has the disadvantages of easily causing the chattering and folding back of the cleaning blade and the chipping of an edge, because a frictional force between the cleaning blade and an electrophotographic photosensitive member is great. Here, the chattering of a cleaning blade is a phenomenon that the cleaning blade vibrates by an increased frictional resistance between the cleaning blade and the surface of an electrophotographic photosensitive member, and the folding back of the cleaning blade is a phenomenon that the cleaning blade flips toward a moving direction of the electrophotographic photosensitive member.

The problems with a cleaning blade become more remarkable as the surface layer of an electrophotographic photosensitive member has higher mechanical strength, or equivalently, the surface of the electrophotographic photosensitive member becomes more resistant to abrasion.

In addition, the surface layer of an organic electrophotographic photosensitive member is generally formed with a dip coating, but then, the surface of a surface layer formed with the dip coating, or equivalently, the surface of an electrophotographic photosensitive member becomes smoother, and a contact area between a cleaning blade and the surface of the electrophotographic photosensitive member becomes large to increase frictional resistance between the cleaning blade and the surface of the electrophotographic photosensitive member, so that the above described problems become more remarkable.

As one method of inhibiting the chattering and folding back of a cleaning blade and the chipping of an edge, a method for adequately roughening the surface of an electrophotographic photosensitive member is known.

As a technology of roughening the surface of an electrophotographic photosensitive member, for instance, Japanese Patent Application Laid-Open No. S53-092133 discloses a technology of limiting the surface roughness of the electrophotographic photosensitive member to a defined range in order to facilitate the separation of a transferring material from the surface of the electrophotographic photosensitive member. Japanese Patent Application Laid-Open No. S53-092133 discloses a method for roughening the surface of an electrophotographic photosensitive member into an orange-peeled state by controlling drying conditions in a step of forming a surface layer.

In addition, Japanese Patent Application Laid-Open No. S52-026226 discloses a technology of roughening the surface of an electrophotographic photosensitive member by making the surface layer contain particles.

In addition, Japanese Patent Application Laid-Open No. S57-094772 discloses a technology of roughening the surface of an electrophotographic photosensitive member by polishing the surface of the surface layer with the use of a metal wire brush.

In addition, Japanese Patent Application Laid-Open No. H01-099060 discloses a technology which uses particular cleaning means and toner and roughens the surface of an organic electrophotographic photosensitive member in order to solve the flipping (folding back) of a cleaning blade and the chipping of an edge, which become problems when the cleaning means and the toner are used in an electrophotographic apparatus with a particular process speed or higher.

In addition, Japanese Patent Application Laid-Open No. H02-139566 discloses a technology of roughening the surface of an electrophotographic photosensitive member by polishing the surface of the surface layer with an abrasive film.

However, the above described conventional technologies could not sufficiently solve the above described problems of the chattering and folding back of the cleaning blade.

In addition, as another technology of roughening the surface of an electrophotographic photosensitive member, Japanese Patent Application Laid-Open No. H02-150850 discloses a technology of roughening the peripheral surface of an electrophotographic photosensitive member by blasting, in order to prevent the flipping (folding back) of a cleaning blade and the fracture (chipping) of an edge.

SUMMARY OF THE INVENTION

The present inventors carried out an experiment of roughening the surface of an electrophotographic photosensitive member with a method described in Japanese Patent Application Laid-Open No. 02-150850, in order to solve the above described problems of the chattering and folding back of a cleaning blade and the chipping of an edge, and then, an electrophotographic photosensitive member having a plurality of dimple-shaped concavities on the surface was resulting, but it was newly found when mounting the electrophotographic photosensitive member on an electrophotographic apparatus and outputting images, the following problems might occur.

The problem will be now specifically described. The abrasion rate of the surface and a scratch-growing rate when an electrophotographic photosensitive member is used in an electrophotographic apparatus can be generally anticipated from the degree of an electrical external force and a mechanical external force which the electrophotographic photosensitive member may receive in the electrophotographic apparatus, materials used in a coating solution for a surface layer, and conditions when drying and curing the coating solution for the surface layer after having applied it. In addition, the life of an electrophotographic photosensitive member is anticipated generally from the anticipated abrasion rate of the surface, the scratch-growing rate, and the thickness of a coating film in a wet condition, which has been coated with a coating solution for a surface layer.

However, when an electrophotographic photosensitive member having a dimple-shaped concavity on the surface is repeatedly used for a long period, there were cases where an image defect due to a scratch was produced earlier than the anticipated life of the electrophotographic photosensitive member, and the electrophotographic photosensitive member could not be used earlier than the anticipated life (hereafter called "life-shortening due to scratch" as well).

An object of the present invention is to provide an electrophotographic photosensitive member that inhibits the above described "life-shortening due to scratch" which may occur in an electrophotographic photosensitive member having a dimple-shaped concavity on the surface; a method for manufacturing the electrophotographic photosensitive member; a process cartridge and an electrophotographic apparatus comprising such an electrophotographic photosensitive member.

As a result of an extensive research, the present inventors have determined that the above described "life-shortening due to scratch" is the problem which appears when a dimple-shaped concavity was formed on the surface of an electrophotographic photosensitive member, in other words, only on the surface of the surface layer of the electrophotographic photosensitive member and the film of the surface layer becomes locally thin (at the part of the recess); found that the above described "life-shortening due to scratch" can be inhibited by forming a plurality of recesses (valley toward a support side) on an interface between a surface layer and a layer directly under the surface layer, so as to correspond to the dimple-shaped concavities in the electrophotographic photosensitive member having a plurality of dimple-shaped concavities on the surface; and arrived at the present invention.

Specifically, the present invention provides:

(1) an electrophotographic photosensitive member having a support and an organic photosensitive layer provided on the support, characterized in that a plurality of dimple-shaped concavities are formed on the surface of the surface layer of the electrophotographic photosensitive member, and a plurality of recesses corresponding to the dimple-shaped concavities formed on the surface of the surface layer are formed on an interface between the surface layer and the layer directly under the surface layer;

(2) the electrophotographic photosensitive member according to aspect (1), wherein the dimple-shaped concavities formed on the surface of the surface layer have a rate of 50 to 100% fitting to the recesses formed on the interface between the surface layer and the layer directly under the surface layer;

(3) the electrophotographic photosensitive member according to aspect (2), wherein the dimple-shaped concavities formed on the surface of the surface layer have a rate of 70 to 100% fitting to the recesses formed on the interface between the surface layer and the layer directly under the surface layer;

(4) the electrophotographic photosensitive member according to any one of aspects (1) to (3), wherein the surface of the surface layer has an elastic deformation rate of 46% or higher;

(5) the electrophotographic photosensitive member according to aspect (4), wherein the surface of the surface layer has an elastic deformation rate of 50% or higher;

(6) the electrophotographic photosensitive member according to any one of aspects (1) to (5), wherein the surface of the surface layer has an elastic-deformation rate of 63% or lower;

(7) the electrophotographic photosensitive member according to any one of aspects (1) to (6), wherein the surface of the surface layer has a universal hardness value (HU) of 150 to 230 $N/mm^2$;

(8) the electrophotographic photosensitive member according to any one of aspects (1) to (7), wherein the surface of the layer directly under the surface layer has the elastic deformation rate of 45% or lower and the universal hardness value (HU) of 230 $N/mm^2$ or smaller;

(9) the electrophotographic photosensitive member according to any one of aspects (1) to (8), wherein the surface layer has a thickness of 10 μm or less;

(10) the electrophotographic photosensitive member according to aspect (9), wherein the surface layer has a thickness of 6 μm or less;

(11) the electrophotographic photosensitive member according to any one of aspects (1) to (10), wherein the surface layer is a cured layer;

(12) the electrophotographic photosensitive member according to any one of aspects (1) to (11), wherein the surface layer is a cured layer containing at least one curable resin selected from the group consisting of an acrylic resin, a phenol resin, an epoxy resin, a silicone resin and a urethane resin;

(13) the electrophotographic photosensitive member according to any one of aspects (1) to (12), wherein the surface layer contains a cured material resulting by curing and polymerizing a hole-transporting compound having two or more chain-polymerizable functional groups in a molecular thereof;

(14) the electrophotographic photosensitive member according to aspect (13), wherein the cured material is resulting by curing and polymerizing the hole-transporting compound having two or more chain-polymerizable functional groups in a molecular thereof, by heating or irradiation with a radioactive ray;

(15) the electrophotographic photosensitive member according to aspect (14), wherein the radioactive rays is electron beam;

(16) the electrophotographic photosensitive member according to any one of aspects (1) to (15), wherein the surface layer is formed by coating;

(17) the electrophotographic photosensitive member according to any one of aspects (1) to (16), wherein the surface layer is formed by dip coating;

(18) the electrophotographic photosensitive member according to any one of aspects (1) to (17), wherein the photosensitive layer is a multilayer-type photosensitive layer formed by layering, in an order closer to the support, a charge-generating layer and a charge-transporting layer, and the surface layer is the charge-transporting layer, and the layer directly under the surface layer is the charge-generating layer;

(19) the electrophotographic photosensitive member according to any one of aspects (1) to (18), wherein the photosensitive layer is a multilayer-type photosensitive layer formed by layering, in an order closer to the support, a charge-generating layer, a first charge-transporting layer and a second charge-transporting layer, and the surface layer is the second charge-transporting layer and the layer directly under the surface layer is the first charge-transporting layer;

(20) the electrophotographic photosensitive member according to any one of aspects (1) to (19), wherein the electrophotographic photosensitive member further has a protective layer arranged on the photosensitive layer, the photosensitive layer is a multilayer-type photosensitive layer formed by layering, in an order closer to the support, a charge-generating layer and a charge-transporting layer, the surface layer is the protective layer and the layer directly under the surface layer is the charge-transporting layer;

(21) a method for manufacturing the electrophotographic photosensitive member according to any one of aspects (1) to (20), characterized in that the method comprises a surface-layer-forming step of forming the surface layer right on the layer directly under the surface layer; and a recess-forming step of forming a plurality of dimple-shaped concavities on the surface of the surface layer formed in the surface-layer-forming step, and a plurality of recesses corresponding to the dimple-shaped concavities on an interface between the surface layer and the layer directly under the surface layer, by dry blasting treatment or wet honing;

(22) a process cartridge characterized in that the process cartridge integrally supports either the electrophotographic photosensitive member according to any one of aspects (1) to (20), or an electrophotographic photosensitive member manufactured by a manufacturing method according to aspect (21), and at least one means selected from the group consisting of charging means, developing means and cleaning means, and is releasable from the main body of an electrophotographic apparatus;

(23) an electrophotographic apparatus characterized in that the electrophotographic apparatus has either the electrophotographic photosensitive member according to any one of aspects (1) to (20), or an electrophotographic photosensitive member manufactured by the manufacturing method according to aspect (21), charging means, exposure means, developing means, transferring means and cleaning means.

The present invention can provide an electrophotographic photosensitive member that inhibits the above described "life-shortening due to scratch" which may occur in an electrophotographic photosensitive member having a dimple-shaped concavity on the surface; a method for manufacturing the electrophotographic photosensitive member; a process cartridge having the electrophotographic photosensitive member; and an electrophotographic apparatus.

DESCRIPTION OF THE PREFERRED EMBODIMENTS

Figure 1:
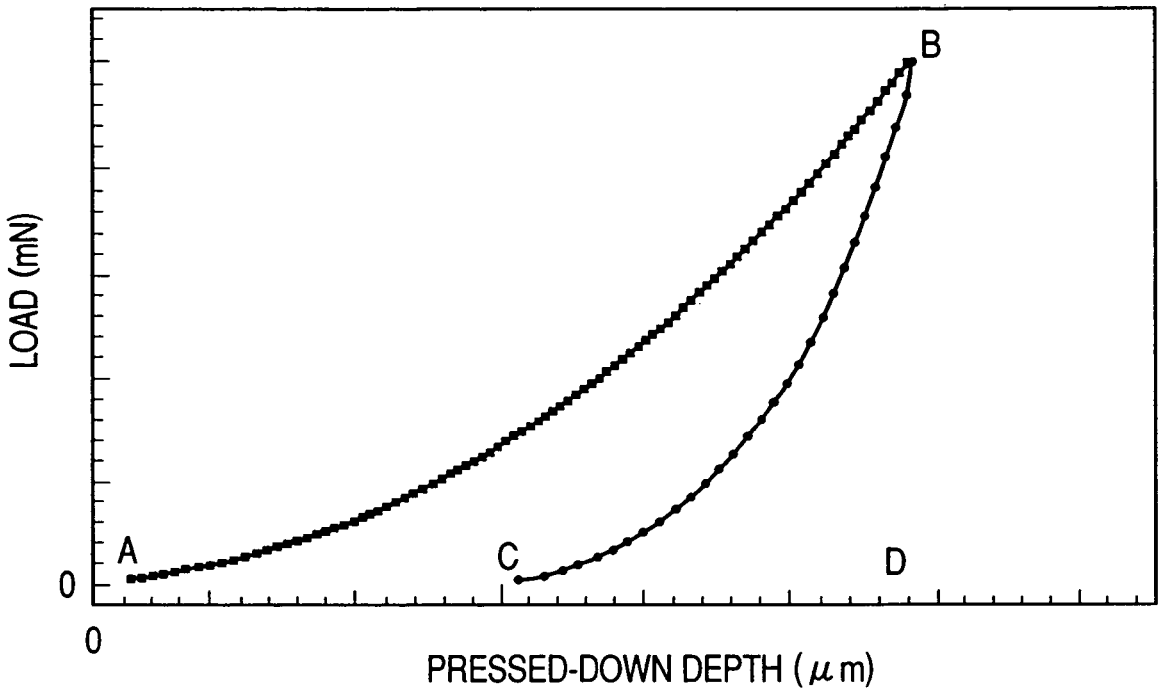
FIG. 1 is a schematic view of a chart measured with a microhardness measurement instrument, a Fischer scope H100V (a product made by H. Fischer Co. Ltd.,)

When scratches produced on the surface by a repeated use of an electrophotographic photosensitive member grow and reach a layer directly under a surface layer (hereinafter called "surface underlayer"), the electrophotographic photosensitive member generally becomes unusable.

When a dimple-shaped concavity is formed only on the surface of an electrophotographic photosensitive member, in other words, on the surface of the surface layer of the electrophotographic photosensitive member, a scratch formed in the recess reaches a surface underlayer earlier than the scratch formed in a non-recess part does, because the film of the surface layer is thinner in the recess than in the non-recess part which constitutes most parts of the surface. The present inventors thought that this is the cause of the above described "life-shortening due to scratch".

An electrophotographic photosensitive member according to the present invention has dimple-shaped concavities formed not only on the surface of a surface layer but also at such positions on the interface between the surface layer and a surface underlayer as to correspond to the dimple-shaped concavities, so that there are no parts or almost no parts in which the film of the surface layer is locally thin. Accordingly, an electrophotographic photosensitive member according to the present invention has less probability that a scratch formed in the recess on the surface reaches the surface underlayer earlier than a scratch formed in a non-recess part does, than an electrophotographic photosensitive member having dimple-shaped concavities formed only on the surface of the surface layer.

A "dimple-shaped concavity" according to the present invention is a fine recess formed on the surface of the surface layer of an electrophotographic photosensitive member. It is preferable that the recess exists in an isolated form as much as possible, has an adequate size, an adequate depth and an adequate space between recesses, and is formed so that the recesses may not be streakily ranged in particular, and may not distributed with directivity.

An electrophotographic photosensitive member according to the present invention has a shape which can be repeatedly used in an electrophotographic apparatus, such as a cylindrical or belt-shaped form, and a rotating shaft, and is used in a form of repeating an electrophotographic process including electrification, exposure, development, transferring, cleaning and the like, while rotating. A cleaning blade is normally arranged in parallel to the rotating shaft of the electrophotographic photosensitive member, and is abutted to the surface of the surface layer of the electrophotographic photosensitive member. Thus, a circumferential direction means a perpendicular direction to a rotating shaft, and a direction of repeatedly contacting with a member in each process as the electrophotographic photosensitive member rotates.

In the present invention, 10-point average roughness (Rzjis), mean spacing of irregularities (RSm), maximum peak height (Rp) and maximum valley depth (Rv) mean values measured in conformance with a method described in JIS-B0601-2001. Those values were measured with the use of a surface roughness-measuring instrument (a trade name: Surfcoder SE3500, product made by Kosaka Laboratory Ltd.)

The surface roughness of the surface layer of an electrophotographic photosensitive member is preferably in a range of 0.3 to 2.5 μm, and further preferably in a range of 0.4 to 2.0 μm by Rzjis, when measured in both of a circumferential direction and a rotating shaft direction. When the surface roughness is too small, an improvement effect due to roughening of the present invention is not resulting, and when it is too large, rough images are resulting due to the roughened surface, and an amount of toners passing through a cleaning blade increases.

The surface profile required in the present invention is the one having many isolated recesses as close to a circle as possible, which can be expressed as so-called a dimple-shaped concavity. The dimple-shaped concavities are preferably distributed with no directivity to all directions on the surface of an electrophotographic photosensitive member.

When the surface of an electrophotographic photosensitive member has such irregularities that the valley parts are streakily ranged, low-resistance materials such as electrification products accumulate on the streaky portion, which may cause a problem that the defect of a streaky image occurs due to a surface profile, when used particularly in a high temperature and high humidity environment for a long period.

Accordingly, a ratio of a value of Rzjis (A) in a circumferential direction to a value of Rzjis (B) in an axial direction around which an electrophotographic photosensitive member rotates, is preferably as close to 1 as possible.

Mean spacing of irregularities RSm is preferably 5 to 120 μm, when measured in both of a circumferential direction and a rotating shaft direction, and a ratio of RSm (C) in a circumferential direction to RSm (D) in a rotating shaft direction RSm(D)/RSm(C) needs to be in a range of 0.5 to 1.5.

It is further preferable that both values of RSm measured in a circumferential direction and a rotating shaft direction are 10 to 100 μm, and RSm(D)/RSm(C) is 0.8 to 1.2.

An electrophotographic photosensitive member thus having a surface profile which has the recesses of the same shape not ranged in a circumferential direction and has the whole surface randomly roughened, does not concentratively abut recesses of the same shape to a fixed part of a cleaning blade when it is rotated, disperses a load, reduces a passing amount of a toner, and improves the folding back of the blade and a fracture of an edge are improved.

The surface of an electrophotographic photosensitive member abuts to a cleaning blade with a difference of speeds, so that there is an optimal range of spacing of irregularities. When the RSm is too small, a roughening effect is lost, and when it is too large, the electrophotographic photosensitive member tends to increase poor cleaning such as the passing of a toner.

In addition, a surface profile according to the present invention is directed at profile positively possessing more recesses than salients. When an electrophotographic photosensitive member has a predominantly salient profile and thus high salients, they increase their local resistance to a cleaning blade, and cause a problem of fracturing an edge of a cleaning blade after a long period of endurance test.

Accordingly, in the present invention, in order to selectively form a profile having less salients and more recesses, the maximum peak height (Rp) is preferably 0.6 μm or less, and further preferably 0.4 μm or less. In addition, the ratio of the maximum valley depth Rv to the maximum peak height Rp, Rv/Rp is preferably 1.2 or more, and is further preferably 1.5 or more to show a more excellent effect.

A result of having further examined these dimple-shaped concavities in detail will be now described. A dimple-shaped concavity was measured with the use of a surface profile measuring system (Surface Explorer SX-520DR, a product made by Ryoka Systems Inc.)

A surface profile was measured, at first, by placing a drum sample on a workpiece table, keeping a level by controlling a tilt, and setting the mode to a wave mode, and taking data on a three-dimensional profile of the surface on an electrophotographic photosensitive member. At this time, the surface in a field of 100×100 μm was observed with an object lens having a magnification of 50 times. Subsequently, contour line data for the surface was displayed with the use of a particle analysis program in a data-analysis software.

The number and the area of dimple-shaped concavities were determined by setting each hole analysis parameter for the upper limit of the maximum diameter to 50 μm, for the lower limit of maximum diameter to 1 μm, for the lower limit of depth to 0.1 μm and for the lower limit of volume to 1 $\mu m^3$ or more, observing the recesses, and counting the number of the dimple-shaped concavities which seem to be so on a screen. The number of the dimple-shaped concavities existing in the area of 100 μm square was determined by counting the number of the dimple-shaped concavities seen in a visual field on an analysis screen.

The area rate of dimple-shaped concavities was determined by setting a visual field and analysis conditions to the same conditions as those described above, regarding the total area as 10,000 $\mu m^2$, determining the area of dimple-shaped concavities by summing calculated values in a particle analysis software, and calculating a value according to the expression of (summed area of dimple-shaped concavities/total area)×100 (%).

The average aspect ratio of a dimple-shaped concavity was determined by collecting data of apparent dimple-shaped concavities from the same visual field and analysis conditions, and calculating the average value of the aspect ratio.

The number of dimple-shaped concavities suitable for an electrophotographic photosensitive member according to the present invention is preferably 5 to 50 recesses per 100 μm square, and further preferably 5 to 40 recesses. The area rate of dimple-shaped concavities is preferably 3 to 60%, and further preferably 3 to 50%. When the number and the area rate of dimple-shaped concavities exceed the upper limits or fall short of the lower limits, a roughening effect is not resulting.

In addition, an average aspect ratio of recesses of a dimple shape is preferably 0.5 to 0.95.

The surface profile satisfying these numerical specifications show the irregularities of isolated dimple-shaped concavity having a shape close to a circle, which is required in the present invention. The roughened surface having such profile has a suitable roughness without directivity, and efficiently provides an improvement effect according to the present invention, from the reason described above and below.

The present invention is characterized in that when recesses with an optimized particular dimple shape are formed on the surface layer, the dimple-shaped concavities formed on the surface of a surface layer and on the interface between the surface of the surface layer and a surface underlayer are controlled so as to have almost the same pattern.

As a numerical value for quantitatively showing a matching rate of a pattern of dimple-shaped concavities on the surface of a surface layer with that on an interface formed between the surface layer and a surface underlayer according to the present invention, a fitting rate was used.

A method for determining the fitting rate will be described below.

At first, a plurality of samples with a square of about 5 mm length are arbitrarily cut out from the surface of an electrophotographic photosensitive member. The cross section of one sample among-them is observed with a SEM, a plurality of dimple-shaped concavities are arbitrarily selected from them, a photograph of a cross section in which a surface underlayer of the part and the surface layer exist in the same visual field, is taken, and the following items are measured on each dimple-shaped concavity, based on the photograph of the cross section.

Figure 3:
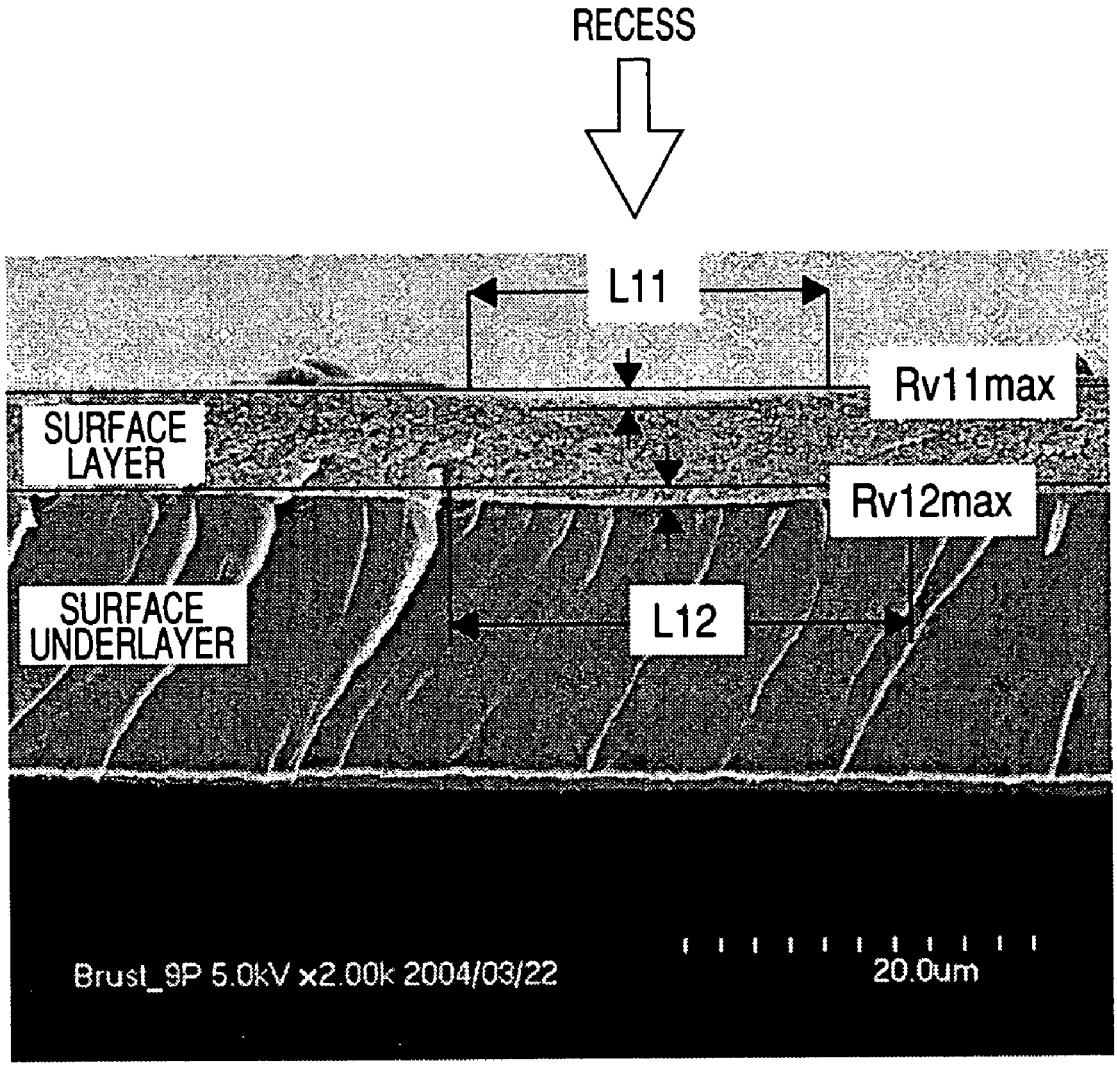
FIG. 3 is an example of a sectional photograph of an electrophotographic photosensitive member according to the present invention.

FIG. 3 shows an example of a photograph for a cross section of an electrophotographic photosensitive member according to the present invention.

The depth indicated by Rv11max (maximum valley depth) of a dimple-shaped concavity on the surface of a surface layer, and the depth indicated by Rv12max (maximum valley depth) of a dimple-shaped concavity formed on the interface between the surface of the surface layer and a surface lower layer, in the part corresponding to the recess are measured from the photograph of a cross section. In addition, L11 and L12, which are the diameters of both of the above described dimple-shaped concavities, are measured from the photography of a cross section in the same way. From these values, a fitting rate is determined by the following expressions:

$$100\times(Rv12/Rv11+L12/L11)/2=F1\%$$

(: fitting rate of sample No. 1).

The operation is performed for a plurality of portions in every cut-out sample of a plurality of samples cut out from the surface of an electrophotographic photosensitive member, and an average value of 20 portions or more in total is determined to be the fitting rate of the electrophotographic photosensitive member. The relationship is shown in the following expressions.

$$100\times(Rvn2/Rvn1+Ln2/Ln1)2=Fn\%$$

($Fn$: fitting rate of sample No. n); and $$(F1+F2+F3+ - - - +Fn)/n=F\%$$

(F: fitting rate of a measured electrophotographic photosensitive member).

In the present invention, when a fitting rate of a dimple-shaped concavity formed on the surface of a surface layer to a dimple-shaped concavity formed on an interface between the surface layer and a surface underlayer is 50% or higher, it has been demonstrated from the results of endurance performance that the shape and the pattern of the recesses are in approximately the same state. The result is considered to mean that thus formed electrophotographic photosensitive member has such a surface layer having a dimple-shaped concavity on the surface as to acquire uniform film thickness, and consequently has both low probabilities that the scratch of the surface of the surface layer reaches the surface underlayer to form images with the scratch even after the surface of the surface layer has been slowly cut while the electrophotographic photosensitive member has been used for a long period, and that a deep scratch accidentally formed on the surface layer penetrates the surface layer to reach the surface underlayer, even when the surface is not cut very much. After all, the electrophotographic photosensitive member hardly forms the image with a scratch, caused by the scratch formed on the surface occurring while having been used for a long period, and can be continually used up to the original life of the surface layer of the electrophotographic photosensitive member, in other words, has the life close to an anticipated life of the electrophotographic photosensitive member, which is calculated from an amount to be abraded by a unit number of sheets of the electrophotographic photosensitive member in an early period of an endurance test, and a growing rate of the scratch in an early period of the endurance test while printing the unit number of sheets.

As a result of examinations according to the present inventors, it has been found that when the electrophotographic photosensitive member has more preferably a fitting rate of 70% or higher, it attains a printable number closer to an anticipated number of tolerabily printed sheets.

In the present invention, any film-forming method or roughening method may be employed so far as the above described dimple-shaped concavity is formed on a surface layer.

But, it is effective to use any of mechanical roughening methods, in order to easily obtain a surface profile on a surface layer having such a dimple-shaped concavity as to satisfy the above described fitting rate which is required in the present invention. Among a plurality of mechanical roughening methods, a dry blasting method and a wet honing method are preferable as a method for forming the recess with the dimple shape. Out of them, the dry blasting method is further preferable, because it can roughen an electrophotographic photosensitive member sensitive to humidity conditions without contacting it with a solvent like water.

There are methods of spraying particles by using a compressed air, and spraying them by using a motor as a power, in methods of blasting treatment, but a method of using a compressed air is preferable because it can precisely and controllably roughens the surface of an electrophotographic photosensitive member and the facility is simple.

A material of an abrasive used in blasting includes ceramics such as aluminum oxide, zirconia, silicon carbide and glass; metals such as stainless steel, iron and zinc; and resins such as nylon, polycarbonate, epoxy and polyester. Particularly, glass, aluminum oxide and zirconia are preferable from the viewpoint of a roughening efficiency and a cost.

Figure 2:
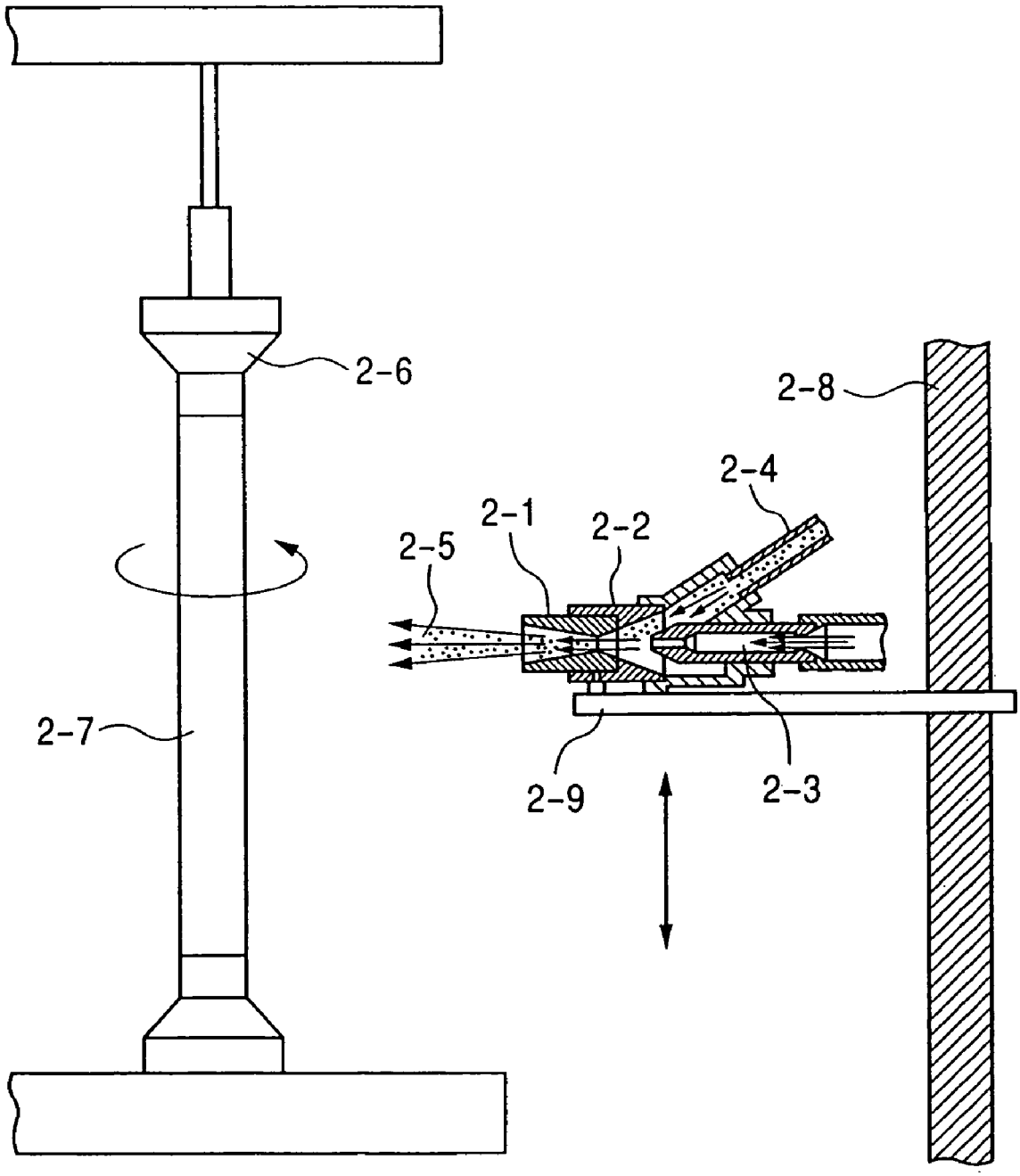
FIG. 2 is a schematic view of a blasting machine.

An example of a blasting device used in the present invention is shown in FIG. 2. An abrasive stored in a container (not-shown) is introduced to a nozzle through a path 2-4, is spouted from a jet nozzle 2-1 by using a compressed air introduced from a path 2-3, and is collided with an electrophotographic photosensitive member 2-7 which is supported by a workpiece support 2-6 and rotates. At this time, a distance between the nozzle and the workpiece is adjusted and fixed by a nozzle-setting holder 2-2 and 2-9, and an arm. A nozzle roughens a workpiece while moving the nozzle normally in the direction along a rotating shaft of a workpiece together with a nozzle support 2-8 moving in the same direction, to uniformly roughen the workpiece.

At this time, the shortest distance between a nozzle and the surface of an electrophotographic photosensitive member needs to be adjusted to a suitable space. When the distance is excessively short or long, the working efficiency may be lowered or the workpiece may not be desirably roughened. The pressure of a compressed air used as a power for spouting needs to be suitably adjusted. A manufacturing method of roughening an organic electrophotographic photosensitive member after finishing film formation as described above can have a high productivity.

A surface profile or a roughened shape according to the present invention is not affected by the surface profile of an electroconductive substrate which is a base material of an electrophotographic photosensitive member. Particularly, an organic photosensitive layer film-formed with a dip coating has often a very smooth surface, and even if having been formed on the roughened substrate, does not reflect the surface profile of the substrate.

When it is aimed to form a surface profile having dimple-shaped concavities according to the present invention by mechanical roughening, it is preferable to roughen the surface layer of an electrophotographic photosensitive member after having finishing the film formation of the top layer to be used on an organic electrophotographic photosensitive member.

It is a necessary condition to use an organic electrophotographic photosensitive member in the present invention. The organic electrophotographic photosensitive member normally has thickness and elastic characteristics suitable for being roughened after the electrophotographic photosensitive member has been film-formed, and has such an advantage that the profile of the surface which is finally used can be arbitrarily and widely controlled by controlling roughening conditions. When the organic electrophotographic photosensitive member is employed, it is particularly necessary for the electrophotographic photosensitive member to have an elastic deformation rate measured from the surface of the electrophotographic photosensitive member in the range of the present invention, in order to acquire a particularly adequate surface profile.

A roughening technology according to the present invention is an effective technique for forming an electrophotographic photosensitive member superior in durable characteristics. Particularly, an electrophotographic photosensitive member with a high elastic deformation rate has superior durability, causes little change from an original surface profile after a long period of use, and has a tendency to keep the profile. It is important to optimally control the original surface profile of such an electrophotographic photosensitive member.

The elastic deformation rate of a surface layer was measured on a roughened electrophotographic photosensitive member, or equivalently, on the surface layer. The elastic deformation rate of a surface underlayer was measured from the surface of an electrophotographic photosensitive member free from the above described surface layer.

Here, an elastic deformation rate We % is a value measured by using a microhardness measuring instrument, Fischer Scope H100V (a product made by Fischer Inc.), continuously applying a load of 6 mN onto a Vickers quadrangular pyramid diamond indentator having an angle between the opposite faces of 136 degrees under an environment of 25° C. and a humidity of 50%, and direct-reading a pressed-down depth under a load. Specifically, the pressed-down depth is measured stepwisely by applying a load finally of 6 mN (holding time of 0.1 S for each point and 273 points in total). A schematic view of an output chart from Fischer Scope H100V (a product made by Fischer Inc.) is shown in FIG. 1. In FIG. 1, a vertical axis indicates a load F (mN) and a horizontal axis indicates a pressed-down depth h (μm).

In the present invention, a universal hardness value (hereafter also called HU) can be determined by assigning a pressed-down depth measured under the final pressing load of 6 mN into the following expression (1):

$$Hu = \frac{\text{Test load } (N)}{\text{Surface area of Vickers indent at test load (mm)}^2} = \frac{F}{26.43\ h^2} \quad (1)$$

h: pressed-down depth (mm) under test load

An elastic deformation rate can be determined from work (energy) done to a film by an indentator, that is, a change in energy responding to a change in load to the film applied by the indentator, and specifically, it can be calculated from the following expression (2):

$$\text{Elastic deformation rate} = We/Wt \quad (2)$$

In the above described expression, total work done Wt (nJ) indicates an area surrounded by A-B-D-A in FIG. 1, and elastic deformation work done We (nJ) indicates an area surrounded by C-B-D-C.

In the present invention, an elastic deformation rate We % of a surface layer is preferably 46% or higher, and further preferably is 50% or higher and 63% or lower.

When the elastic deformation rate of a surface layer is less than 46%, the surface layer causes a great change in a surface profile after having been repeatedly used, and even if the surface layer is adequately roughened, the effect of roughening does not last long because the surface profile can not be maintained for a long time, to easily cause poor cleaning or produce a scratch.

In addition, when a surface layer is roughened by blasting treatment, the energy of colliding particles is easily dispersed in the surface layer, so that the force is hardly uniformly transmitted to a surface underlayer, and an irregular profile on the surface underlayer becomes different from that of the surface layer. As a result, the surface layer has a decreased fitting rate, has a large fluctuation of an effective thickness of itself, and then, increases a probability that a scratch reaches the surface underlayer during endurance test.

In addition, when the surface layer is roughened particularly by blasting treatment, it acquires more salients in the irregularities produced by colliding particles with the surface, and increases the probability of producing an image defect.

When an elastic deformation rate We % is in a range of 50% or more, on the other hand, a repeatedly-used surface profile is less changed, so that the present invention becomes more effective. In addition, when a surface layer is roughened by blasting treatment, the energy of particles collided with the surface is not dispersed in the surface layer, so that the force is easily uniformly transmitted to a surface underlayer, and the irregularities on a surface underlayer becomes close to that of the surface layer. As a result, the surface layer has a fitting rate-increased, has little fluctuation of an effective thickness of itself, and decreases a probability that a scratch reaches the surface underlayer after a long period of use.

However, when a surface layer has an elastic deformation rate We % higher than 63%, it tends to make a paper powder and a toner caught between an electrophotographic photosensitive member and an abutment member such as an electrification member and a cleaning member, tends to form scratches on the surface of an electrophotographic photosensitive member induced by scrubbing onto the surface of the electrophotographic photosensitive member by them, and consequently tends to increase abrasion. In addition, when the surface layer is roughened by blasting treatment, the energy of colliding particles is easily absorbed in the surface layer, so that the force is hardly uniformly transmitted to a surface underlayer, and the irregular profile on the surface underlayer becomes different from that of the surface layer. As a result, the surface layer has a fitting rate decreased, has a large fluctuation of an effective thickness of the surface layer, and then, increases a probability that a scratch reaches the surface underlayer during endurance test.

In an electrophotographic photosensitive member according to the present invention, it is preferable that the elastic deformation rate of a surface underlayer is 45% or lower, and that a universal hardness value (HU) is 230 N/mm$^2$ or smaller.

When a surface layer is worked with the above described blasting method to acquire dimple-shaped concavities, in order to increase the fitting rate of the dimple-shaped concavities formed on the surface of a surface layer to the dimple-shaped concavities formed on an interface between the surface layer and a surface underlayer, it is preferable to control the elastic deformation rate of the surface underlayer to 45% or lower and a universal hardness value (HU) to 230 N/mm$^2$ or smaller.

When a surface underlayer has a universal hardness value (HU) larger than 230 N/mm$^2$, it is not deformed so much though it receives the impact of particles collided with a surface layer by blasting on the interface of the surface underlayer; consequently has a fitting rate decreased; and occasionally tends to cause such problems as the formation of a crack on the surface layer or the interface.

In addition, when a surface underlayer has an elastic deformation rate higher than 45%, it absorbs the impact of particles collided with a surface layer by blasting on an interface between itself and a photosensitive layer under the surface layer, and tends to cause such problems as the formation of a crack on the surface of the surface layer or the interface in this case as well.

A surface layer according to the present invention has preferably a thickness of 10 μm or less, and has further preferably 6 μm or less.

A too thick surface layer, even if the surface profile is formed thereon by blasting treatment, disperses and attenuates the force of colliding particles in itself, and hardly transmits the force to an interface under the surface layer, so that a fitting rate is remarkably decreased.

An electrophotographic photosensitive member having a surface profile according to the present invention is most effective when a curable resin is applied to a surface layer. This is because an electrophotographic photosensitive member having a surface layer containing a curable resin causes little abrasion of the surface after endurance test, does not cause a change of a surface profile between an early stage and the time during endurance test, and maintains the optimal surface profile formed in an early stage for a long period of time. For instance, the surface layer of an electrophotographic photosensitive member is formed by using a (monomer of) curable resin, or using a hole-transporting compound having a polymerizable functional group (a chain-polymerizable functional group, a sequentially polymerizable functional group or the like), which is a hole-transporting compound having the polymerizable functional group chemically bonded to a portion of the molecule. When using a curable resin having no charge-transporting capability, a charge-transporting material may be mixed.

In order to obtain an electrophotographic photosensitive member particularly having the elastic deformation rate of a surface layer in the above described range, it is effective to form the surface layer of an electrophotographic photosensitive member through curing and polymerizing (polymerizing with cross-linking) a hole-transporting compound having a chain-polymerizable functional group, and particularly, through curing and polymerizing the hole-transporting compound having two or more chain-polymerizable functional groups in a molecular thereof. In addition, when employing a hole-transporting compound having a sequentially polymerizable functional group as the compound, it is preferable to use a hole-transporting compound having three or more sequentially polymerizable functional groups in a molecular thereof.

A method for forming the surface layer of an electrophotographic photosensitive member by using a hole-transporting compound having a chain-polymerizable functional group will be now described further in detail below. The same method can be employed when forming the surface layer by using a hole-transporting compound having a sequentially polymerizable functional group.

The surface layer of an electrophotographic photosensitive member can be formed by applying a coating solution for a surface layer containing a solvent and a hole-transporting compound having a chain-polymerizable functional group on a surface underlayer, curing and polymerizing the hole-transporting compound having the chain-polymerizable functional group, and thereby curing the applied coating solution for the surface layer.

A usable method of applying the coating solution for the surface layer includes, for instance, a dip coating (a dipping and coating), a spray coating method, a curtain coating method and a spin coating method. Among these application methods, the dip coating and the spray coating method are preferable from the viewpoint of effectiveness and productivity.

A method for curing and polymerizing a hole-transporting compound having a chain-polymerizable functional group include a method using heat; light such as visible light and ultra-violet rays; and radioactive rays such as electron beams and gamma rays. A polymerization initiator may be added to a coating solution for a surface layer, as needed.

Among methods for curing and polymerizing a hole-transporting compound having a chain-polymerizable functional group, methods of using radioactive rays such as electron beams and gamma rays are, and particularly, a method of using electron beams is preferable. This is because polymerization by radioactive rays does not particularly require a polymerization initiator. By curing and polymerizing a hole-transporting compound having a chain-polymerizable functional group without using a polymerization initiator, a surface layer of extremely high purity with a three-dimensional matrix can be formed and an electrophotographic photosensitive member showing adequate electrophotographic characteristics can be resulting. Among radioactive rays, electron beams are suitable for polymerization, because it gives very little damage due to irradiation to an electrophotographic photosensitive member, and can develop adequate electrophotographic characteristics.

In order to obtain an electrophotographic photosensitive member which has a universal hardness value (HU) and an elastic deformation rate in the above described range according to the present invention, by curing and polymerizing a hole-transporting compound having a chain-polymerizable functional group through irradiation with electron beams, it is important to consider the conditions of irradiation with electron beams.

Irradiation with electron beams can be performed with the use of an accelerator, such as a scanning type, an Electrocurtain type, a broad beam type, a pulse type and a laminar type. An accelerating voltage is preferably 250 kV or lower, and more preferably is particularly 150 kV or lower. Dose is preferably in a range of 1 to 1,000 kGy (0.1 to 100 Mrad), and further preferably is particularly in a range of 5 to 200 kGy (0.5 to 20 Mrad). When accelerating voltage and dose are too high, the electrical characteristics of an electrophotographic photosensitive member may be deteriorated. When dose is too low, a hole-transporting compound having a chain-polymerizable functional group may not be sufficiently cured and polymerized, so that a coating solution for a surface layer may not be sufficiently cured.

In addition, in order to promote the curing of a coating solution for a surface layer, it is preferable to heat an article to be irradiated (an article to be irradiated with electron beams) when curing and polymerizing a hole-transporting compound having a chain-polymerizable functional group by electron beams. An article to be irradiated may be heated in any step before irradiation with electron beams, during irradiation and after irradiation, but it is preferable that the article to be irradiated is kept in a constant temperature while there are radicals in a hole-transporting compound having a chain-polymerizable functional group. An article to be irradiated is preferably heated so that it can be kept to a temperature between room temperature and 250° C. (preferably 50 to 150° C.). When heating temperature is too high, the material of an electrophotographic photosensitive member may be deteriorated. When the heating temperature is too low, the effect of heating becomes poor. A coated liquid is preferably heated for about several seconds to tens of minutes, and specifically, for two seconds to 30 minutes.

An article to be irradiated may be irradiated with electron beams and heated in any atmosphere of atmospheric air, an inert gas such as nitrogen or helium and a vacuum, but it is preferable to be irradiated and heated in an inert gas or a vacuum because the atmosphere inhibits a radical from being deactivated by oxygen.

In addition, the surface layer of an electrophotographic photosensitive member has a thickness of preferably 30 μm or less, more preferably 20 μm or less, further preferably 10 μm or less, and still further preferably 7 μm or less, from the viewpoint of electrophotographic characteristics. On the other hand, the thickness is preferably 0.5 μm or more, and further preferably 1 μm or more, from the viewpoint of the durability of an electrophotographic photosensitive member.

By the way, chain polymerization means a polymerization reaction form of chain polymerization when the reaction of producing a high polymer is broadly divided into chain polymerization and sequential polymerization, and more specifically means unsaturation polymerization, ring opening polymerization or isomerization polymerization, which proceed the reaction mainly through intermediate products such as a radical and an ion.

A chain-polymerizable functional group means a functional group enabling the above described reaction. Examples of a widely-applicable unsaturation-polymerizable functional group and a ring-opening-polymerizable functional group will be described below.

Unsaturation polymerization means a reaction of polymerizing an unsaturated group such as C=C, C≡C, C=O, C=N and C≡N, and mainly C=C among them by using a reactivity of a radical or an ion. Specific examples of an unsaturation-polymerizable functional group are shown below.

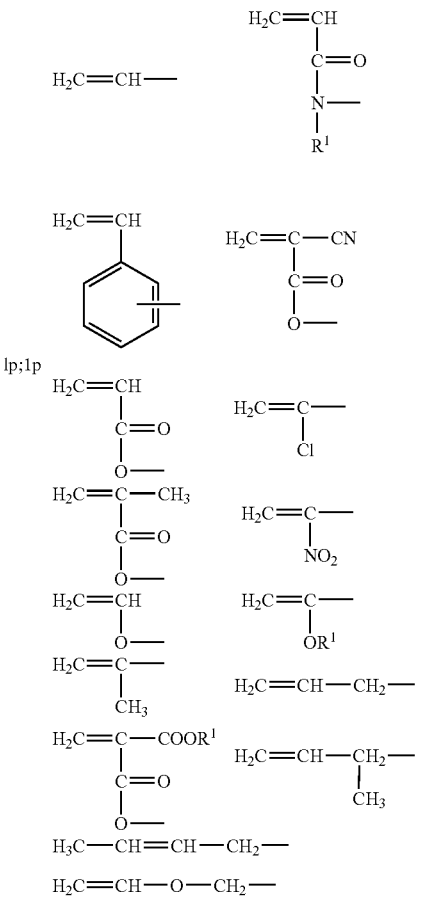

In the above described formulas, $R^1$ represents a hydrogen atom, a substituted or unsubstituted alkyl group, a substituted or unsubstituted aryl group, and a substituted or unsubstituted aralkyl group. Here, the alkyl group includes a methyl group, an ethyl group and a propyl group. The aryl group includes a phenyl group, a naphthyl group and an anthryl group. The aralkyl group includes a benzyl group and a phenethyl group.

Ring opening polymerization means a reaction in which an unstable cyclic structure having distortion such as a carbocyclic ring and an oxo ring and a nitrogen heterocycle repeats ring opening and simultaneous polymerization to produce chain polymer molecules, and ions predominantly act as activated species. Specific examples of a ring-opening-polymerizable functional group are described below.

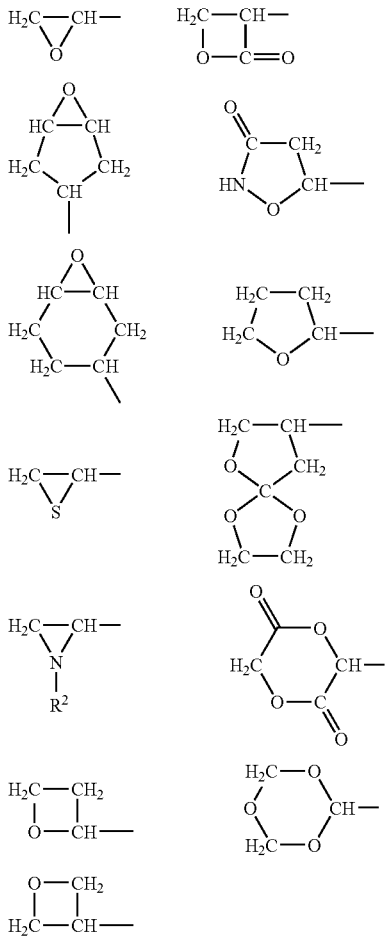

In the above described formulas, $R^2$ represents a hydrogen atom, a substituted or unsubstituted alkyl group, a substituted or unsubstituted aryl group, and a substituted or unsubstituted aralkyl group. Here, the alkyl group includes a methyl group, an ethyl group and a propyl group. The aryl group includes a phenyl group, a naphthyl group and an anthryl group. The aralkyl group includes a benzyl group and a phenethyl group.

Among the above exemplified chain-polymerizable functional groups, chain-polymerizable functional groups having the structures shown in the following formulas (1) to (3) are preferable.

(1)

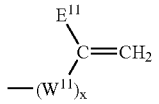

In Formula (1), $E^{11}$ represents a hydrogen atom, a halogen atom, a substituted or unsubstituted alkyl group, a substituted or unsubstituted aryl group, a substituted or unsubstituted aralkyl group, a substituted or unsubstituted alkoxy group, a cyano group, a nitro group, —$COOR^{11}$, or —$CONR^{12}R^{13}$; and $W^{11}$ represents a substituted or unsubstituted alkylene group, a substituted or unsubstituted arylene group, —COO—, —O—, —OO—, —S—, or $CONR^{14}$—. $R^{11}$ to $R^{14}$ represent each independently a hydrogen atom, a halogen atom, a substituted or unsubstituted alkyl group, a substituted or unsubstituted aryl group, or a substituted or unsubstituted aralkyl group. A subscript X represents 0 or 1. Here, a halogen atom includes a fluorine atom, a chlorine atom and a bromine atom. An alkyl group includes a methyl group, an ethyl group, a propyl group and a butyl group. An aryl group includes a phenyl group, a naphthyl group, an anthryl group, a pyrenyl group, a thiophenyl group and a furyl group. An aralkyl group includes a benzyl group, a phenethyl group, a naphthyl methyl group, a furfuryl group and a thienyl group. An alkoxy group includes a methoxy group, an ethoxy group and a propoxy group. An alkylene group includes a methylene group, an ethylene group and a butylene group. An arylene group includes a phenylene group, a naphthylene group and an anthracenylene group.

Substituents which may be included in each of the above described groups include a halogen atom such as a fluorine atom, a chlorine atom, a bromine atom and an iodine atom; an alkyl group such as a methyl group, an ethyl group, a propyl group and a butyl group; an aryl group such as a phenyl group, a naphthyl group, an anthryl group and a pyrenyl group; an aralkyl group such as a benzyl group, a phenethyl group, a naphthyl methyl group, a furfuryl group and a thienyl group; an alkoxy group such as a methoxy group, an ethoxy group and a propoxy group; an aryloxy group such as a phenoxy group and a naphthoxy group; a nitro group; a cyano group; and a hydroxyl group.

(2)

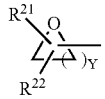

In Formula (2), $R^{21}$ and $R^{22}$ represent each independently a hydrogen atom, a substituted or unsubstituted alkyl group, a substituted or unsubstituted aryl group, or a substituted or unsubstituted aralkyl group; and a subscript Y represents an integer of 1 to 10. Here, an alkyl group includes a methyl group, an ethyl group, a propyl group and a butyl group. An aryl group includes a phenyl group and a naphthyl group. The aralkyl group includes a benzyl group and a phenethyl group.

Substituents which may be included in each of the above described groups include a halogen atom such as a fluorine atom, a chlorine atom, a bromine atom and an iodine atom; an alkyl group such as a methyl group, an ethyl group, a propyl group and a butyl group; an aryl group such as a phenyl group, a naphthyl group, an anthryl group and a pyrenyl group; an aralkyl group such as a benzyl group, a phenethyl group, a naphthyl methyl group, a furfuryl group and a thienyl group; an alkoxy group such as a methoxy group, an ethoxy group and a propoxy group; and an aryloxy group such as a phenoxy group and a naphthoxy group.

(3)

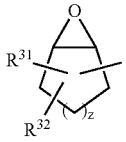

In Formula (3), $R^{31}$ and $R^{32}$ represent each independently a hydrogen atom, a substituted or unsubstituted alkyl group, a substituted or unsubstituted aryl group, or a substituted or unsubstituted aralkyl group; and a subscript Z represents an integer of 0 to 10. Here, an alkyl group includes a methyl group, an ethyl group, a propyl group and a butyl group. An aryl group includes a phenyl group and a naphthyl group. The aralkyl group includes a benzyl group and a phenethyl group.

Substituents which may be included in each of the above described groups include a halogen atom such as a fluorine atom, a chlorine atom, a bromine atom and an iodine atom; an alkyl group such as a methyl group, an ethyl group, a propyl group and a butyl group; an aryl group such as a phenyl group, a naphthyl group, an anthryl group and a pyrenyl group; an aralkyl group such as a benzyl group, a phenethyl group, a naphthyl methyl group, a furfuryl group and a thienyl group; an alkoxy group such as a methoxy group, an ethoxy group and a propoxy group; and an aryloxy group such as a phenoxy group and a naphthoxy group.

Among the chain-polymerizable functional groups having the structures shown in the above described formulas (1) to (3), chain-polymerizable functional groups having the structures shown in the following formulas (P-1) to (P-11) are more preferable.

(P-1)

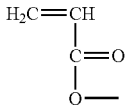

(P-2)

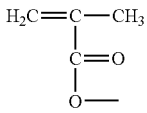

(P-3)

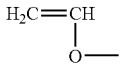

(P-4)

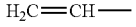

(P-5)

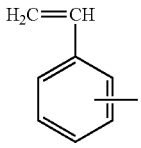

(P-6)

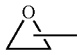

-continued (P-7)

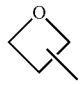

(P-8)

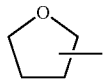

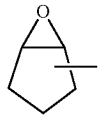

(P-10)

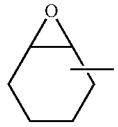

(P-11)

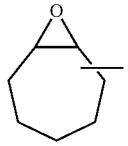

Among the chain-polymerizable functional groups having the structures shown in the above described formulas (P-1) to (P-11), the chain-polymerizable functional group having the structure shown in the above described Formula (P-1), or equivalently, an acryloyloxy group, and the chain-polymerizable functional group having the structure shown in the above described Formula (P-2), or equivalently, a methacryloyloxy group are further preferable.

In the present invention, among the hole-transporting compounds having the above described chain-polymerizable functional group, a hole-transporting compound having two or more chain-polymerizable functional groups (in a molecular thereof) is preferable. Specific examples of a hole-transporting compound having two or more chain-polymerizable functional groups are shown below.

$$(P^{41})_a\text{-}A^{41}\text{-}[R^{41}\text{—}(P^{42})_d]_b \quad (4)$$

In the above described Formula (4), $P^{41}$ and $P^{42}$ represent each independently a chain-polymerizable functional group; $R^{41}$ represents a divalent group; $A^{41}$ represents a hole-transporting group; and subscripts a, b and d represent each independently integers of 0 or greater. However, the value of a+b×d is 2 or more. When a is 2 or more, a groups of $P^{41}$ may be the same or different, as or from each other; when b is 2 or more, b groups of $[R^{41}\text{—}(P^{42})_d]$ may be the same or different, as or from each other, and when d is 2 or more, d groups of $P^{42}$ may be the same or different, as or from each other.

Examples in which hydrogen atoms substitute for all of $(P_{41})_a$ and $[R^{41}\text{—}(P^{42})_d]_b$ in the above described Formula (4), include oxazole derivatives, oxadiazole derivatives, imidazole derivatives, triaryl amine derivatives (triphenyl amine and the like), 9-(p-diethylamino styryl) anthracene, 1,1-bis-(4-dibenzylamino phenyl) propane, styryl anthracene, styryl pyrazoline, phenylhydrazones, thiazole derivatives, triazole derivatives, phenazine derivatives, acridine derivatives, benzofuran derivatives, benzimidazole derivatives, thiophene derivatives and N-phenyl carbazole derivatives. Among those (compounds in which hydrogen atoms substitute for all of $(P^{41})_a$ and $[R^{41}\text{—}(P^{42})_d]_b$ in the above described Formula (4)), a structure shown in the following Formula (5) is preferable.

(5)

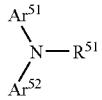

In the above described Formula (5), $R^{51}$ represents a substituted or unsubstituted alkyl group, a substituted or unsubstituted aryl group, or a substituted or unsubstituted aralkyl group; $Ar^{51}$ and $Ar^{52}$ represents each independently a substituted or unsubstituted aryl group; and $R^{51}$, $Ar^{51}$ and $Ar^{52}$ may be directly bonded to N (a nitrogen atom), or to N (a nitrogen atom) through an alkylene group (a methyl group, an ethyl group and a propylene group, etc.), a hetero atom (an oxygen atom and a sulfur atom, etc.) or —CH═CH—. Here, the alkyl group has preferably 1 to 10 carbon atoms, and includes a methyl group, an ethyl group, a propyl group and a butyl group. The aryl group includes a phenyl group, a naphthyl group, an anthryl group, a phenanthryl group, a pyrenyl group, a thiophenyl group, a furyl group, a pyridyl group, a quinolyl group, a benzoquinolyl group, a carbazolyl group, a phenothiazinyl group, a benzofuryl group, a benzothiophenyl group, a dibenzofuryl group and a dibenzothiophenyl group. The aralkyl group includes a benzyl group, a phenethyl group, a naphthyl methyl group, a furfuryl group and a thienyl group. In addition, $R^{51}$ in the above described Formula (5) is preferably a substituted or unsubstituted aryl group.

Substituents which may be included in each of the above described groups include a halogen atom such as a fluorine atom, a chlorine atom, a bromine atom and an iodine atom; an alkyl group such as a methyl group, an ethyl group, a propyl group and a butyl group; an aryl group such as a phenyl group, a naphthyl group, an anthryl group and a pyrenyl group; an aralkyl group such as a benzyl group, a phenethyl group, a naphthyl methyl group, a furfuryl group and a thienyl group; an alkoxy group such as a methoxy group, an ethoxy group and a propoxy group; an aryloxy group such as a phenoxy group and a naphthoxy group; a substituted amino group such as a dimethylamino group, a diethyl amino group, a dibenzyl amino group, a diphenyl amino group and a di(p-tolyl)amino group; an arylvinyl group such as a styryl group and a naphthyl vinyl group; a nitro group; a cyano group; and a hydroxyl group.

A divalent group of $R^{41}$ in the above described Formula (4) includes a substituted or unsubstituted alkylene group; a substituted or unsubstituted arylene group; $\text{—}CR^{411}\text{═}CR^{412}\text{—}$ (wherein $R^{411}$ and $R^{412}$ represents each independently a hydrogen atom, a substituted or unsubstituted alkyl group or a substituted or unsubstituted aryl group); —CO—; —SO—; $\text{—}SO_2\text{—}$; an oxygen atom; a sulfur atom; and combinations thereof. Among them, the divalent group having a structure shown in the following Formula (6) is preferable, and the divalent group having a structure shown in the following Formula (7) is more preferable.

$$\text{—}(X^{61})_{p6}\text{—}(Ar^{61})_{q6}\text{—}(X^{62})_{r6}\text{—}(Ar^{62})_{s6}\text{—}(X^{63})_{t6}\text{—} \quad (6)$$

$$\text{—}(X^{71})_{p7}\text{—}(Ar^{71})_{q7}\text{—}(X^{72})_{r7}\text{—} \quad (7)$$

In the above described Formula (6), $X^{61}$ to $X^{63}$ each independently represents a substituted or unsubstituted alkylene group, —($CR^{61}$=$CR^{62}$)$_{n6}$— (wherein $R^{61}$ and $R^{62}$ each independently represents a hydrogen atom, a substituted or unsubstituted alkyl group, or a substituted or unsubstituted aryl group; and a subscript n6 represents an integer of 1 or greater (preferably 5 or smaller), —CO—, —SO—, —$SO_2$—, an oxygen atom or a sulfur atom. $Ar^{61}$ and $Ar^{62}$ each independently represent a substituted or unsubstituted arylene group. Subscripts p6, q6, r6, s6 and t6 represent each independently integers of 0 or greater (preferably 10 or smaller, and more preferably 5 or smaller), but all of p6, q6, r6, s6 and t6 can not be 0. Here, the alkylene group preferably has 1 to 20 carbon atoms, and particularly 1 to 10 carbon atoms, and includes a methylene group, an ethylene group and a propylene group. The arylene group includes a divalent group which has removed two hydrogen atoms from benzene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene or the like. The alkyl group includes a methyl group, an ethyl group and a propyl group. The aryl group includes a phenyl group, a naphthyl group and thiophenyl group.

Substituents which may be included in each of the above described groups include a halogen atom such as a fluorine atom, a chlorine atom, a bromine atom and an iodine atom; an alkyl group such as a methyl group, an ethyl group, a propyl group and a butyl group; an aryl group such as a phenyl group, a naphthyl group, an anthryl group and a pyrenyl group; an aralkyl group such as a benzyl group, a phenethyl group, a naphthyl methyl group, a furfuryl group and a thienyl group; an alkoxy group such as a methoxy group, an ethoxy group and a propoxy group; an aryloxy, group such as a phenoxy group and a naphthoxy group; a substituted amino group such as a dimethylamino group, a diethyl amino group, a dibenzyl amino group, a diphenyl amino group and a di(p-tolyl)amino group; an arylvinyl group such as a styryl group and a naphthyl vinyl group; a nitro group; a cyano group; and a hydroxyl group.

In the above described Formula (7), $X^{71}$ and $X^{72}$ represents each independently a substituted or unsubstituted alkylene group, —($CR^{71}$=$CR^{7}$)$_{n7}$— (wherein $R^{71}$ and $R^{72}$ represents each independently a hydrogen atom, a substituted or unsubstituted alkyl group or a substituted or unsubstituted aryl group; and a subscript n7 represents an integer of 1 or greater (preferably 5 or smaller)), —CO— or an oxygen atom; $Ar^{71}$ represents a substituted or unsubstituted arylene group; subscripts p7, q7 and r7 represents each independently integers of 0 or greater (preferably 10 or smaller, and further preferably 5 or smaller), but all of p7, q7 and r7 can not be 0. Here, the alkylene group preferably has 1 to 20 carbon atoms, and particularly 1 to 10 carbon atoms, and includes a methylene group, an ethylene group and a propylene group. The arylene group includes a divalent group which has removed two hydrogen atoms from benzene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene or the like. The alkyl group includes a methyl group, an ethyl group and a propyl group. The aryl group includes a phenyl group, a naphthyl group and thiophenyl group.

Substituents which may be included in each of the above described groups include a halogen atom such as a fluorine atom, a chlorine atom, a bromine atom and an iodine atom; an alkyl group such as a methyl group, an ethyl group, a propyl group and a butyl group; an aryl group such as a phenyl group, a naphthyl group, an anthryl group and a pyrenyl group; an aralkyl group such as a benzyl group, a phenethyl group, a naphthyl methyl group, a furfuryl group and a thienyl group; an alkoxy group such as a methoxy group, an ethoxy group and a propoxy group; an aryloxy group such as a phenoxy group and a naphthoxy group; a substituted amino group such as a dimethylamino group, a diethyl amino group, a dibenzyl amino group, a diphenyl amino group and a di(p-tolyl)amino group; an arylvinyl group such as a styryl group and a naphthyl vinyl group; a nitro group; a cyano group; and a hydroxyl group.

Preferred examples of a hole-transporting compound having two or more chain-polymerizable functional groups (examples of the compound) are listed below.

| No. | Examples of the compound |
|---|---|
| 1 | 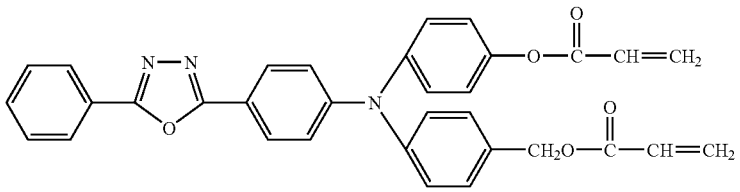 |
| 2 | 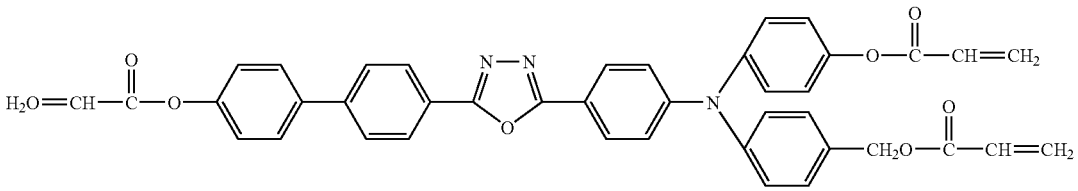 |

-continued
| No. | Examples of the compound |
|---|---|
| 3 | 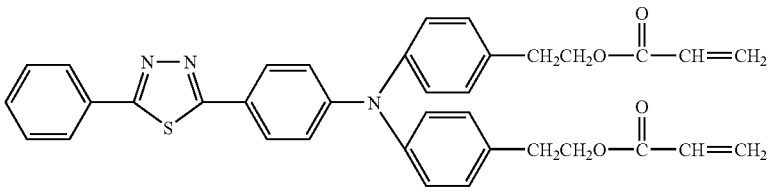 |
| 4 | 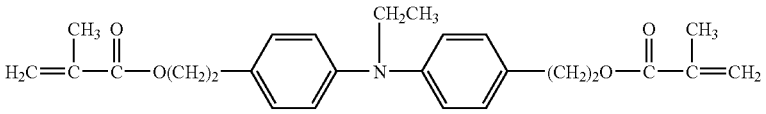 |
| 5 | 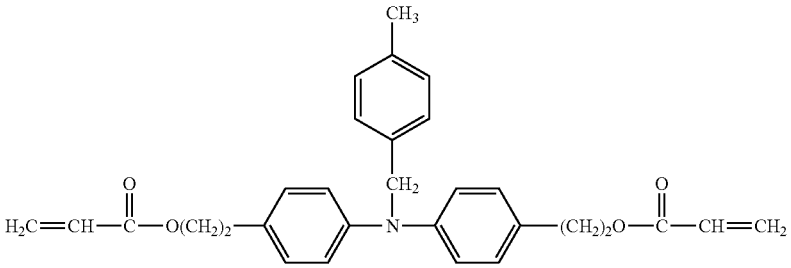 |
| 6 | 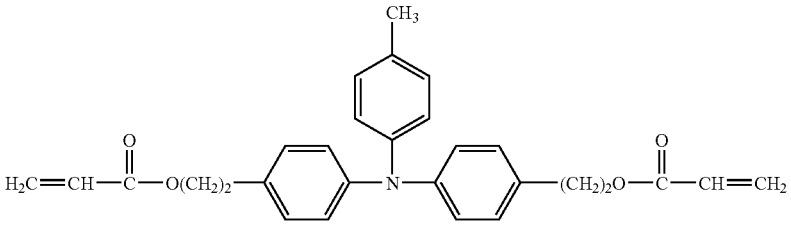 |
| 7 | 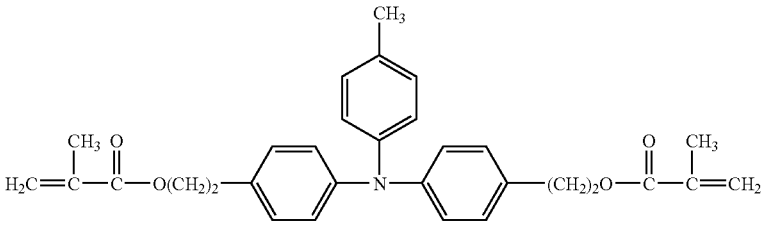 |
| 8 | 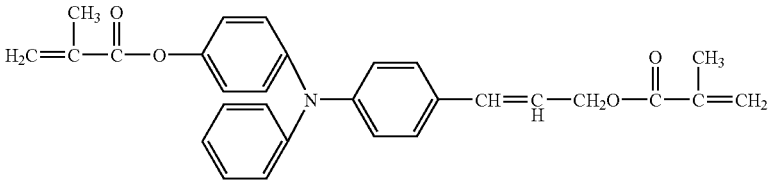 |
| 9 | 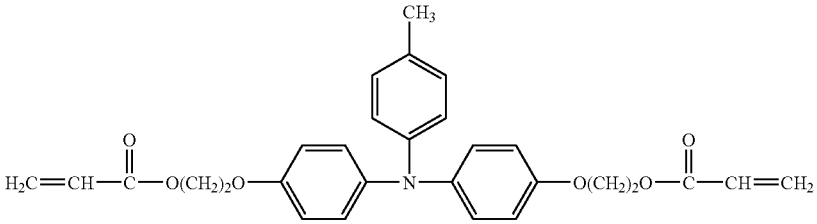 |

-continued
| No. | Examples of the compound |
|---|---|
| 10 | 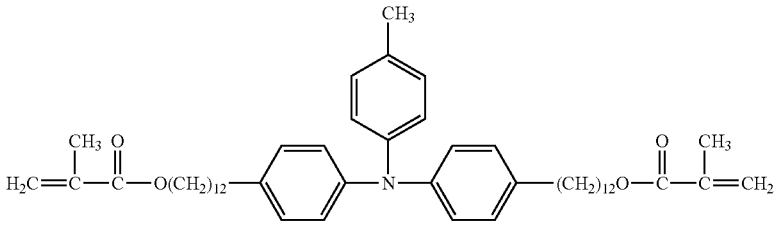 |
| 11 | 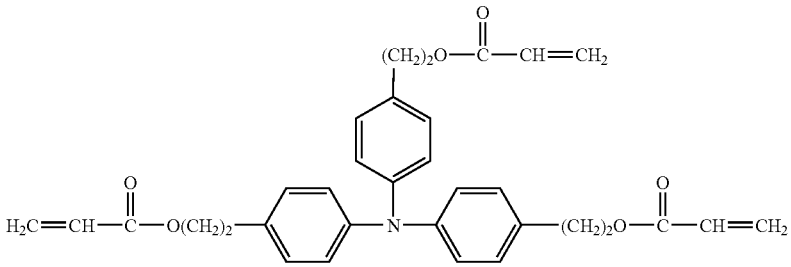 |
| 12 | 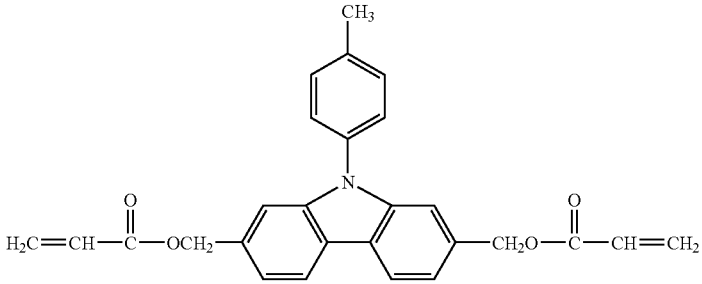 |
| 13 | 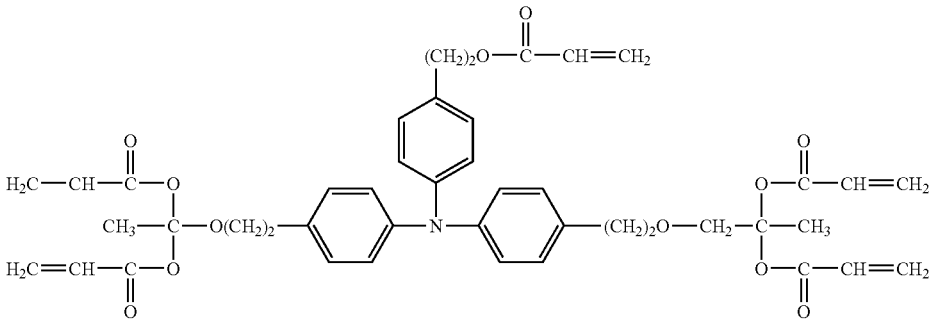 |
| 14 | 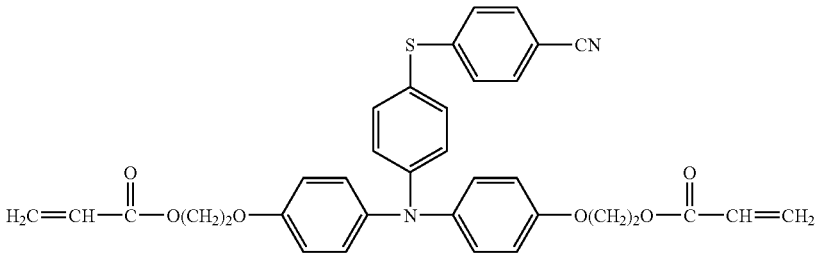 |

-continued
| No. | Examples of the compound |
|---|---|
| 15 | 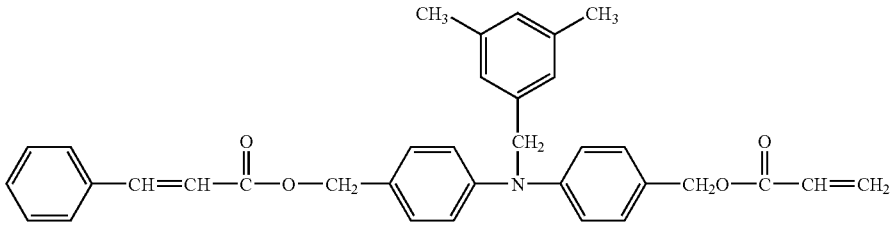 |
| 16 | 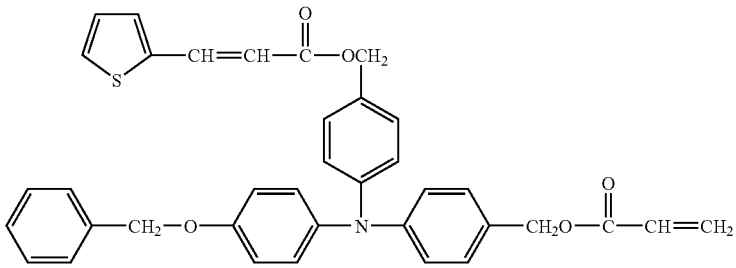 |
| 17 | 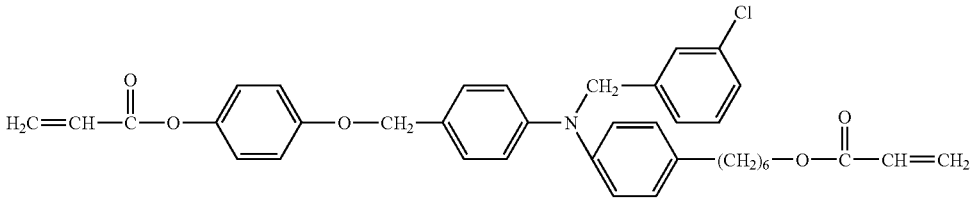 |
| 18 | 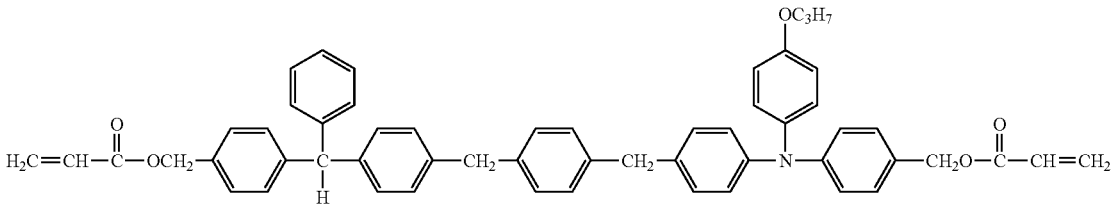 |
| 19 | 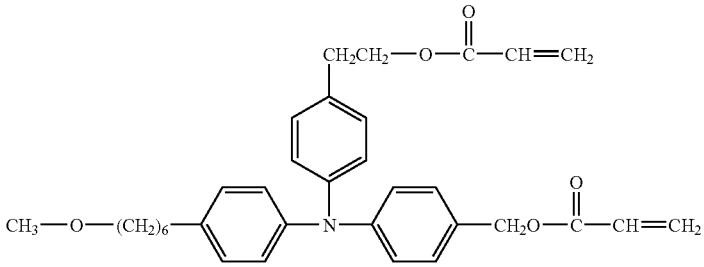 |
| 20 | 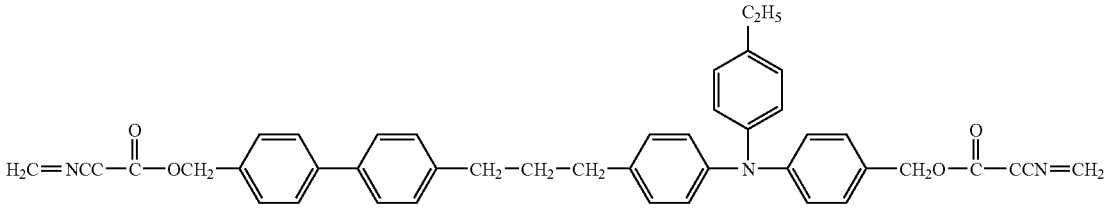 |

-continued
| No. | Examples of the compound |
|---|---|
| 21 | 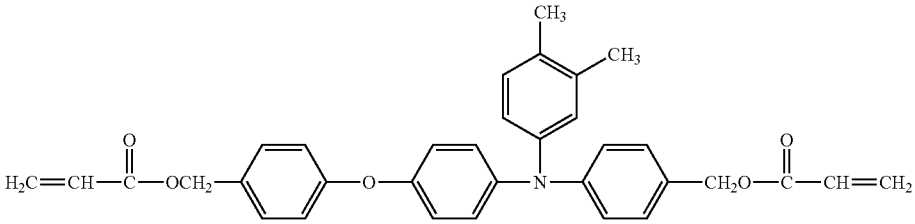 |
| 22 | 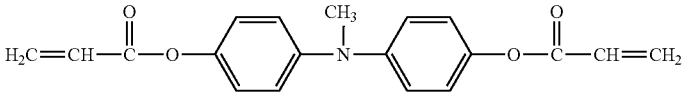 |
| 23 | 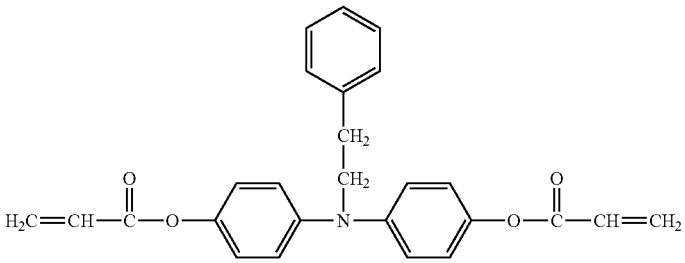 |
| 24 | 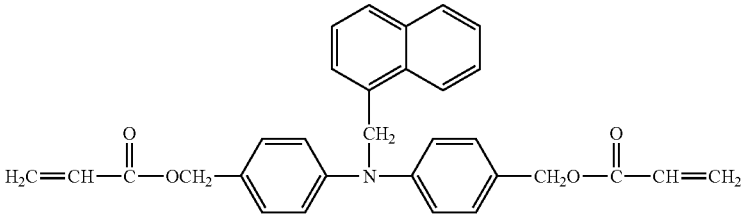 |
| 25 | 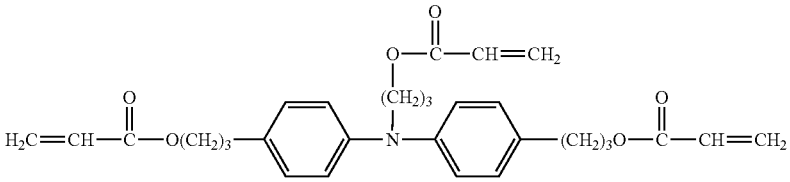 |
| 26 | 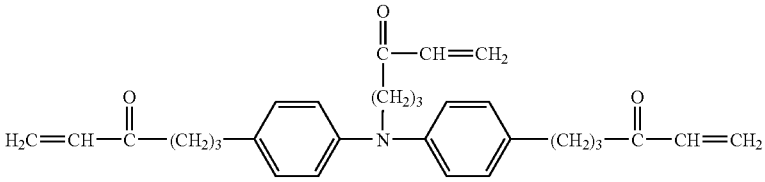 |
| 27 | 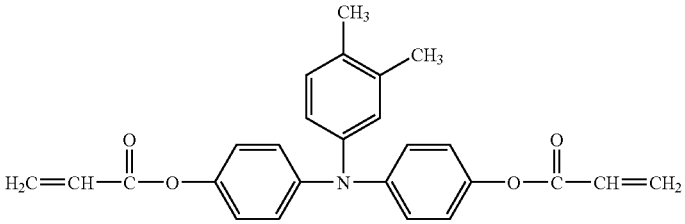 |

-continued
| No. | Examples of the compound |
|---|---|
| 28 | 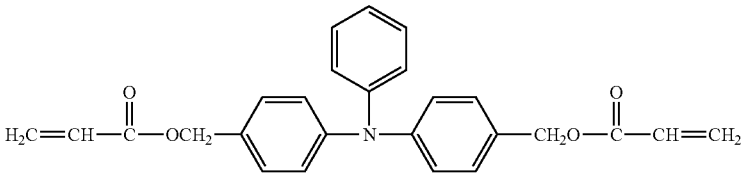 |
| 29 | 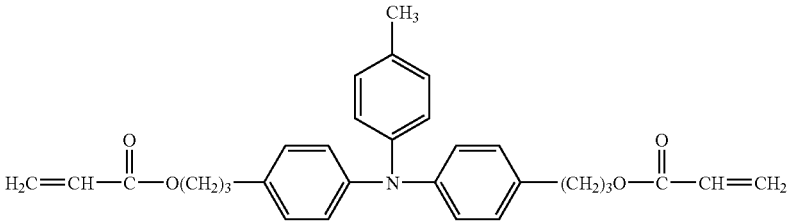 |
| 30 | 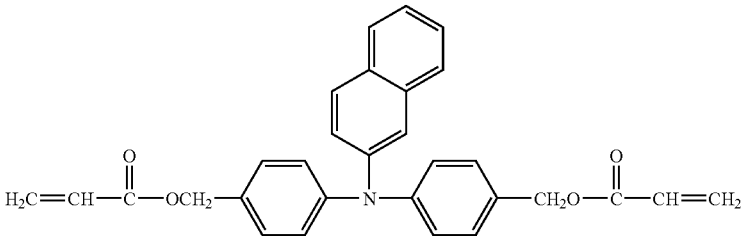 |
| 31 | 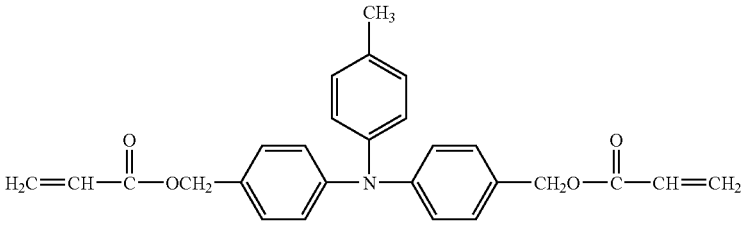 |
| 32 | 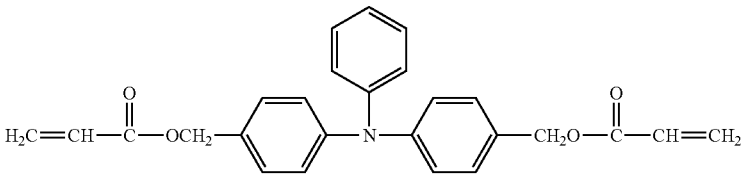 |
| 33 | 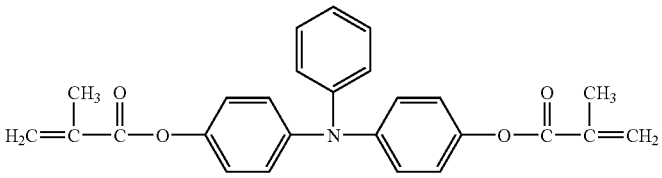 |
| 34 | 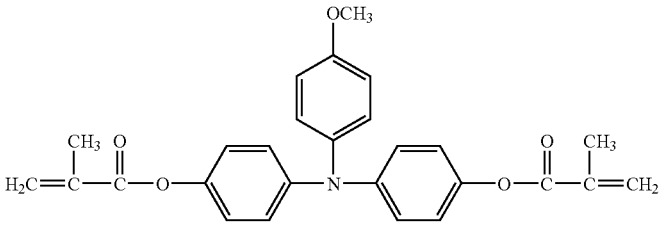 |

-continued
| No. | Examples of the compound |
|---|---|
| 35 | 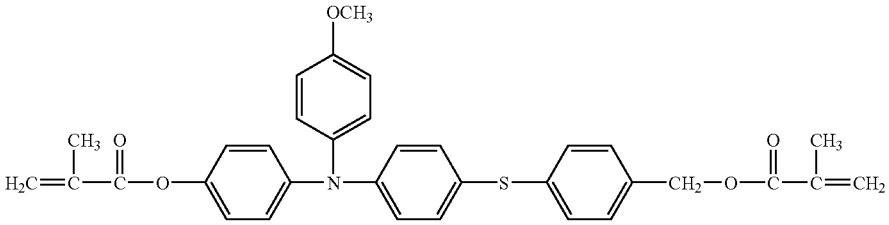 |
| 36 | 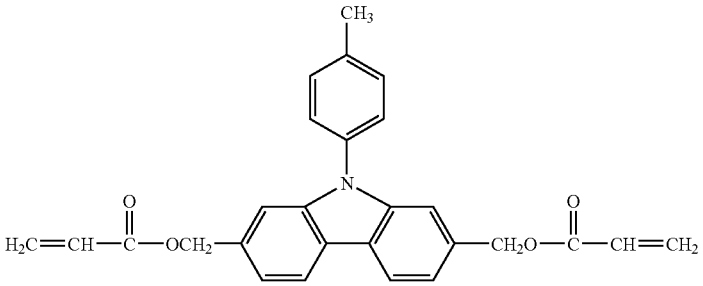 |
| 37 | 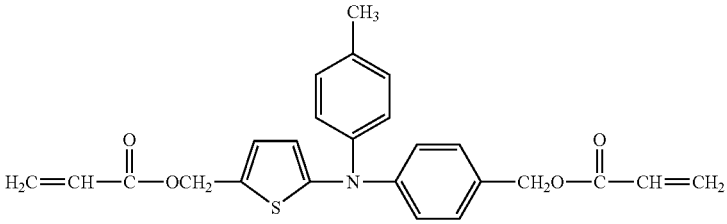 |
| 38 | 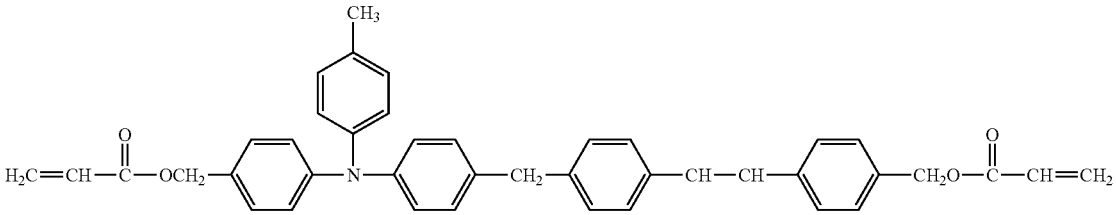 |
| 39 | 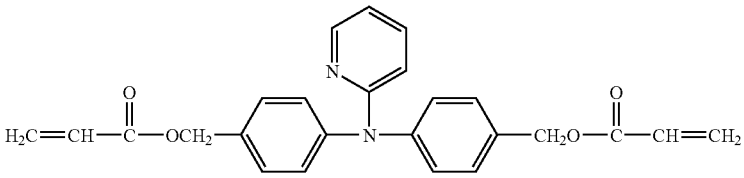 |
| 40 | 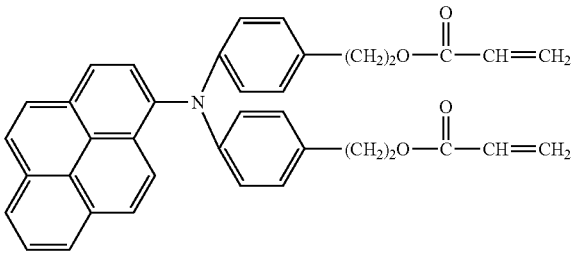 |

-continued
| No. | Examples of the compound |
|---|---|
| 41 | 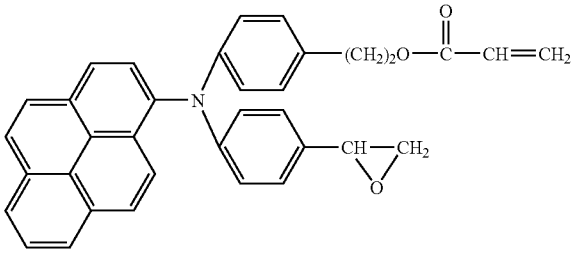 |
| 42 | 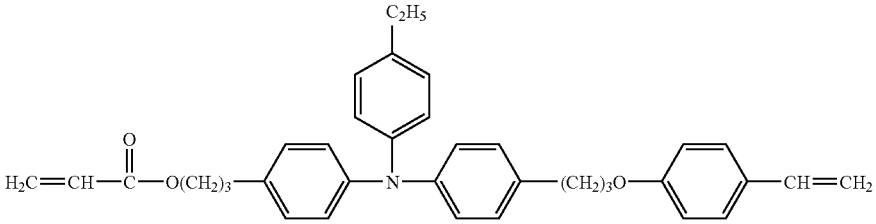 |
| 43 | 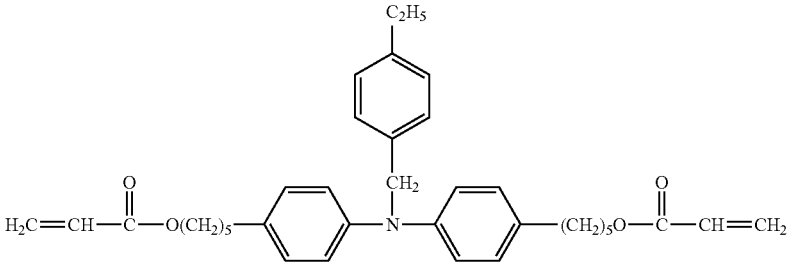 |
| 44 | 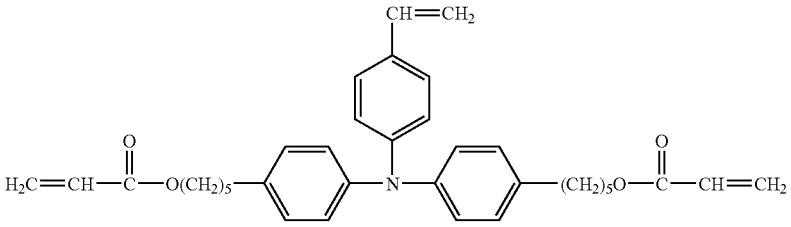 |
| 45 | 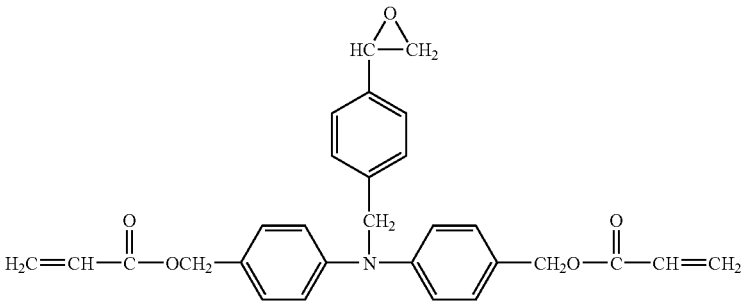 |
| 46 | 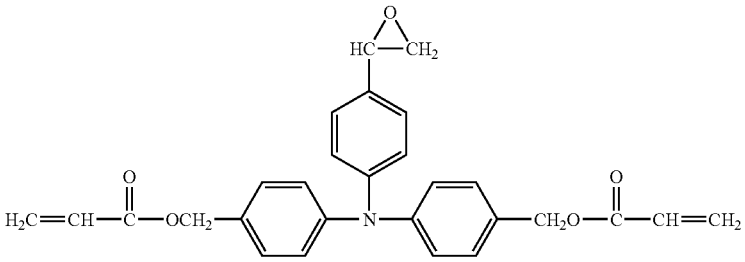 |

-continued
| No. | Examples of the compound |
|---|---|
| 47 | 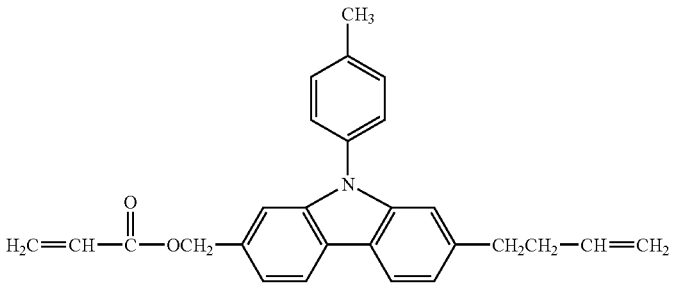 |
| 48 | 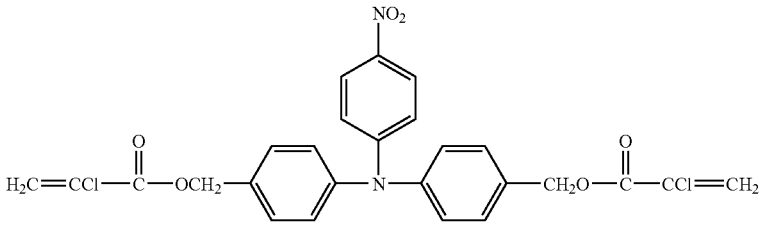 |
| 49 | 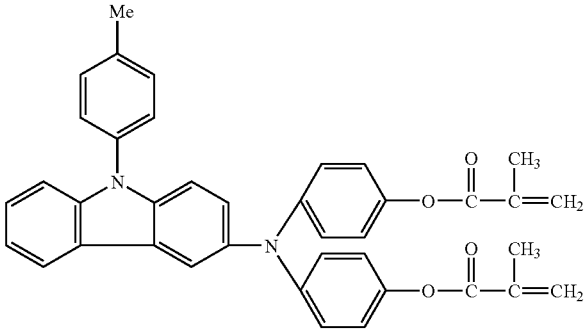 |
| 50 | 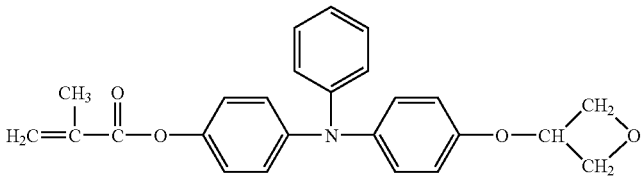 |
| 51 | 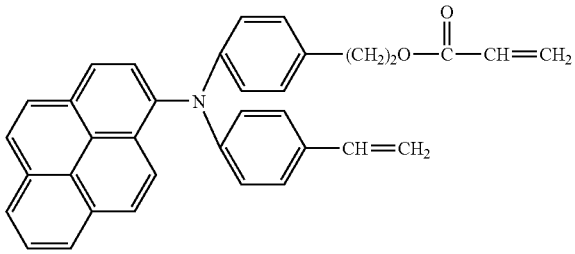 |
| 52 | 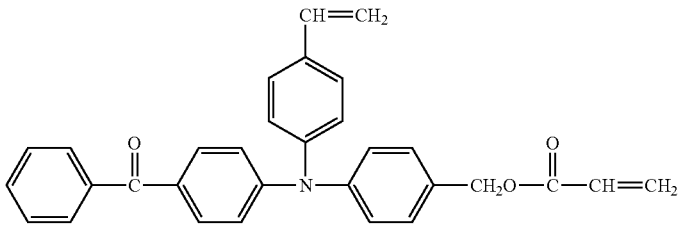 |

-continued
| No. | Examples of the compound |
|---|---|
| 53 | 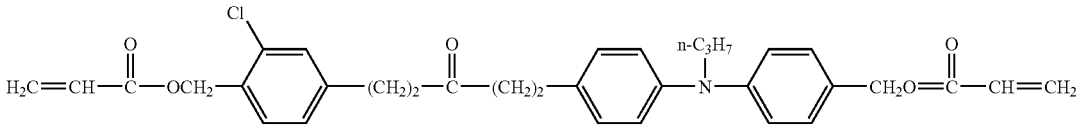 |
| 54 | 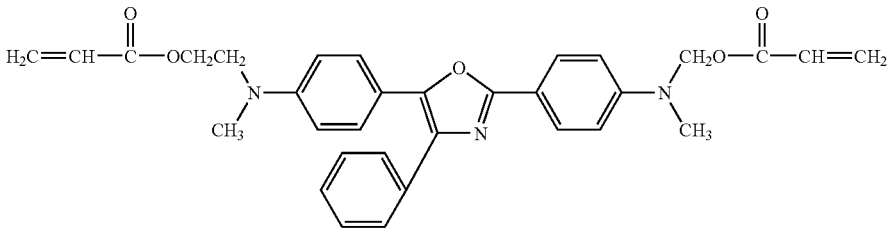 |
| 55 | 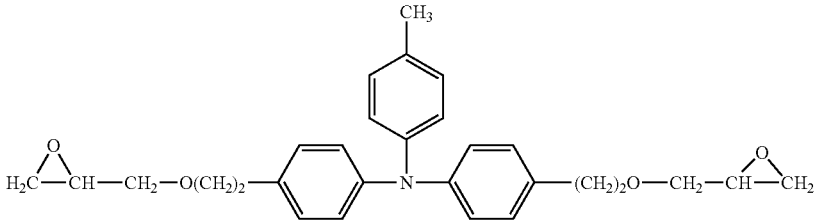 |
| 56 | 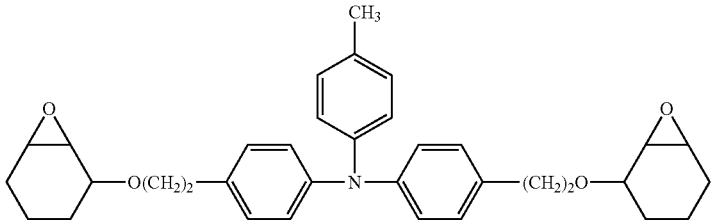 |
| 57 | 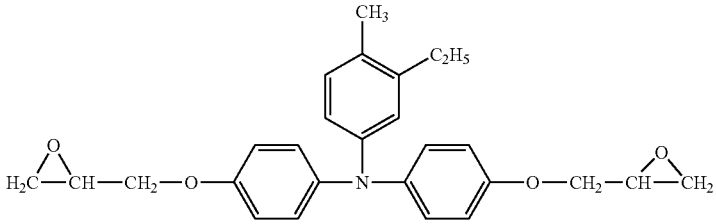 |
| 58 | 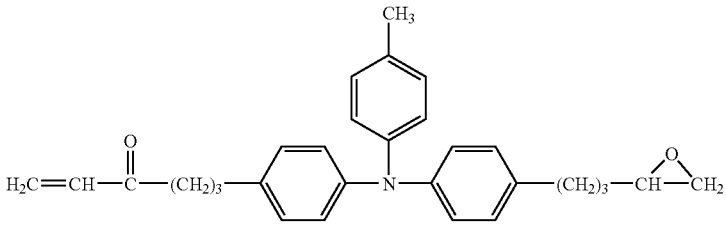 |

-continued
| No. | Examples of the compound |
|---|---|
| 59 | 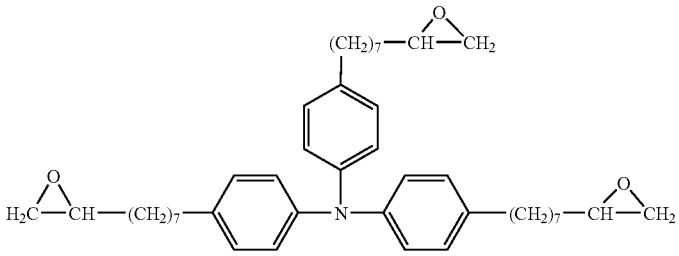 |
| 60 | 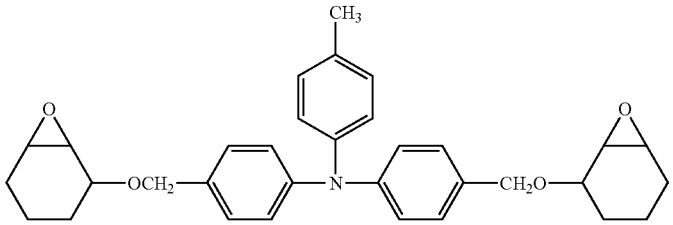 |
| 61 | 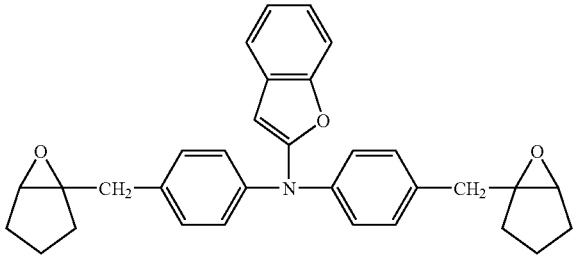 |
| 62 | 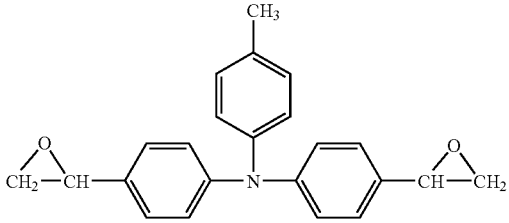 |
| 63 | 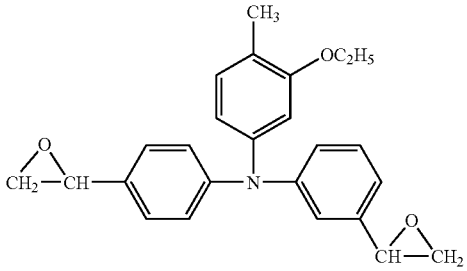 |
| 64 | 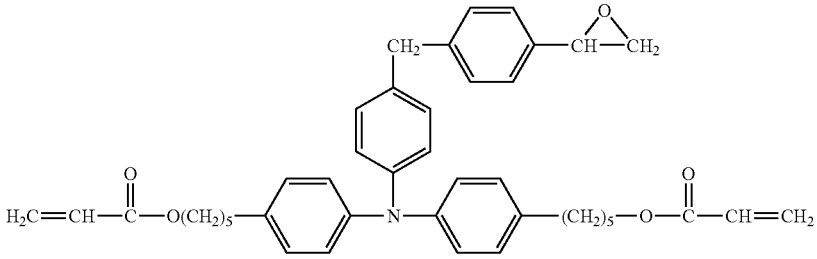 |

-continued
| No. | Examples of the compound |
|---|---|
| 65 | 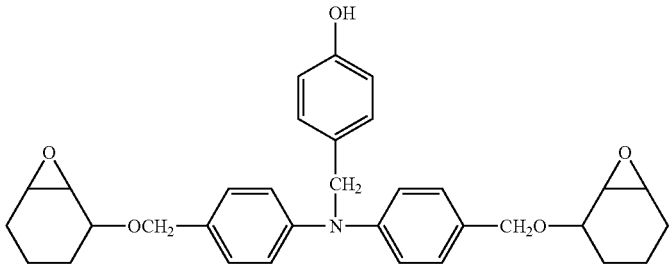 |
| 66 | 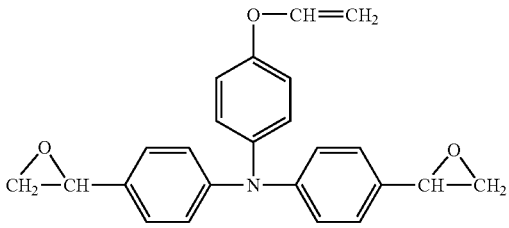 |
| 67 | 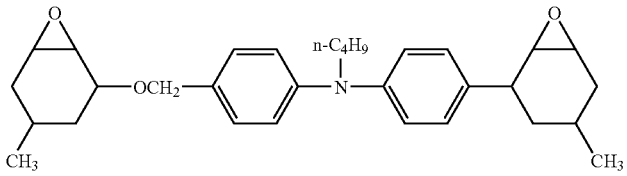 |
| 68 | 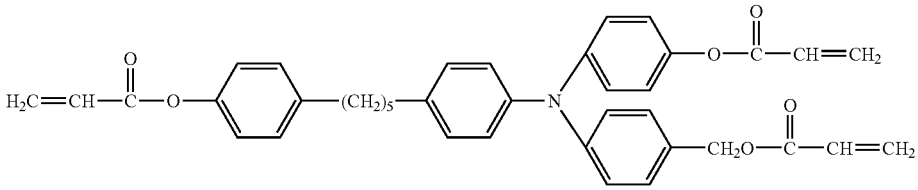 |
| 69 | 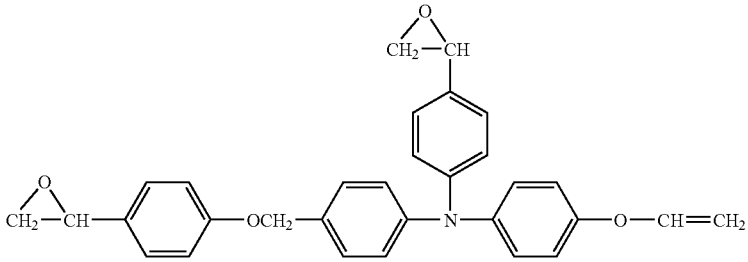 |
| 70 | 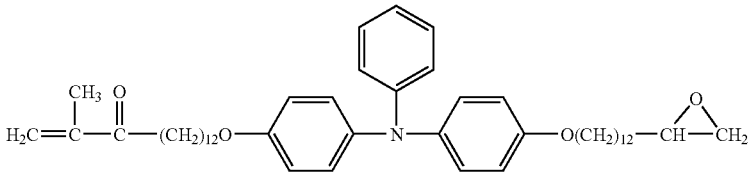 |

-continued
| No. | Examples of the compound |
|---|---|
| 71 | 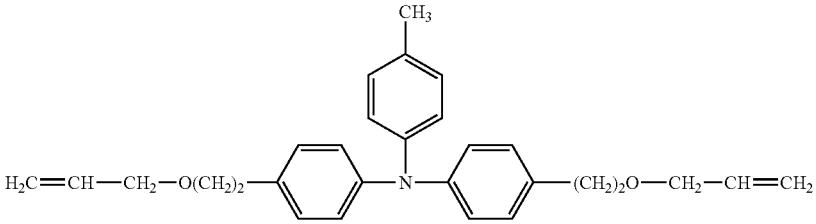 |
| 72 | 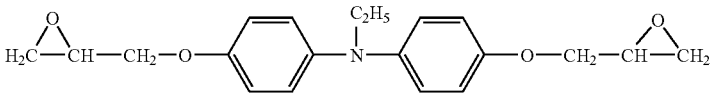 |
| 73 | 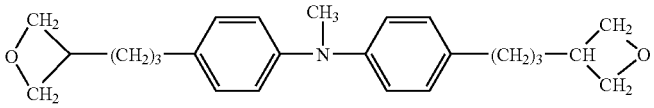 |
| 74 | 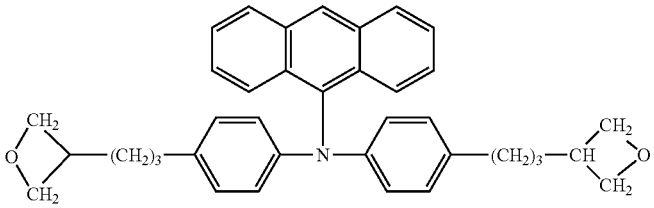 |
| 75 | 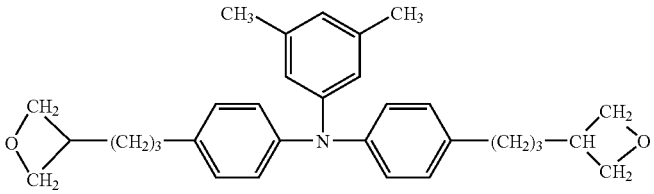 |
| 76 | 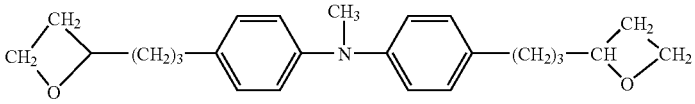 |
| 77 | 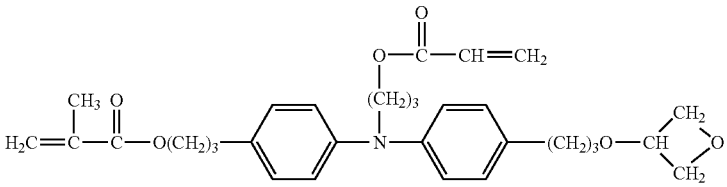 |
| 78 | 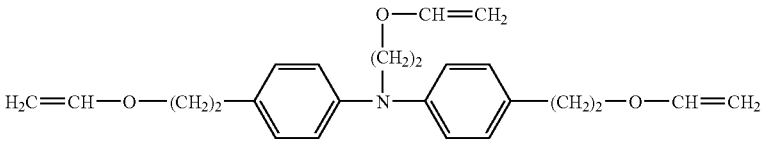 |

-continued
| No. | Examples of the compound |
|---|---|
| 79 | 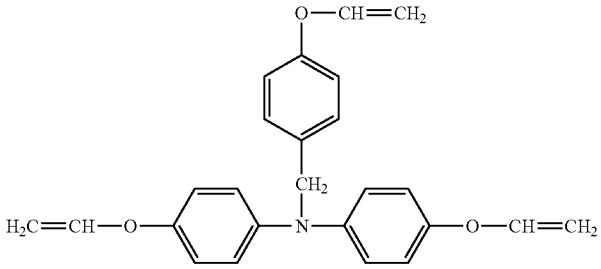 |
| 80 | 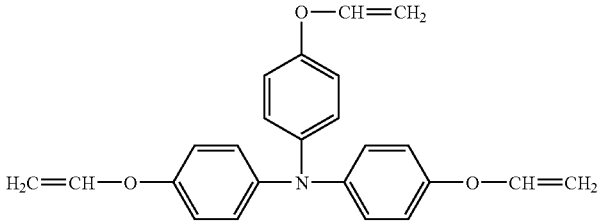 |
| 81 | 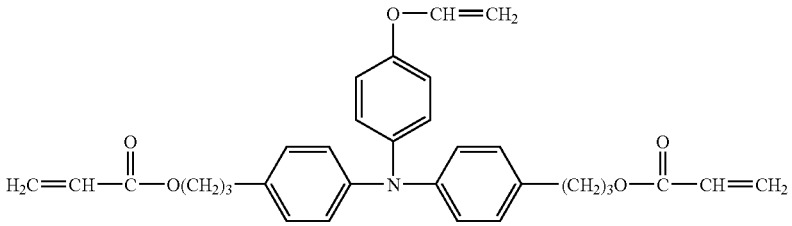 |
| 82 | 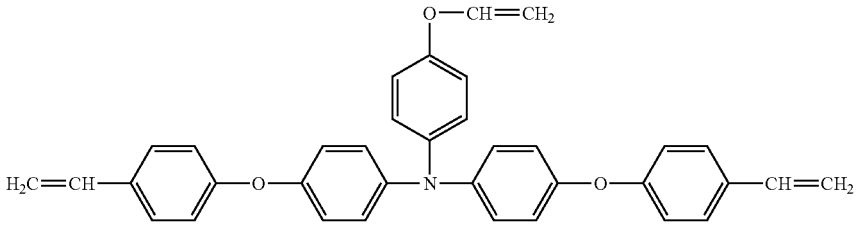 |
| 83 | 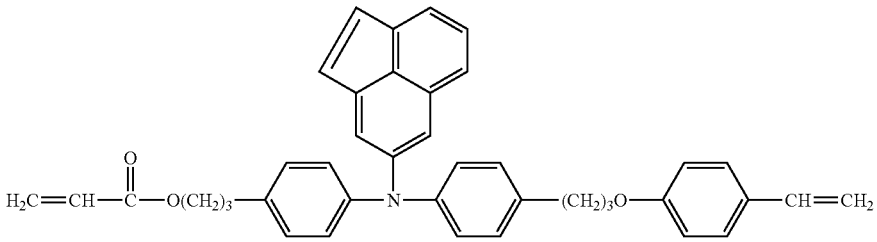 |
| 84 | 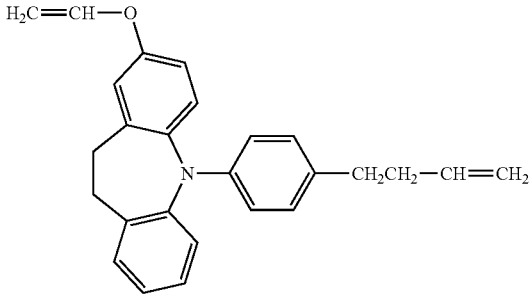 |

-continued
| No. | Examples of the compound |
|---|---|
| 85 | 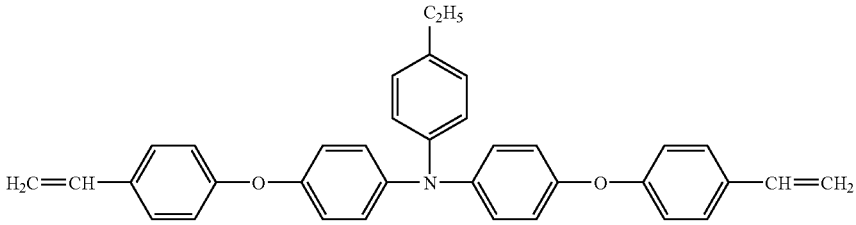 |
| 86 | 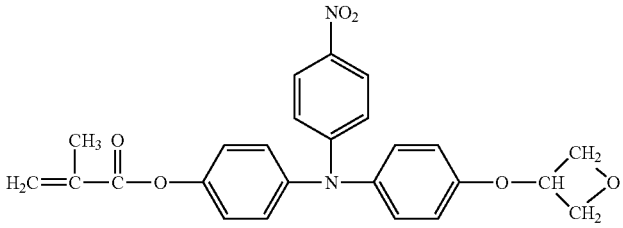 |
| 87 | 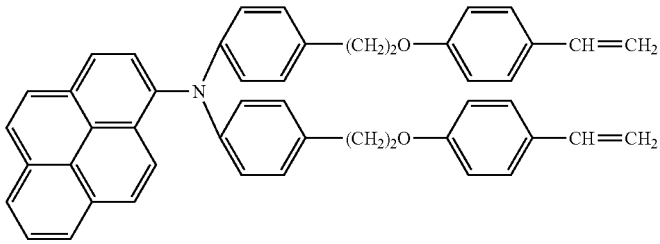 |
| 88 | 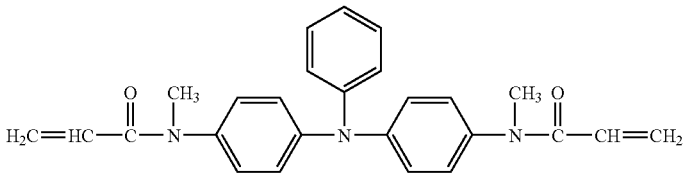 |
| 89 | 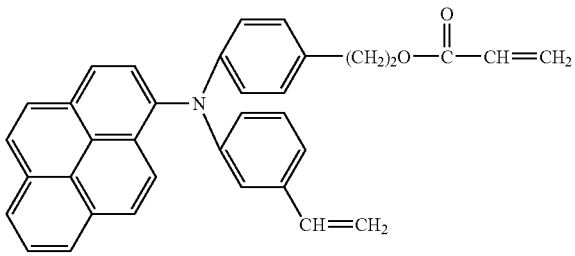 |
| 90 | 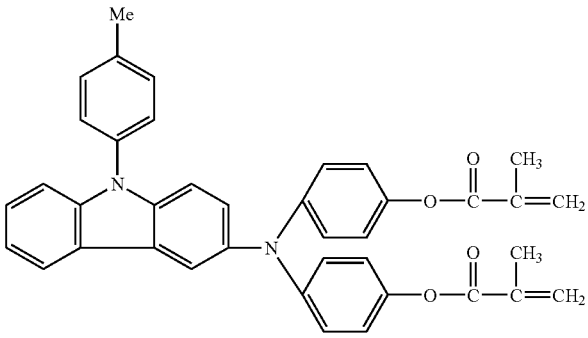 |

-continued
| No. | Examples of the compound |
|---|---|
| 91 | 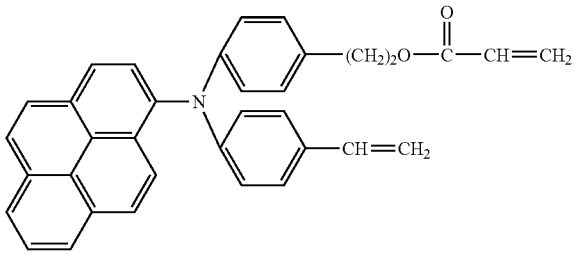 |
| 92 | 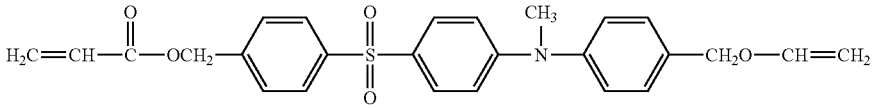 |
| 93 | 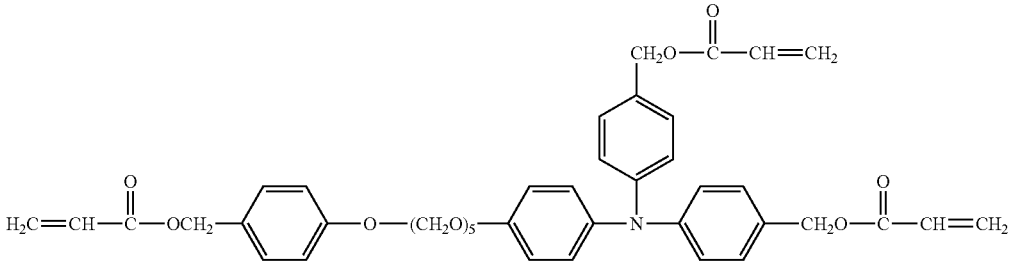 |
| 94 | 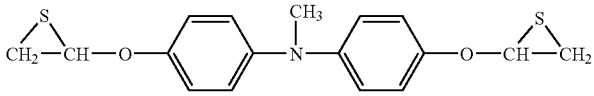 |
| 95 | 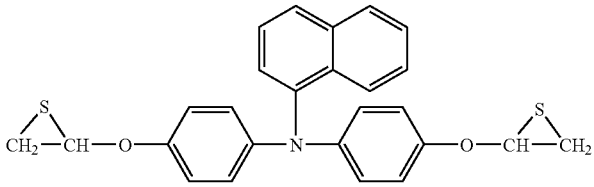 |
| 96 | 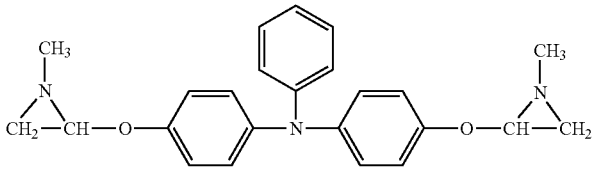 |
| 97 | 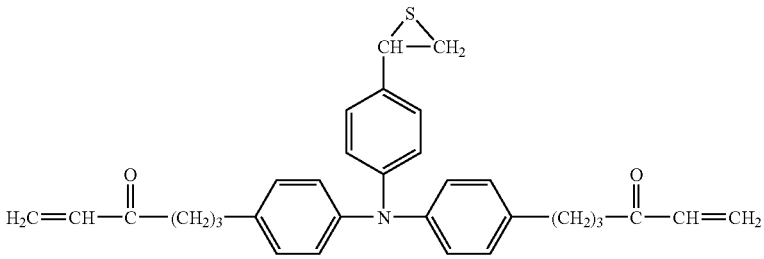 |

-continued
| No. | Examples of the compound |
|---|---|
| 98 | 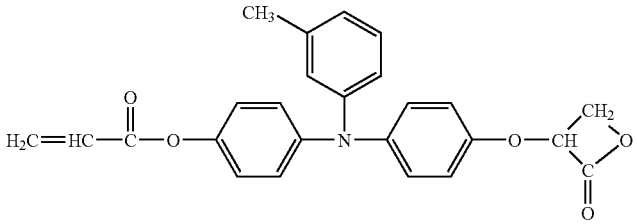 |
| 99 | 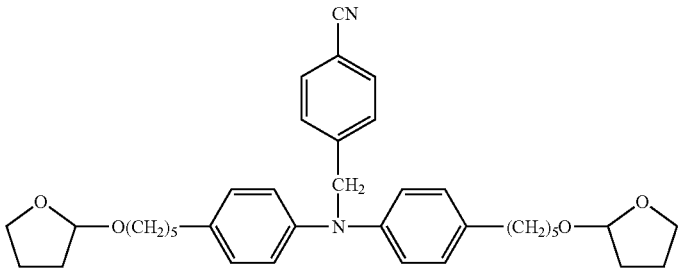 |
| 100 | 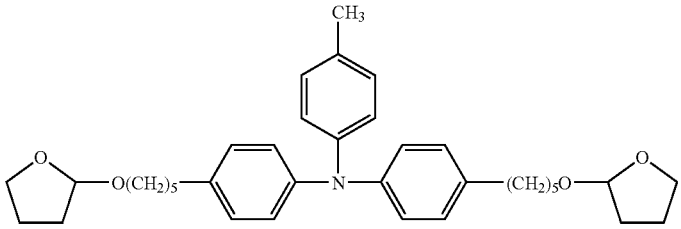 |
| 101 | 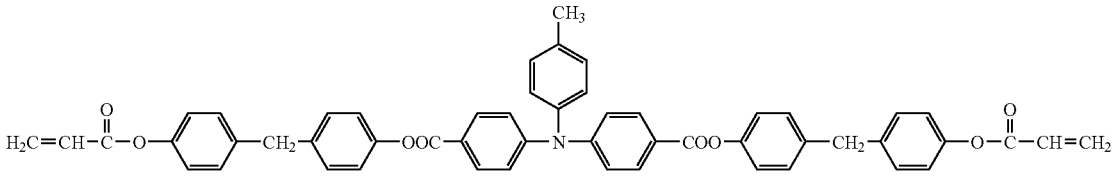 |
| 102 | 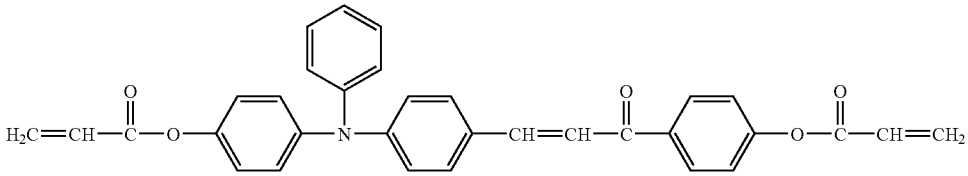 |
| 103 | 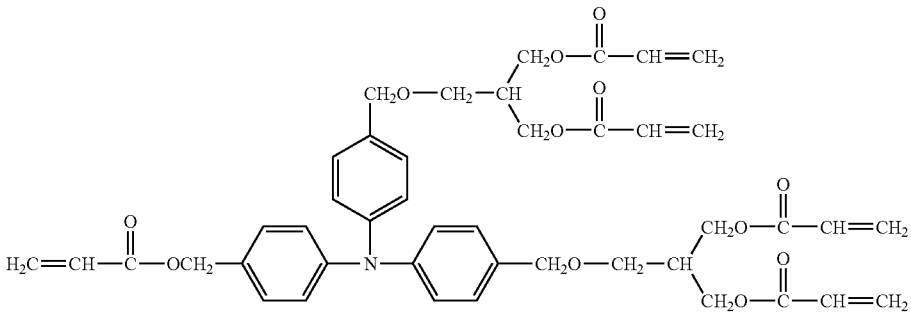 |

-continued
| No. | Examples of the compound |
|---|---|
| 104 | 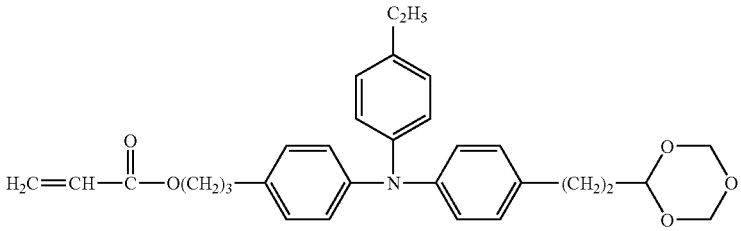 |
| 105 | 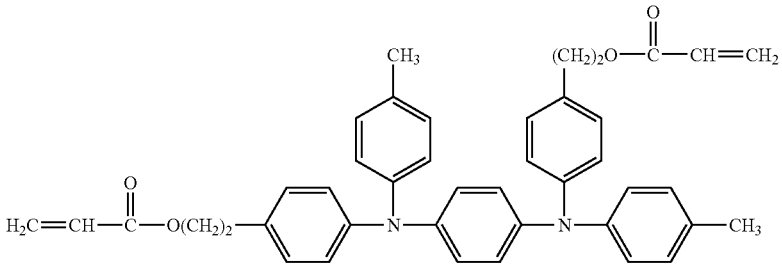 |
| 106 | 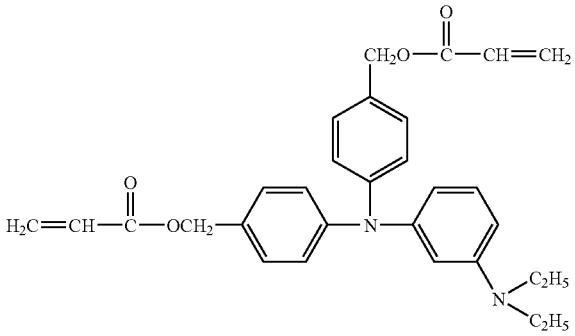 |
| 107 | 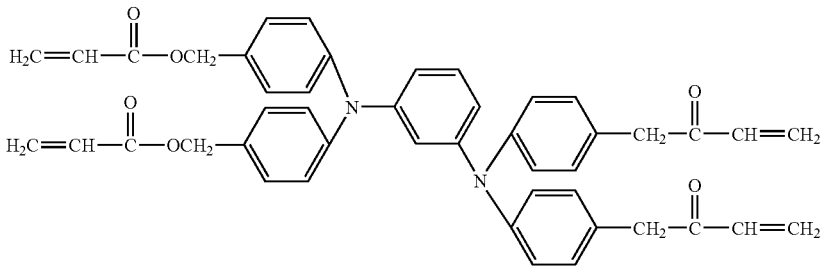 |
| 108 | 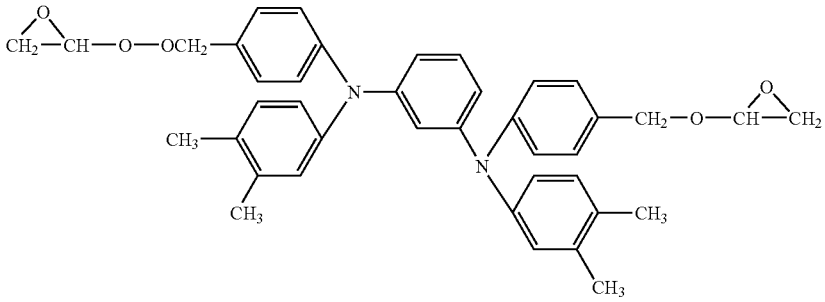 |

-continued
| No. | Examples of the compound |
|---|---|
| 109 | 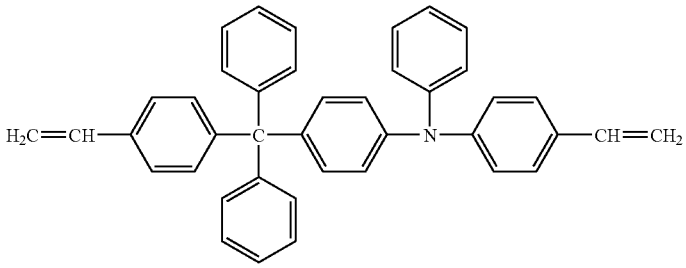 |
| 110 | 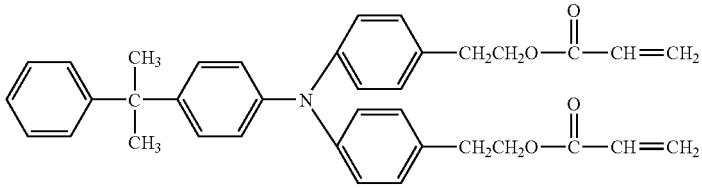 |
| 111 | 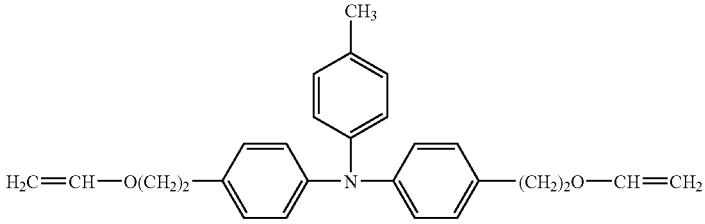 |
| 112 | 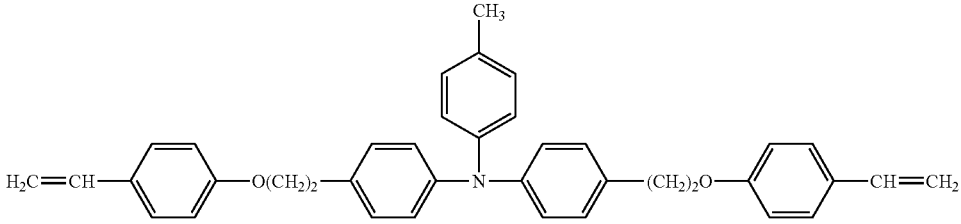 |
| 113 | 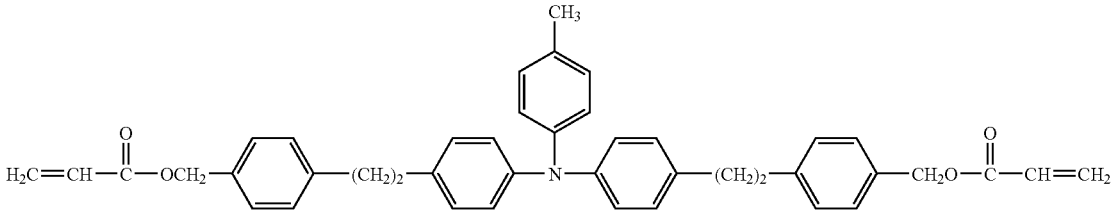 |
| 114 | 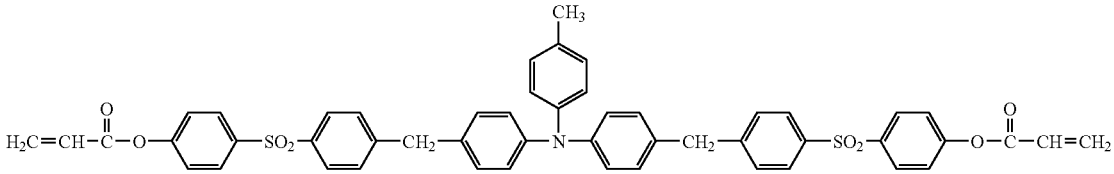 |
| 115 | 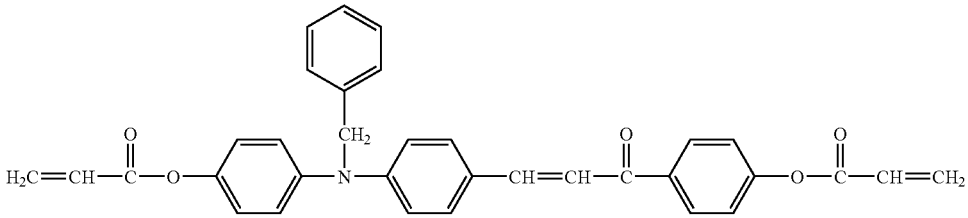 |

-continued

| No. | Examples of the compound |
|---|---|
| 116 | 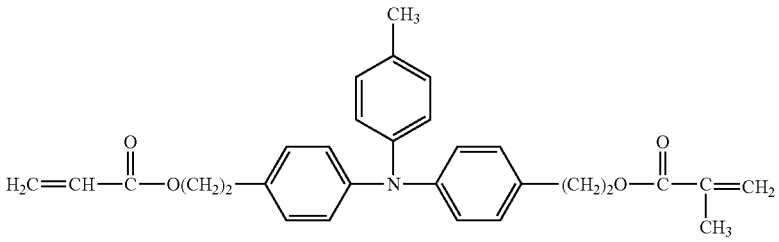 |
| 117 | 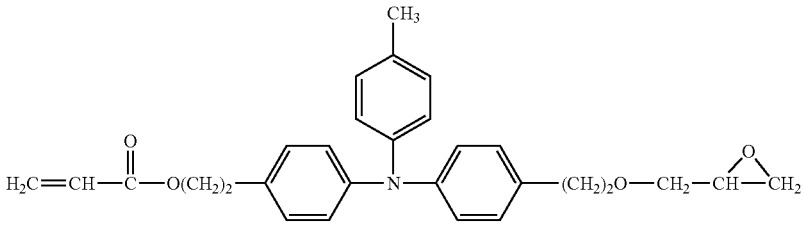 |
| 118 | 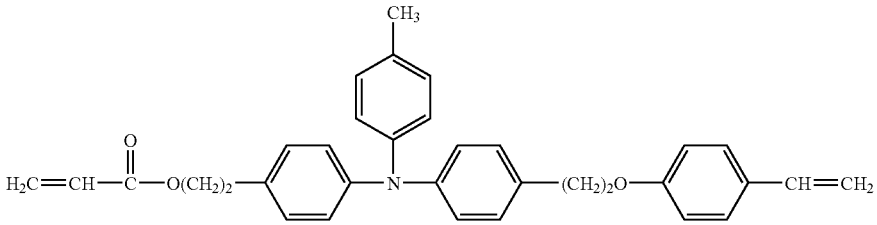 |
| 119 | 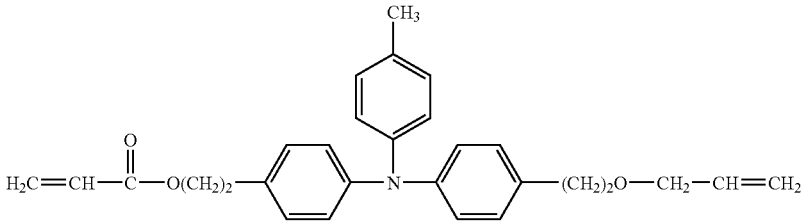 |

Subsequently, an electrophotographic photosensitive member according to the present invention including layers other than a surface layer will be described further in detail.

As described above, an electrophotographic photosensitive member according to the present invention is a cylindrical electrophotographic photosensitive member having a support (a cylindrical support) and an organic photosensitive layer (hereinafter simply called "a photosensitive layer") provided on the support (the cylindrical support).

The photosensitive layer may be a monolayer-type photosensitive layer containing a charge-transporting material and a charge-generating material in the same layer, or a multilayer-type (a function-separating-type) photosensitive layer having a charge-generating layer containing a charge-generating material and a charge-transporting layer containing a charge-transporting material, separated from each other, but the multilayer-type photosensitive layer is preferable from the viewpoint of electrophotographic characteristics. In the multilayer-type photosensitive layer, there are two types of a normal-order-type photosensitive layer formed of, in an order closer to a support, a charge-generating layer and the charge-transporting layer, and a reverse-order-type photosensitive layer formed of, in an order closer to the support, a charge-transporting layer and a charge-generating layer, but the normal-order-type photosensitive layer is preferable from the viewpoint of electrophotographic characteristics. In addition, each of the charge-generating layer and the charge-transporting layer may have a layered structure.

FIG. 4A to 4I show the examples of a layer configuration of an electrophotographic photosensitive member according to the present invention.

Figure 4A:
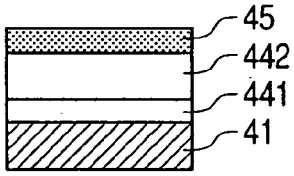
FIG. 4A is one example of a layer configuration of an electrophotographic photosensitive member according to the present invention.

An electrophotographic photosensitive member with a layer configuration shown in FIG. 4A has sequentially a layer 441 (a charge-generating layer) containing a charge-generating material provided on a support 41, a layer (a first charge-transporting layer) containing a charge-transporting material 442, and further a layer 45 (second charge-transporting layer) formed by polymerizing a hole-transporting compound having a chain-polymerizable functional group, arranged thereon as a surface layer. In this case, the first charge-transporting layer of 442 shall be a surface underlayer.

Figure 4B:
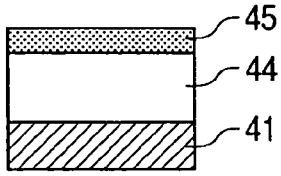
FIG. 4B is another example of a layer configuration of an electrophotographic photosensitive member according to the present invention.

An electrophotographic photosensitive member having a layer configuration shown in FIG. 4B has a layer 44 containing a charge-generating material and a charge-transporting material provided on a support 41, and a layer 45 further formed thereon as a surface layer by polymerizing a hole-transporting compound having a chain-polymerizable functional group.

Figure 4C:
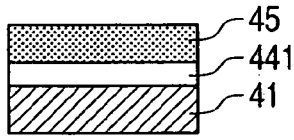
FIG. 4C is another example of a layer configuration of an electrophotographic photosensitive member according to the present invention.

An electrophotographic photosensitive member having a layer configuration shown in FIG. 4C has a layer 441 containing a charge-generating material (a charge-generating layer) provided on a support 41, and a layer 45 directly thereon formed as a surface layer by polymerizing a hole-transporting compound having a chain-polymerizable functional group. In this case, a charge-generating layer shall be a surface underlayer.

In addition, as shown in FIGS. 4D to 4I, an intermediate layer 43 (also called "a subbing layer") having a barrier function and an adhesive function, and an electroconductive layer 42 for preventing an interference pattern may be arranged between a support 41 and a layer 441 (a charge-generating layer) containing a charge-generating material, or between the support 41 and a layer 44 containing a charge-generating material and a charge-transporting material.

Figure 4D:
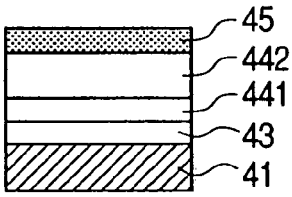
FIG. 4D is further another example of a layer configuration of an electrophotographic photosensitive member according to the present invention.
Figure 4E:
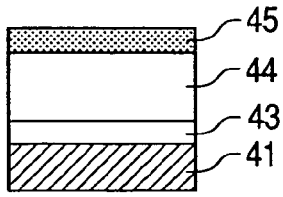
FIG. 4E is another example of a layer configuration of an electrophotographic photosensitive member according to the present invention.
Figure 4F:
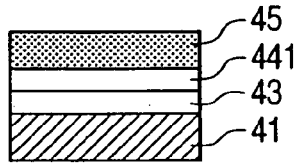
FIG. 4F is further another example of a layer configuration of an electrophotographic photosensitive member according to the present invention.
Figure 4G:
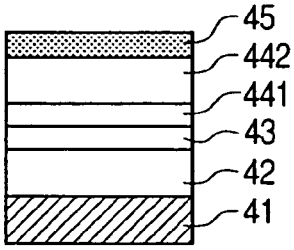
FIG. 4G is another example of a layer configuration of an electrophotographic photosensitive member according to the present invention.
Figure 4H:
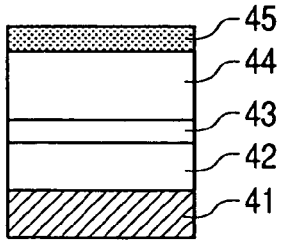
FIG. 4H is further another example of a layer configuration of an electrophotographic photosensitive member according to the present invention.
Figure 4I:
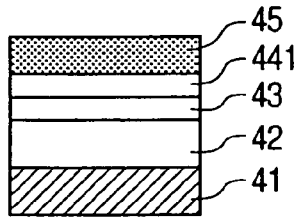
FIG. 4I is further another example of a layer configuration of an electrophotographic photosensitive member according to the present invention.

In addition to the above examples, any other layer configuration is available (for instance, eliminating a layer formed by polymerizing a hole-transporting compound having a chain-polymerizable functional group), but when employing a layer formed by polymerizing a hole-transporting compound having a chain-polymerizable functional group as the surface layer of an electrophotographic photosensitive member, layer configurations shown in FIGS. 4A, 4D and 4G are preferable among layer configurations shown in FIGS. 4A to 4I.

A support has only to show electroconductivity (to be an electroconductive support), and a support made of a metal such as iron, copper, gold, silver, aluminum, zinc, titanium, lead, nickel, tin, antimony and indium, can be used.

In addition, the above described support made of a metal or a plastic support having a layer of aluminum, an aluminum alloy and an indium oxide-stannic oxide alloy film-formed thereon by vacuum deposition can be used. In addition, a support containing electroconductive particles such as carbon black, stannic oxide particles, titanium oxide particles and silver particles together with an adequate binder resin impregnated in plastic or paper, or a plastic support containing an electroconductive binder resin can be used.

In addition, the surface of a support may be machined, roughened or anodized, for the purpose of preventing the surface from causing an interference pattern due to the scattering of a laser beam or the like.

As described above, an electroconductive layer for preventing the interference pattern due to the scattering of the laser beam or the like, or for coating the scratches of a support may be arranged between the support and a photosensitive layer (a charge-generating layer and/or a charge-transporting layer), or between the support and an intermediate layer which will be described later.

An electroconductive layer can be formed by dispersing electroconductive particles such as carbon black, metallic particles and metallic oxide particles in a binder resin.

An electroconductive layer preferably has a thickness of 1 to 40 μm, and more preferably of particularly 2 to 20 μm.

In addition, as described above, an intermediate layer having a barrier function and an adhesive function may be arranged between a support or an electroconductive layer and a photosensitive layer (a charge-generating layer and/or a charge-transporting layer). The intermediate layer is formed for improving the adhesiveness, applicability, and the charge implantability from a support of a photosensitive layer, and protecting a photosensitive layer from electrical breakdown.

The intermediate layer can be formed by using a binder resin mainly such as a polyester resin, a polyurethane resin, a polyacrylate resin, a polyethylene resin, a polystyrene resin, a polybutadiene resin, a polycarbonate resin, a polyamide resin, a polypropylene resin, a polyimide resin, a phenol resin, an acrylic resin, a silicone resin, an epoxy resin, a urea resin, an allyl resin, an alkyd resin, a polyamide-imide resin, a nylon resin, a polysulfone resin, a polyallyl ether resin, a polyacetal resin and a butyral resin. In addition, the intermediate layer may contain a metal, an alloy, an oxide thereof, a salt or a surface active agent.

An intermediate layer has the thickness preferably of 0.05 to 7 μm, and more preferably of 0.1 to 2 μm.

A charge-generating material used in an electrophotographic photosensitive member according to the present invention includes, for instance, selenium-tellurium, pyrylium, thiapyrylium-based dye, phthalocyanine pigment having various central metals and crystals (α, β, γ, ϵ and X types), anthoanthrone pigment, dibenzpyrenequinone pigment and pyranthrone pigment, azo pigment such as monoazo pigment, disazo pigment and trisazo pigment, indigo pigment, quinacridone pigment, asymmetrical quinocyanine pigment, quinocyanine pigment and amorphous silicon. One or more materials among the above charge-generating materials may be used.

A charge-transporting material used in an electrophotographic photosensitive member according to the present invention includes, in addition to the above described hole-transporting compound having a chain-polymerizable functional group, for instance, a pyrene compound, an N-alkylcarbazole compound, a hydrazone compound, an N,N-dialkylaniline compound, a diphenylamine compound, a triphenylamine compound, a triphenylmethane compound, a pyrazoline compound, a styryl compound and a stilbene compound.

When allotting functions of a photosensitive layer to each of a charge-generating layer and a charge-transporting layer, the charge-generating layer can be formed by applying a coating solution for the charge-generating layer resulting by dispersing a charge-generating material together with a binder resin and a solvent, and drying it. A dispersion method includes methods with the use of a homogenizer, an ultrasonic disperser, a ball mill, a vibratory ball mill, a sand mill, a roll mill, an attritor and a liquid collision type high-speed disperser. A content of the charge-generating material in a charge-generating layer preferably is 0.1 to 100 weight % with respect to the total weight of a binder resin and the charge-generating material, and more preferably is 10 to 80 weight %. In addition, the content is preferably 10 to 100 weight % with respect to the total weight of a charge-generating layer, and is more preferably 50 to 100 weight %. In addition, the above described charge-generating materials may be singly film-formed into a charge-generating layer, with a vacuum deposition method.

A charge-generating layer has the thickness preferably of 0.001 to 6 μm, and more preferably of 0.01 to 2 μm.

When allotting functions of a photosensitive layer to each of a charge-generating layer and a charge-transporting layer, the charge-transporting layer, particularly the charge-transporting layer which is not the surface layer of an electrophotographic photosensitive member, can be formed by applying a coating solution for the charge-transporting layer resulting by dissolving a charge-transporting material and a binder resin in a solvent, and drying it. In addition, a material capable of forming a film of itself among the above described charge-transporting materials can be also film-formed by itself without using a binder resin, and can function as a charge-transporting layer. A content of the charge-transporting material in a charge-transporting layer preferably is 0.1 to 100 weight % with respect to the total weight of a binder resin and the charge-transporting material, and more preferably is 10 to 80 weight %. In addition, the content is preferably 20 to 100 weight % with respect to the total weight of a charge-transporting layer, and is further preferably 30 to 90 weight %.

A charge-transporting layer, particularly the charge-transporting layer which is not the surface layer of an electrophotographic photosensitive member has the thickness preferably of 5 to 70 μm, and more preferably of 10 to 30 μm. A too thin charge-transporting layer tends to deteriorate charge retainability, and a too thick layer tends to increase a residual potential.

When making a charge-transporting material and a charge-generating material contained in the same layer, the layer can be formed by applying a coating solution for the layer resulting by dispersing the above described charge-generating material and the above described charge-transporting material together with a binder resin and a solvent, and drying it. In addition, the layer preferably has the thickness of 8 to 40 μm, and more preferably of 12 to 30 μm. In addition, a content of the photoconductive materials (a charge-generating material and a charge-transporting material) in the layer is preferably 20 to 100 weight % with respect to the total weight of the layer, and further preferably 30 to 90 weight %.

A binder resin used in a photosensitive layer (a charge-transporting layer and a charge-generating layer) includes, for instance, an acrylic resin, an allyl resin, an alkyd resin, an epoxy resin, a silicone resin, a phenol resin, a butyral resin, a benzal resin, a polyacrylate resin, a polyacetal resin, a polyamide-imide resin, a polyamide resin, a polyallylether resin, a polyarylate resin, a polyimide resin, a polyurethane resin, a polyester resin, a polyethylene resin, a polycarbonate resin, a polysulfone resin, a polystyrene resin, a polybutadiene resin, a polypropylene resin and a urea resin. One or more compounds among them can be used singly or as a mixture or a copolymer.

In addition, a protective layer may be provided on a photosensitive layer for the purpose of protecting the photosensitive layer. The protective layer preferably has the thickness of 0.01 to 10 μm, and more preferably of 0.1 to 6 μm. For a protective layer, a curable resin which is cured and polymerized by heat or irradiation with a radioactive ray, is preferably used. For the resin monomer of the curable resin, a resin monomer having a chain-polymerizable functional group is preferably used. In addition, a protective layer may contain electroconductive materials such as a metal, an oxide thereof, a nitride, a salt, an alloy and carbon black. The metal includes iron, copper, gold, silver, lead, zinc, nickel, tin, aluminum, titanium, antimony and indium. More specifically, ITO, $TiO_2$, ZnO, $SnO_2$ and $Al_2O_3$ can be used. The electroconductive material is preferably particulate and is dispersed and contained in a protective layer, and has a particle diameter preferably of 0.001 to 5 μm, and further preferably of 0.01 to 1 μm. A content of the electroconductive material in a protective layer is preferably 1 to 70 weight % to the total weight of the protective layer, and further preferably 5 to 50 weight %. For an agent for dispersing them, a titanium coupling agent, a silane coupling agent and various surface active agents can be used.

Each layer composing the above described electrophotographic photosensitive member may contain an oxidant inhibitor or a photo degradation-preventing agent as well. In addition, the surface layer of an electrophotographic photosensitive member may contain various fluorine compounds, silane compounds and metallic oxides, for the purpose of improving the lubricity and the water repellency of the peripheral surface of the electrophotographic photosensitive member. In addition, the protective layer can disperse them in a form of particulate substances therein. In addition, a surface active agent can be used as a dispersing agent for them. A content of the above described various additives in the surface layer of an electrophotographic photosensitive member is preferably 1 to 70 weight % with respect to the total weight of the surface layer, and more preferably 5 to 50 weight %.

Various methods such as vacuum deposition and coating can be adopted to form each layer of an electrophotographic photosensitive member according to the present invention, but coating is preferable among them. Coating can form thin to thick layers of various compositions. Coating specifically includes coating a bar coater, a knife coater, a roll coater or an attritor; dip coating; spray coating; beam coating; electrostatic coating; and powder coating.

Figure 5:
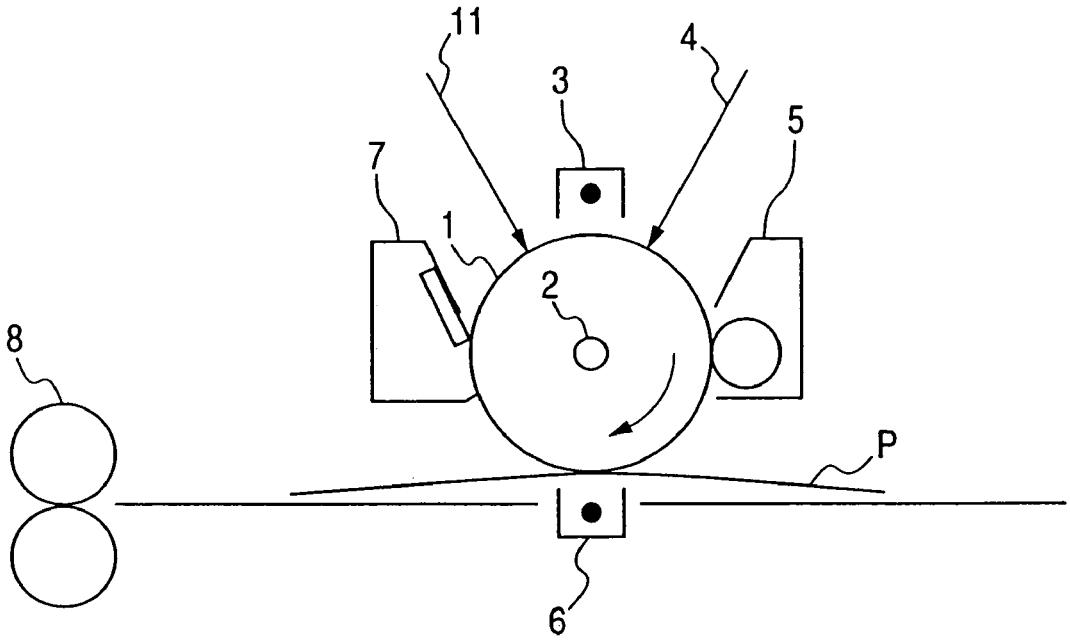
FIG. 5 is a schematic view of an electrophotographic apparatus according to the present invention.

FIG. 5 shows a diagrammatic configuration example of a general transferring-type electrographic apparatus using an electrophotographic photosensitive member according to the present invention.

In FIG. 5, reference numeral 1 denotes a cylindrical electrophotographic photosensitive member of an image carrying member according to the present invention, which is rotationally driven around an axis 2 in the direction of the arrow at a predetermined peripheral velocity. The above described electrophotographic photosensitive member 1 takes a uniform electrostatic charge from charging means 3 into a predetermined electrically positive or negative potential on the peripheral surface during a rotation process, and then is subjected to light-figure exposure (slit exposure or laser beam scan exposure) through image exposure means 4 in an exposure portion. Thereby, an electrostatic latent image corresponding to an exposure image is sequentially formed on the peripheral surface of an electrophotographic photosensitive member.

The electrostatic latent image is subsequently developed by a toner which has been supplied from a developing sleeve in developing means 5, and the toner-developed image is sequentially transferred onto the surface of transfer materials P by transferring means 6, which has been taken out from a not-shown paper-supplying portion and supplied to a portion between an electrophotographic photosensitive member 1 and transferring means 6, synchronously with the rotation of the electrophotographic photosensitive member 1.

The transfer material P having an image transferred thereon is separated from an electrophotographic photosensitive member, is introduced into image-fixing means 8, in which the image is fixed, and is output as a copy to the outside of the electrophotographic apparatus.

The surface of an electrophotographic photosensitive member 1, after having transferred an image therefrom, is cleaned by cleaning means 7 which removes the toner remaining on the surface after having transferred an image therefrom, further electrically neutralized by pre-exposure means 11, and repeatedly used for image-forming.

Figure 6:
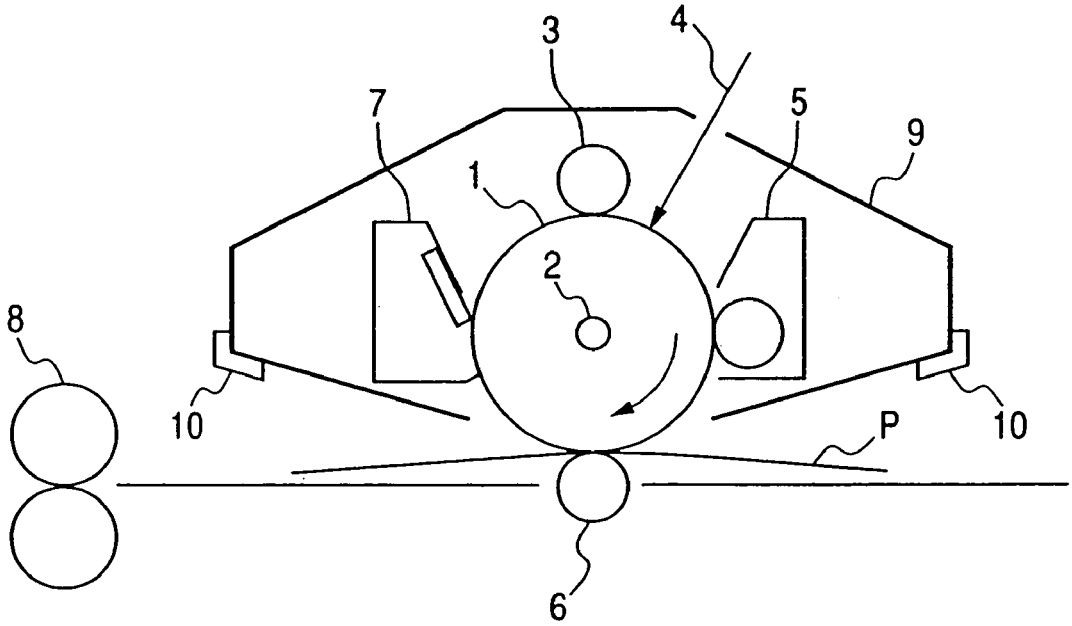
FIG. 6 is a schematic view of an electrophotographic apparatus having a process cartridge according to the present invention.

An electrophotographic apparatus may be structured into a process cartridge which is a device unit composed by integrating a plurality of components out of the above described electrophotographic photosensitive member, developing means and cleaning means and is removably attached to the main body of the apparatus. FIG. 6 shows an example of a process cartridge. For instance, an electrophotographic photosensitive member 1 and a cleaning means 7 may be integrated into one device unit which is removably attached to the main body of an apparatus with the use of guiding means such as a rail 10. The above described device unit may have a configuration of including charging means and/or developing means.

When an electrophotographic apparatus is used as a copying machine or a printer, a light-figure exposure 4 is performed by converting a reflected light or a transmitted light from or through an original, or a read original into signals, and scanning a laser beams, driving an arrayed light emitting diode or driving an array liquid crystal shutter by using the signals. When the electrophotographic apparatus is used as a printer of a facsimile, the light-figure exposure 4 is used for printing received data.

FIG. 6 shows an example of a diagrammatic configuration of an electrophotographic apparatus provided with an electrophotographic photosensitive member according to the present invention.

In FIG. 6, reference numeral 1 denotes a cylindrical electrophotographic photosensitive member, which is rotationally driven around an axis 2 in the direction of the arrow at a predetermined peripheral velocity.

The peripheral surface of a rotationally driven electrophotographic photosensitive member 1 is uniformly charged into a positive or negative predetermined electric potential by charging means 3 (primary charging means: an electrostatic charge roller or the like), and subsequently receives an exposing light 4 (an image-exposing light) which is output from exposing means (not shown) such as slit exposure and laser beam scan exposure. Thus, an electrostatic latent image corresponding to an objective image is sequentially formed on the peripheral surface of an electrophotographic photosensitive member 1.

The electrostatic latent image formed on the peripheral surface of the electrophotographic photosensitive member 1 becomes a toner image after having been developed by a toner included in a developer of developing means 5. Subsequently, the toner image formed and carried on the peripheral surface of an electrophotographic photosensitive member 1 is sequentially transferred onto the surface of transfer materials P by transfer bias applied from transferring means 6 (a transferring roller), which has been taken out from transfer material-supplying means (not shown) and supplied to a portion (an abutment) between an electrophotographic photosensitive member 1 and transferring means 6, synchronously with the rotation of the electrophotographic photosensitive member 1.

The transfer material P having a toner-image transferred thereon is separated from the peripheral surface of an electrophotographic photosensitive member 1, is introduced into image-fixing means 8, in which the image is fixed, and is printed out as an image-formed article (a print or a copy) to the outside of the electrophotographic apparatus.

The surface of an electrophotographic photosensitive member 1 after having transferred a toner image therefrom is cleaned by cleaning means (a cleaning blade or the like) 7 which removes a developer (a toner) remaining on the surface after having transferred an image therefrom, is further electrically neutralized by pre-exposure light from pre-exposure means (not shown), and is repeatedly used for image-forming. However, pre-exposure is not always necessary as shown in FIG. 6, when charging means 3 is contact charging means using a charging roller.

A process cartridge may be structured by integrating a plurality of components among the above described electrophotographic photosensitive member 1, charging means 3, developing means 5, transferring means 6 and cleaning means 7 and housing them in a vessel, so as to be releasably attachable to the main body of an electrophotographic apparatus such as a copying machine or a laser beam printer. In FIG. 6, an electrophotographic photosensitive member 1, a charging means 3, a developing means 5 and a cleaning means 7 are integrated into one unit of a process cartridge 9, which can be releasably attachable to the main body of an electrophotographic apparatus with the use of a guiding means 10 such as a rail in the main body of the electrophotographic apparatus.

An electrophotographic photosensitive member according to the present invention can be utilized not only in an electrophotographic copy machine but also can be widely used in an electrophotographic application field such as a laser beam printer, a CRT printer, an LED printer, a liquid crystal printer and a laser beam plate-making.

In the next place, the present invention will be described more in detail with reference to examples. However, the present invention is not limited to these examples.

EXAMPLES

In the next place, the present invention will be described more in detail with reference to examples. However, the present invention is not limited to these examples.

Example 1

An electrophotographic photosensitive member used in Example 1 was produced in the following way. At first, an aluminum cylinder (made of an aluminum alloy specified in JIS A3003) with a length of 370 mm, an outside diameter of 84 mm and a wall thickness of 0.3 mm was produced by cutting. The surface roughness Rzjis of this cylinder was measured in an axial direction, and showed 0.08 μm. The cylinder was ultrasonically cleaned in a solution containing a detergent (a trade name: Chemicohl CT made by Tokiwa Chemical Co., Ltd.) in pure water, subsequently was rinsed in a step of rinsing the detergent away, and then was ultrasonically cleaned in pure water for degreasing.

A solution consisting of 60 parts by weight of titanium oxide powders having a coating film of stannic oxide doped with antimony (a trade name: Kronos ECT-62 made by Titan Kogyo K.K.), 60 parts by weight of titanium oxide powders (a trade name: Titone SR-1T made by Sakai Chemical Industry Co., Ltd.), 70 parts by weight of a resol-type phenol resin (a trade name: Phenolite J-325 containing 70% of solids made by Dainippon Ink & Chemicals, Inc.), 50 parts by weight of 2-methoxy-1-propanol and 50 parts by weight of methanol was prepared by dispersing them with a ball mill for about 20 hours. The average particle diameter of fillers contained in the dispersion liquid was 0.25 μm.

Thus mixed dispersion liquid was applied onto the above described aluminum cylinder with a dipping method, and was heated, dried and cured in a hot-air heat oven adjusted to 150° C. for 48 minutes to form an electroconductive layer with a thickness of 15 μm.

Next, a solution was prepared by dissolving 10 parts by weight of a copolymerization nylon resin (a trade name: Amilan CM8000 made by Toray Industries, Inc.) and 30 parts by weight of a methoxy methylation nylon resin (a trade name: Toresin EF30T, made by Teikoku Chemical Industries Co., Ltd.) in a liquid mixture of 500 parts by weight of methanol and 250 parts by weight of butanol, was dip-coated on the above described electroconductive layer, was charged into a hot-air heat oven adjusted to 100° C., and was heated and dried for 22 minutes to form an subbing layer with a thickness of 0.45 μm.

Subsequently, a mixed solution was prepared by dispersing 4 parts by weight of hydroxygallium phthalocyanine pigment having strong peaks at 7.4 degrees and 28.2 degrees in Bragg angle of 2θ=0.2 degrees in a CuKα-ray diffraction spectrum, and 2 parts by weight of a polyvinyl butyral resin (a trade name: S-LEC BX-1 made by Sekisui Chemical Co., Ltd.), in 90 parts by weight of cyclohexanone for 10 hours with a sand mill while using glass beads with a diameter of 1 mm, and then a coating solution for a charge-generating layer was prepared by adding 110 parts by weight of ethyl acetate to the mixed solution. The coating solution was dip-coated onto the above described subbing layer, was charged into a hot-air heat oven adjusted to 80° C., and was heated and dried for 22 minutes to form a charge-generating layer with a thickness of 0.17 μm.

Next, a coating solution for a first charge-transporting layer was prepared by dissolving 35 parts by weight of a triaryl amine-based compound shown in the following structural formula (11):

Structural formula (11)

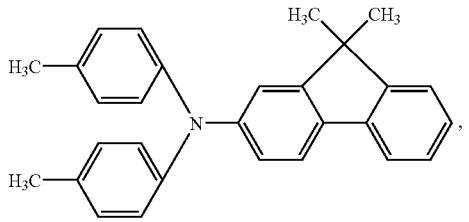

and 50 parts by weight of a bisphenol Z type polycarbonate resin (a trade name: Iupilon Z400 made by Mitsubishi Engineering-Plastics Corporation), in 320 parts by weight of monochlorobenzene and 50 parts by weight of dimethoxymethane.

The coating solution for the first charge-transporting layer was dip-coated onto the above described charge-generating layer, was charged into a hot-air heat oven adjusted to 100° C., and was heated and dried for 40 minutes to form the first charge-transporting layer with a thickness of 20 μm.

Subsequently, a coating solution for a second charge-transporting layer was prepared by dissolving 30 parts by weight of a hole-transporting compound having a polymerizable functional group shown in the following structural formula (12):

Structural formula (12)

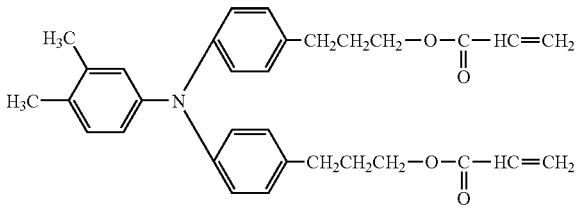

-continued

Structural formula (12)

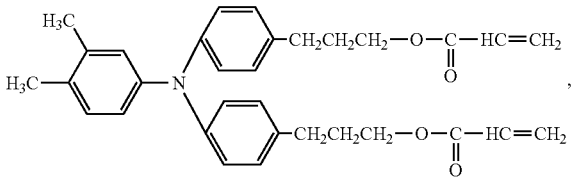

in 35 parts by weight of 1-propanol and 35 parts by weight of 1,1,2,2,3,3,4-heptafluoro cyclopentane (a trade name: Zeorora H, made by NIHON ZEON Corporation), and the solution was then pressurization-filtered with a 0.5 μm membrane filter made of PTFE. The coating solution was coated onto the above described charge-transporting layer with a dip coating to form a curable second charge-transporting layer. The second charge-transporting layer was then irradiated with electron beams under conditions of an accelerating voltage of 150 kV and a dose of $1.5\times10^4$ Gy, in a nitrogen atmosphere. Subsequently, the electrophotographic photosensitive member was heated for 90 seconds in such a condition as to make itself 120° C. The oxygen concentration in the nitrogen atmosphere was 10 ppm. The electrophotographic photosensitive member was further heated in a hot-air heat oven adjusted to 100° C. in atmospheric air for 20 minutes, and a curable second charge-transporting layer with a thickness of 6 μm was formed thereon.

Next, the surface of the resulting electrophotographic photosensitive member was roughened; specifically was subjected to blasting treatment with the use of a dry blasting machine (a product made by Fujiseiki Corporation) shown in FIG. 2, in the following conditions.

Abrasive grains: spherical glass beads with an average diameter of 30 μm (a trade name: UB-01L made by Union Co., Ltd.) were used. Air blasting pressure: 3.5 kgf/cm$^2$. Moving speed of a blasting gun: 430 mm/min. Rotational speed of workpiece (an electrophotographic photosensitive member): 2.88 rpm. Distance between a discharge opening of the blasting gun and an electrophotographic photosensitive member: 100 mm. Discharge angle for abrasive grains: 90 degrees. Amount of supplying abrasive grains: 200 g/min. Blasting time: one way×twice. Furthermore, an abrasive remaining/sticking on/to the surface of the electrophotographic photosensitive member was removed by spraying a compressed air.

The surface profile of the surface layer on the electrophotographic photosensitive member was measured with the use of Surfcoder SE3500 type surface roughness instrument made by Kosaka Laboratory Co., Ltd. Rzjis and RSm measured for the electrophotographic photosensitive member in a circumferential direction with the use of a circumferential roughness measuring device in the above described instrument. The measurement was performed in conditions of a measurement length of 0.4 mm and a measuring speed of 0.1 mm/s. The RSm measurement was performed after having set the set value of the base line level of noise cut to 10%.

Ten point mean roughnesses Rzjis (A) and Rzjis (B), and mean spacing of irregularities RSm (C) and RSm (D) measured for the electrophotographic photosensitive member were respectively 0.55 μm, 0.60 μm, 42 μm and 43 μm.

In addition, maximum peak height Rp was 0.2 μm and maximum valley depth Rv/maximum peak height Rp was 2.02.

In addition, the number of dimple-shaped concavities per 100 μm square on the surface layer of the electrophotographic photosensitive member, an area rate of dimple-shaped concavities, and an average aspect ratio of a dimple-shaped concavity were measured and calculated with the use of the above described surface shape measurement system (Surface Explorer SX-520DR type machine made by Ryoka Systems Inc.).

As a result, the number of dimple-shaped concavities per 100 μm square, an area rate of dimple-shaped concavities, and an average aspect ratio of a dimple-shaped concavity were respectively 15, 12.2 and 0.68.

In addition, a fitting rate of the electrophotographic photosensitive member was measured. The fitting rate is measured by taking a photograph of the cross section for the first and second charge-transporting layers with a SEM, so that an electrophotographic photosensitive member is inevitably necessary to be destroyed. Accordingly, one extra electrophotographic photosensitive member formed in the same condition as described above was prepared, and was used as a sample for measuring the fitting rate.

At first, nine samples with about 5 mm square were arbitrarily cut in the surface of an electrophotographic photosensitive member. Among them, one sample was subjected to the observation of the cross section with a SEM, three dimple-shaped concavities were arbitrarily selected among them, and in each point, Rv11max (maximum valley depth) and L11 (diameter) of the dimple-shaped concavity on a second charge-transporting layer, and Rv12max (maximum valley depth) and L12 (diameter) of a dimple-shaped concavity formed on the interface between the first charge-transporting layer and the second charge-transporting layer in a portion corresponding to the recess were measured. The operation was repeated for 27 points in total of dimple-shaped concavities, and the fitting rate was calculated by averaging treatment to show 80%. The results are shown in Table 1.

Next, an electrophotographic photosensitive member to be used for a hardness test was left in an environment of 23° C. and humidity of 50% for 24 hours, and then was subjected to the measurement of an elastic deformation rate with the use of the above described microhardness measuring instrument Fischerscope H100V (a product made by Fischer Inc.).

An elastic deformation rate is determined from continuously measured hardness by continuously loading an indentator, and directly reading the pressed-down depth under the load. A Vickers quadrangular pyramid diamond indentator with an angle between the opposite faces of 136 degrees can be used as the indentator. Specifically, the hardness was measured by stepwisely applying a load finally of 6 mN (holding time of 0.1 S for each point and 273 points in total).

An elastic deformation rate was measured for two surfaces of a second charge-transporting layer which is a surface layer, and a first charge-transporting layer which is a subsurface layer.

The elastic deformation rate of the surface of a second charge-transporting layer was measured, by pressing an indentator in the surface of the second charge-transporting layer after having subjected the second charge-transporting layer to blast treatment.

The elastic deformation rate of the surface of a first charge-transporting layer was measured similarly to the above described method, by preparing an electrophotographic photosensitive member having the first charge-transporting layer but not yet having a second charge-transporting layer formed thereon, and pressing an indentator in the surface of the first charge-transporting layer.

The measurement result is shown in Tables 1 and 2.

The durability of an electrophotographic photosensitive member according to the present example was tested and evaluated with the use of an apparatus which has been prepared by adapting an electrophotographic copying machine (a trade name: iRC6800 made by Canon) so that it can mount a negatively charged organic electrophotographic photosensitive member thereon, may not cause problems with cleaning properties and developing properties, and can continue outputting desired images.

At first, an electrophotographic photosensitive member was subjected to the endurance test of 50,000 sheets for a test image of an A4 size in full color every after two sheets under an environment of 23° C./5% RH; and then the maximum scratch depth within a drum surface and an abraded amount of a drum was measured, and defects of the test image output as a halftone image were observed, after every 10,000 sheets.

The maximum scratch depth was measured with the use of the above described Surfcoder SE3500 type surface roughness instrument made by Kosaka Laboratory Co., Ltd. in setting conditions similar to the above described conditions, by determining several points of scratches appearing to be deep by visual inspection, measuring them, and adopting the highest value.

An abraded amount of an electrophotographic photosensitive member was determined from thickness reduced after endurance test. The thickness of an electrophotographic photosensitive member was measured with the concurrent use of an eddy current type thickness measurement instrument Permascope E111 type (a product made by Fischer Inc.) and an interference thickness gage with the use of an instant multi-measuring system MCPD-3000 (a product made by Otsuka Electronics Co., Ltd.).

The maximum depths of scratches produced on an electrophotographic photosensitive member during endurance test were measured every after printing of 10,000 sheets, and the growing state of the scratches was observed. Then, it was found that the depth tends to be saturated after printing of about 20,000 sheets, and the scratch depth after finishing the endurance test of 50,000 sheets showed the same value as one shown after printing of 20,000 sheets.

The value at that time was 1.1 μm by Rmax.

Meanwhile, an abraded amount was 1.2 μm after printing of 50,000 sheets.

From the above result, the life of a drum could be calculated as the number of sheets where a scratch reaches a photosensitive layer, and could be anticipated to be 306,000 sheets judging from the calculation for the scratch.

After the endurance test of 50,000 sheets, the endurance test was further continued till the scratches of an electrophotographic photosensitive member appear on a half tone image as defects. As a result, the image defects occurred after printing of 305,000 sheets, and the life of the electrophotographic photosensitive member was confirmed.

From the result, it could be confirmed that an electrophotographic photosensitive member according to the present example had approximately the same number of sheets of the life as was initially anticipated.

Example 2

In a process of the above described Example 1 for preparing an electrophotographic photosensitive member, a process up to coating and curing of the second charge-transporting layer was performed as in the case of Example 1, except that the thickness was 10 μm Subsequently, the electrophotographic photosensitive member was finished through roughening the surface with a similar roughening method to the one in Example 1 and in the optimized roughening condition, so as to acquire a surface profile which does not cause cleaning problems when mounted in an electrophotographic apparatus.

Thus prepared electrophotographic photosensitive member was mounted on the same electrophotographic apparatus as in the case of Example 1, and was evaluated with a similar method to the one in Example 1. The results are shown in Table 1 and Table 2.

Example 3

In a process of the above described Example 1 for preparing an electrophotographic photosensitive member, a process up to coating and curing of the second charge-transporting layer was performed as in the case of Example 1, except that the thickness was 15 μm. Subsequently, the electrophotographic photosensitive member was finished through roughening the surface with a similar roughening method to the one in Example 1 and in the optimized roughening condition, so as to acquire a surface profile which does not cause cleaning problems when mounted in an electrophotographic apparatus.

Thus prepared electrophotographic photosensitive member was mounted on the same electrophotographic apparatus as the one in Example 1, and was evaluated as in the case of Example 1. The results are shown in Table 1 and Table 2.

Example 4

In a process of the above described Example 1 for preparing an electrophotographic photosensitive member, a process up to coating and curing of the second charge-transporting layer was performed as in the case of Example 1, except that the thickness was 4 μm. Subsequently, the electrophotographic photosensitive member was finished through roughening the surface with a similar roughening method to the one in Example 1 and in the optimized roughening condition, so as to acquire a surface profile which does not cause cleaning problems when mounted in an electrophotographic apparatus.

Thus prepared electrophotographic photosensitive member was mounted on the same electrophotographic apparatus as the one in Example 1, and was evaluated as in the case of Example 1. The results are shown in Table 1 and Table 2.

Example 5

In a process according to the above described Example 1 for preparing an electrophotographic photosensitive member, a process up to the first charge-transporting layer was performed as in the case of Example 1. Subsequently, a second charge-transporting layer was formed as described below.

A liquid was prepared by dissolving 0.15 parts by weight of a fluorinated resin (a trade name: GF-300 made by Toagosei Co., Ltd.) of a dispersing agent in 35 parts by weight of 1,1,2,2,3,3,4-heptafluoro cyclopentane (a trade name: Zeorora H made by ZEON Corporation) and 35 parts by weight of 1-propanol, then adding 3 parts by weight of a tetrafluoroethylene resin powder (a trade name: Rubron L-2, made by Daikin Industries, Ltd.) of a lubricant, and then uniformly dispersing the powder into the solution three times with a pressure of 600 kgf/cm$^2$ in a high-pressure dispersing machine (a trade name: Microfluidizer M-110EH made by Microfluidics in U.S.). The liquid was filtered under pressure by using a PTFE membrane filter with a pore size of 10 μm to prepare a lubricant dispersion. Then, a coating solution for a second charge-transporting layer was prepared by adding 27 parts by weight of a hole-transporting compound shown in the above described formula (12) to the lubricant dispersion, and filtering it under pressure with a 5 μm membrane filter made of PTFE. The coating solution was coated on the above described first charge-transporting layer with a dip coating to form the second charge-transporting layer.

An electrophotographic photosensitive member was prepared by forming the second charge-transporting layer with a thickness of 6 μm through a similar irradiation with electron beams and heat treatment to those in Example 1, and roughening the surface with a similar roughening method to the one in Example 1 and in the optimized roughening condition, so as to acquire a surface profile which does not cause cleaning problems when mounted in an electrophotographic apparatus.

Thus prepared electrophotographic photosensitive member was mounted on the same electrophotographic apparatus as the one in Example 1, and was evaluated as in the case of Example 1. The results are shown in Table 1 and Table 2.

Example 6

In a process according to the above described Example 1 for preparing an electrophotographic photosensitive member, a process up to the formation of a charge-transporting layer was performed as in the case of Example 1. Subsequently, a second charge-transporting layer was formed as described below.

A liquid was prepared by dissolving 0.45 parts by weight of a fluorinated resin (a trade name: GF-300 made by Toagosei Co., Ltd.) of a dispersing agent in 35 parts by weight of 1,1,2,2,3,3,4-heptafluoro cyclopentane (a trade name: Zeorora H made by ZEON Corporation) and 35 parts by weight of 1-propanol, then adding 9 parts by weight of a tetrafluoroethylene resin powder (a trade name: Rubron L-2, made by Daikin Industries, Ltd.) of a lubricant, and then uniformly dispersing the powder into the solution three times with a pressure of 600 kgf/cm$^2$ in a high-pressure dispersing machine (a trade name: Microfluidizer M-110EH made by Microfluidics in U.S.). The liquid was filtered under pressure by using a PTFE membrane filter with a pore size of 10 μm to prepare a lubricant dispersion. Then, a coating solution for a second charge-transporting layer was prepared by adding 27 parts by weight of a hole-transporting compound shown in the above described formula (12) to the lubricant dispersion, and filtering it under pressure with a 5 μm membrane filter made of PTFE. The coating solution was coated on the above described first charge-transporting layer with a dip coating to form the second charge-transporting layer.

An electrophotographic photosensitive member was prepared by forming a curing type surface layer with a thickness of 6 μm through a similar irradiation with electron beams and heat treatment to those in Example 1, and roughening the surface with a similar roughening method to the one in Example 1 and in the optimized roughening condition, so as to acquire a surface profile which does not cause cleaning problems when mounted in an electrophotographic apparatus.

Thus prepared electrophotographic photosensitive member was mounted on the same electrophotographic apparatus as the one in Example 1, and was evaluated as in the case of Example 1. The results are shown in Table 1 and Table 2.

Example 7

In a process according to Example 1 for preparing an electrophotographic photosensitive member, a process up to the formation of a first charge-transporting layer was performed as in the case of Example 1.

An electrophotographic photosensitive member was prepared in a similar way to Example 6 while using the amount of the same tetrafluoroethylene resin dispersion as the one used in Example 5 except that a hole-transporting compound shown in the formula (13) described below substituted for a compound shown in formula (12) in Example 1, and then by roughening the surface with a similar roughening method to the one in Example 1 and in the optimized roughening condition, so as to acquire a surface profile which does not cause cleaning problems when mounted in an electrophotographic apparatus. The results are shown in Table 1 and Table 2.

, and 50 parts by weight of a polyarylate resin (weight average molecular weight: 130,000) which is formed by copolymerization of Z type bisphenol and C type bisphenol blended in the ration of 1/1, in 350 parts by weight of monochlorobenzene and 50 parts by weight of dimethoxymethane. The liquid was dip-coated on the above described charge-generating layer, was charged into a hot-air heat oven adjusted to 110° C., and was heated and dried for 60 minutes to form a first charge-transporting layer with a thickness of 20 μm.

An electrophotographic photosensitive member was prepared by forming a second charge-transporting layer on the surface as in the case of Example 6, and roughening the surface with a similar roughening method to the one in Example 1 and in the optimized roughening condition, so as to acquire a surface profile which does not cause cleaning problems when mounted in an electrophotographic apparatus.

Thus prepared electrophotographic photosensitive member was mounted on the same electrophotographic apparatus as the one in Example 1, and was evaluated as in the case of Example 1. The results are shown in Table 1 and Table 2.

Structural Formula (13)

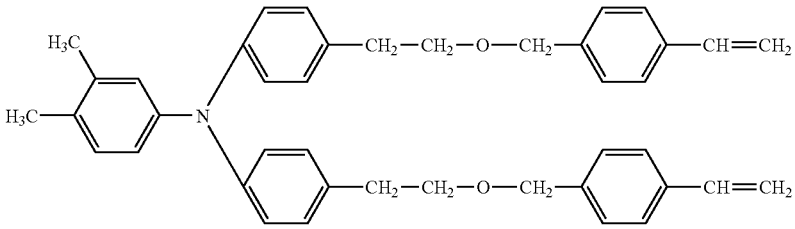

Example 8

In a process according to the above described Example 1 for preparing an electrophotographic photosensitive member, a process up to the formation of a charge-generating layer was performed as in the case of Example 1. Subsequently, a coating solution for a first charge-transporting layer was prepared by dissolving 36 parts by weight of a triaryl amine-based compound shown in structural formula (11) used in the above described Example 1 and 4 parts by weight of a triaryl amine-based compound shown in the following formula (14):

Structural Formula (14)

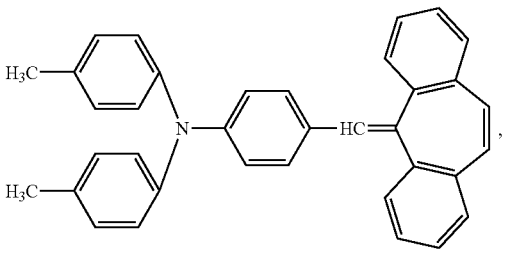

Example 9

A first charge-transporting layer was formed with a similar way to Example 1; then a solution was prepared by dissolving 10 parts by weight of a bisphenol Z type polycarbonate resin (a trade name: Iupilon Z200, made by Mitsubishi Engineering-Plastics Corporation) in the mixed solvent of 100 parts by weight of monochlorobenzene and 60 parts by weight of dichloromethane; a coating solution was prepared by mixing and dispersing 1 parts by weight of hydrophobic silica particles in the solution; and a second charge-transporting layer with a dried thickness of 1.0 μm was formed by applying the coating solution onto the above described first charge-transporting layer with a spraying applicator.

Furthermore, an electrophotographic photosensitive member was prepared by forming a third charge-transporting layer on the surface, which is a curable charge-transporting layer of the same surface layer as in the case of Example 6; and roughening the surface with a similar roughening method to the one in Example 1 and in the optimized roughening condition, so as to acquire a surface profile which does not cause cleaning problems when mounted in an electrophotographic apparatus.

Thus prepared electrophotographic photosensitive member was mounted on the same electrophotographic apparatus as the one in Example 1, and was evaluated as in the case of Example 1. The results are shown in Table 1 and Table 2.

Example 10

A process up to the formation of a charge-generating layer was performed as in the case of Example 1.

Subsequently, a liquid was prepared by dissolving 0.68 parts by weight of a fluorinated resin (a trade name: Surflon S-381 made by Seimi Chemical Co., Ltd.) of a dispersing agent in 35 parts by weight of methanol and 35 parts by weight of ethanol, then adding 6 parts by weight of a tetrafluoroethylene resin powder (Rubron L-2) of a lubricant, and then uniformly dispersing the powder into the solution three times with a pressure of 600 kgf/cm$^2$ in a high-pressure dispersing machine (a trade name: Microfluidizer M-110EH made by Microfluidics in U.S.). The liquid was filtered under pressure by using a PTFE membrane filter with a pore size of 10 μm to prepare a lubricant dispersion. In the liquid, 21.2 parts by weight of a resol type phenolic resin varnish (a trade name: PL-4852 made by Gun Ei Chemical Industry Co., Ltd., nonvolatile component: 75%), and 11.1 parts by weight of a charge-transporting compound having a structure shown in the following formula (16):

Structural formula (16)

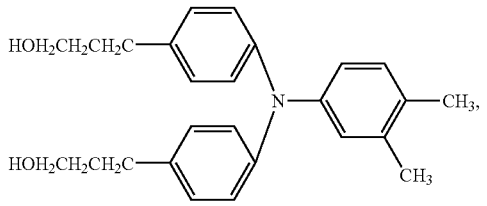

, were mixed, stirred and dissolved. Then, a coating solution for a first charge-transporting layer was prepared by pressure-filtering the liquid with a 5 μm membrane filter made of PTFE.

The coating solution was dip-coated on the charge-generating layer, was charged into a hot-air heat oven adjusted to 145° C., and was heated and cured for 1 hour to form a first charge-transporting layer with a thickness of 20 μm.

An electrophotographic photosensitive member was prepared by forming a second charge-transporting layer as in the case of Example 6, on the surface of thus formed first charge-transporting layer; subjecting it to similar coating and curing to those in Example 1; and roughening the surface with a similar roughening method to the one in Example 1 and in the optimized roughening condition, so as to acquire a surface profile which does not cause cleaning problems when mounted in an electrophotographic apparatus.

Thus prepared electrophotographic photosensitive member was mounted on the same electrophotographic apparatus as the one in Example 1, and was evaluated as in the case of Example 1. The results are shown in Table 1 and Table 2.

Example 11

In a process according to Example 1 for preparing an electrophotographic photosensitive member, a process up to the formation of a first charge-transporting layer was performed as in the case of Example 1.

Subsequently, a coating medium for a second charge-transporting layer was prepared by adding 3 parts by weight of a photoinitiator shown in the following structural formula (17):

Structural formula (17)

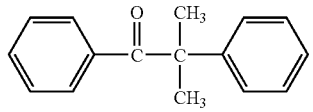

to a coating medium in Example 6 containing 27 parts by weight of a hole-transporting compound shown in the above described formula (12). The coating medium was dip-coated on the above described first charge-transporting layer, cured by irradiating it with a light having an optical intensity of 500 mW/cm$^2$ emitted from a metal halide lamp for 60 seconds, and was heated in a hot-air heat oven adjusted to 120° C. in atmospheric air for 60 minutes to form a second charge-transporting layer with a thickness of 6 μm. The surface of the resulting electrophotographic photosensitive member was roughened with a similar roughening method to the one in Example 1 and in the optimized roughening condition, so as to acquire a surface profile which does not cause cleaning problems when mounted in an electrophotographic apparatus as in the case of Example 1. Thus prepared electrophotographic photosensitive member was mounted on the same electrophotographic apparatus as the one in Example 1, and was evaluated as in the case of Example 1. The results are shown in Table 1 and Table 2.

Example 12

A process up to the formation of a charge-transporting layer was performed as in the case of Example 1.

Subsequently, 100 parts by weight of antimony-doped stannic oxide particles (a trade name: T-1 made by Mitsubishi Materials Corporation, and average diameter: 0.02 μm) were surface-treated with 7 parts by weight (hereafter described as treated amount: 7%) of a fluorinated compound (a trade name: LS-1090 made by Shin-Etsu Chemical Co., Ltd.) having a structure shown in the following formula (18):

Structural formula (18)

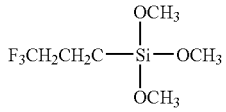

The surface-treated antimony-doped stannic oxide particles in the amount of 50 parts by weight were added to 150 parts by weight of ethanol, were dispersed therein with a sand mill device for 60 hours. Furthermore, 20 parts by weight of tetrafluoroethylene resin particles (Rubron L-2) were added to the liquid, and dispersed therein by the sand mill device for eight hours.

Then, 30 parts by weight of a resol type phenolic resin varnish (a trade name: PL-4804, made by Gun Ei Chemical Industry Co., Ltd.) was dissolved in the liquid to form a coating solution for a surface layer. The coating solution showed an adequately dispersed state.

The coating solution for a surface layer was dip-coated on a charge-transporting layer, was charged into a hot-air heat oven adjusted to 145° C., and was heated and cured for 1 hour to form the surface layer with a thickness of 6 μm.

The surface layer of thus resulting electrophotographic photosensitive member was roughened by similar dry-type blasting treatment to the one in Example 1.

Thus prepared electrophotographic photosensitive member was mounted on the same electrophotographic apparatus as the one in Example 1, and was evaluated as in the case of Example 1. The results are shown in Table 1 and Table 2.

Example 13

In a process according to Example 1 for preparing an electrophotographic photosensitive member, a process up to the formation of a first charge-transporting layer was performed as in the case of Example 1.

Subsequently, a coating solution for a protective layer was prepared by dissolving 5 parts by weight of a triaryl amine-based compound shown in structural formula (11) used for a second charge-transporting layer in the above described Example 1, and 4 parts by weight of a triaryl amine-based compound shown in the formula (14) used in the above described Example 8, and 8 parts by weight of a polyarylate copolymer resin (copolymerization ratio m:n=7:3, and weight average molecular weight: 130,000) shown in structural formula (15), in 240 parts by weight of monochlorobenzene and 160 parts by weight of dimethoxymethane. The coating solution was spray-coated on a charge-transporting layer, was charged into a hot-air heat oven adjusted to 110° C., and was heated and dried for 60 minutes to form a second charge-transporting layer with a thickness of 6 μm.

The surface of the resulting electrophotographic photosensitive member was roughened with a similar roughening method to the one in Example 1 and in the optimized roughening condition, so as to acquire a surface profile which does not cause cleaning problems when mounted in an electrophotographic apparatus as in the case of Example 1. The prepared electrophotographic photosensitive member was mounted on the same electrophotographic apparatus as the one in Example 1, and was evaluated as in the case of Example 1. The results are shown in Table 1 and Table 2.

Example 14

In a process according to Example 1 for preparing an electrophotographic photosensitive member, a process up to the formation of a first charge-transporting layer was performed as in the case of Example 1.

Subsequently, a coating solution for a second charge-transporting layer was prepared by dissolving 10 parts by weight of a charge-transporting compound shown in a structural formula (16) used in Example 10, and 20 parts by weight of a solution (a solid content of 67% by weight) of a burette denatured body having a structure shown in the following formula (19):

Structural formula (19)

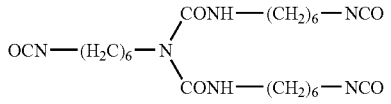

in the mixed solvent consisting of 350 parts by weight of tetrahydrofuran and 150 parts by weight of cyclohexanone.

A coating solution for a second charge-transporting layer to become the surface layer was spray-coated on a first charge-transporting layer, and was left at room temperature for 30 minutes, cured by hot blast at 145° C. for one hour to form a protective layer with a thickness of 6 μm.

The surface of the resulting electrophotographic photosensitive member was roughened with a similar roughening method to the one in Example 1 and in the optimized roughening condition, so as to acquire a surface profile which does not cause cleaning problems when mounted in an electrophotographic apparatus as in the case of Example 1. The prepared electrophotographic photosensitive member was mounted on the same electrophotographic apparatus as the one in Example 1, and was evaluated as in the case of Example 1. The results are shown in Table 1 and Table 2.

Example 15

In a process according to Example 1 for preparing an electrophotographic photosensitive member, a process up to the formation of a first charge-transporting layer was performed as in the case of Example 1.

A hole-transporting compound shown in the following formula (20) was substituted for a compound shown in formula (12) in Example 1. A liquid was prepared by dissolving 0.3 parts by weight of a fluorinated resin (a trade name: GF-300 made by Toagosei Co., Ltd.) of a dispersing agent in 35 parts by weight of 1,1,2,2,3,3,4-heptafluoro cyclopentane (a trade name: Zeorora H made by ZEON Corporation) and 35 parts by weight of 1-propanol, then adding 6 parts by weight of a tetrafluoroethylene resin powder (a trade name: Rubron L-2, made by Daikin Industries, Ltd.) of a lubricant, and then uniformly dispersing the powder into the solution three times with a pressure of 600 kgf/cm$^2$ in a high-pressure dispersing machine (a trade name: Microfluidizer M-110EH made by Microfluidics in U.S.). The liquid was filtered under pressure by using a PTFE membrane filter with a pore size of 10 μm to prepare a lubricant dispersion. Then, a coating solution for a second charge-transporting layer was prepared by adding 27 parts by weight of a hole-transporting compound shown in the above described formula (20) to the lubricant dispersion, filtering it under pressure with a 5 μm membrane filter made of PTFE, and further adding the same amount of a photoinitiator shown in formula (17) as used in Example 11, to it.

Structural formula (20)

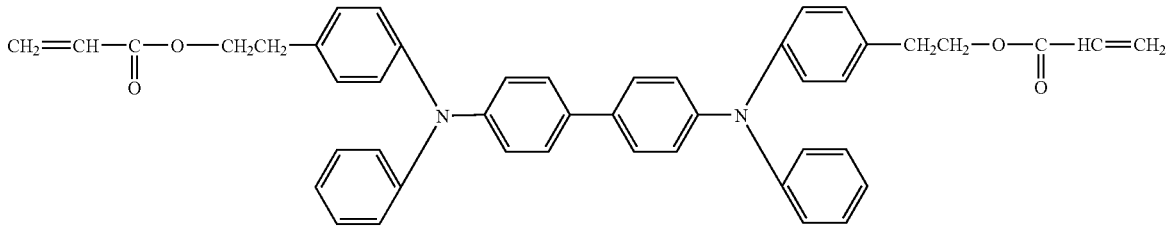

The coating solution was dip-coated on the above described first charge-transporting layer, was cured on the same irradiation conditions as in Example 11, and was subjected to hot blast drying treatment under the same conditions as in Example 10 to form a second charge-transporting layer with a thickness of 6 μm. The surface of the resulting electrophotographic photosensitive member was roughened with a similar roughening method to the one in Example 1 and in the optimized roughening condition, so as to acquire a surface profile which does not cause cleaning problems when mounted in an electrophotographic apparatus as in the case of Example 1. The prepared electrophotographic photosensitive member was mounted on the same electrophotographic apparatus as the one in Example 1, and was evaluated as in the case of Example 1. The results are shown in Table 1 and Table 2.

Structural formual (21)

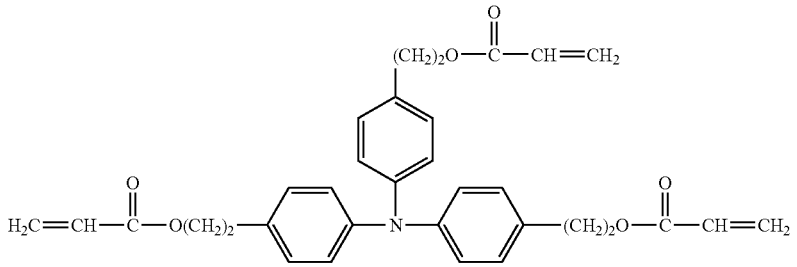

Example 16

In a process according to Example 1 for preparing an electrophotographic photosensitive member, a process up to the formation of a first charge-transporting layer was performed as in the case of Example 1.

A coating solution was prepared through substituting a hole-transporting compound in the following structural formula (21) for a hole-transporting compound in structural formula (12) described in Example 1, and then was coated on the above described first charge-transporting layer with a dip coating to form a second charge-transporting layer. The second charge-transporting layer was then irradiated with electron beams under conditions of an accelerating voltage of 150 kV and a dose of 10 Mrad, in nitrogen atmosphere. Subsequently, the electrophotographic photosensitive member was heated for 90 seconds in such a condition as to make itself 120° C. The oxygen concentration in the nitrogen atmosphere was 10 ppm. The electrophotographic photosensitive member was further heated in a hot-air heat oven adjusted to 100° C. in atmospheric air for 20 minutes, and a second charge-transporting layer with a thickness of 6 μm was formed.

The surface of the resulting electrophotographic photosensitive member was roughened with a similar roughening method to the one in Example 1 and in the optimized roughening condition, so as to acquire a surface profile which does not cause cleaning problems when mounted in an electrophotographic apparatus as in the case of Example 1. The prepared electrophotographic photosensitive member was mounted on the same electrophotographic apparatus as the one in Example 1, and was evaluated as in the case of Example 1. The results are shown in Table 1 and Table 2.

Example 17

A first charge-transporting layer was formed in the same method as in Example 1, and a coating solution for a second charge-transporting layer was prepared by dissolving 30 parts by weight of a hole-transporting compound shown in the above described structural formula (12) and 10 parts by weight of the following structural formula (22), in the mixed solvent 50 parts by weight of monochlorobenzene and 50 parts by weight of dichloromethane.

The coating solution was coated on the above described first charge-transporting layer, and then the layer was irradiated with electron beams in the same method as in Example 1 but under conditions of an accelerating voltage of 150 kV and a dose of 10 Mrad, in nitrogen atmosphere. Subsequently, the electrophotographic photosensitive member was heated for 90 seconds in such a condition as to make itself 120° C. The oxygen concentration in the nitrogen atmosphere was 10 ppm. The electrophotographic photosensitive member was further heated in a hot-air heat oven adjusted to 100° C. in atmospheric air for 20 minutes, and a second charge-transporting layer with a thickness of 2 μm was formed.

The surface of the resulting electrophotographic photosensitive member was roughened with a similar roughening method to the one in Example 1 and under the optimized roughening condition, so as to acquire a surface profile which does not cause cleaning problems when mounted in an electrophotographic apparatus as in the case of Example 1. The prepared electrophotographic photosensitive member was mounted on the same electrophotographic apparatus as the one in Example 1, and was evaluated as in the case of Example 1. The results are shown in Table 1 and Table 2.

Structural formula (22)

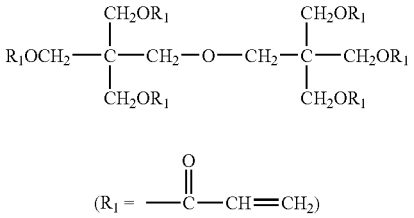

Comparative Example 1

An electrophotographic photosensitive member formed in the above described Example 1 was coated with a second charge-transporting layer, the layer was dried at 50° C. for 15 minutes, and then, before the layer will be irradiated with electron beams for curing, the surface was roughened with a blasting method described in Example 1 and in optimized conditions so as to acquire the same surface profile as that of an electrophotographic photosensitive member in Example 1. After having been roughened, an electrophotographic photosensitive member of comparative Example 1 was prepared by irradiating the second charge-transporting layer with electron beams, and heating it under the same conditions as in Example 1 to cure the layer.

The cross section of the electrophotographic photosensitive member was observed with a SEM and the photograph was taken to prove that the same irregular profile as was formed on a second charge-transporting layer was not formed on the interface between the first and second charge-transporting layers at all, but the interface was flat, and consequently a fitting rate was 0%.

The prepared electrophotographic photosensitive member was mounted on the same electrophotographic apparatus as the one in Example 1, and was evaluated as in the case of Example 1. The results are shown in Table 1 and Table 2.

The electrophotographic photosensitive member did not have problems associated with cleaning through the early stage to end of endurance test. However, the number of sheets of the life when having started showing a scratched image in a long endurance test, did not satisfy the expected printable number of sheets.

Comparative Example 2

An electrophotographic photosensitive member formed in the above described Example 13 was coated with a second charge-transporting layer, the layer was dried at 50° C. for 15 minutes, and then, the surface was roughened with a similar method to the one in Example 13 and in optimized conditions, so as to acquire the same surface profile as that of an electrophotographic photosensitive member in Example 13. After the roughening has been completed, an electrophotographic photosensitive member was prepared by heating and drying the second charge-transporting layer under the same conditions as in Example 13

The cross section of the electrophotographic photosensitive member was observed with a SEM and the photograph was taken to prove that the same irregular profile as was formed on a second charge-transporting layer was not formed on the interface between the first and second charge-transporting layers at all, but the interface was flat, and consequently a fitting rate was 0%.

The prepared electrophotographic photosensitive member was mounted on the same electrophotographic apparatus as the one in Example 1, and was evaluated as in the case of Example 1. The results are shown in Table 1 and Table 2.

The electrophotographic photosensitive member did not have problems associated with cleaning through the early stage to end of endurance test, and showed an abraded amount and a scratch growth rate similar to those of Example 13. However, the number of sheets of the life when having started showing a scratched image in endurance test, did not satisfy the expected printable number of sheets.

Comparative Example 3

Figure 7:
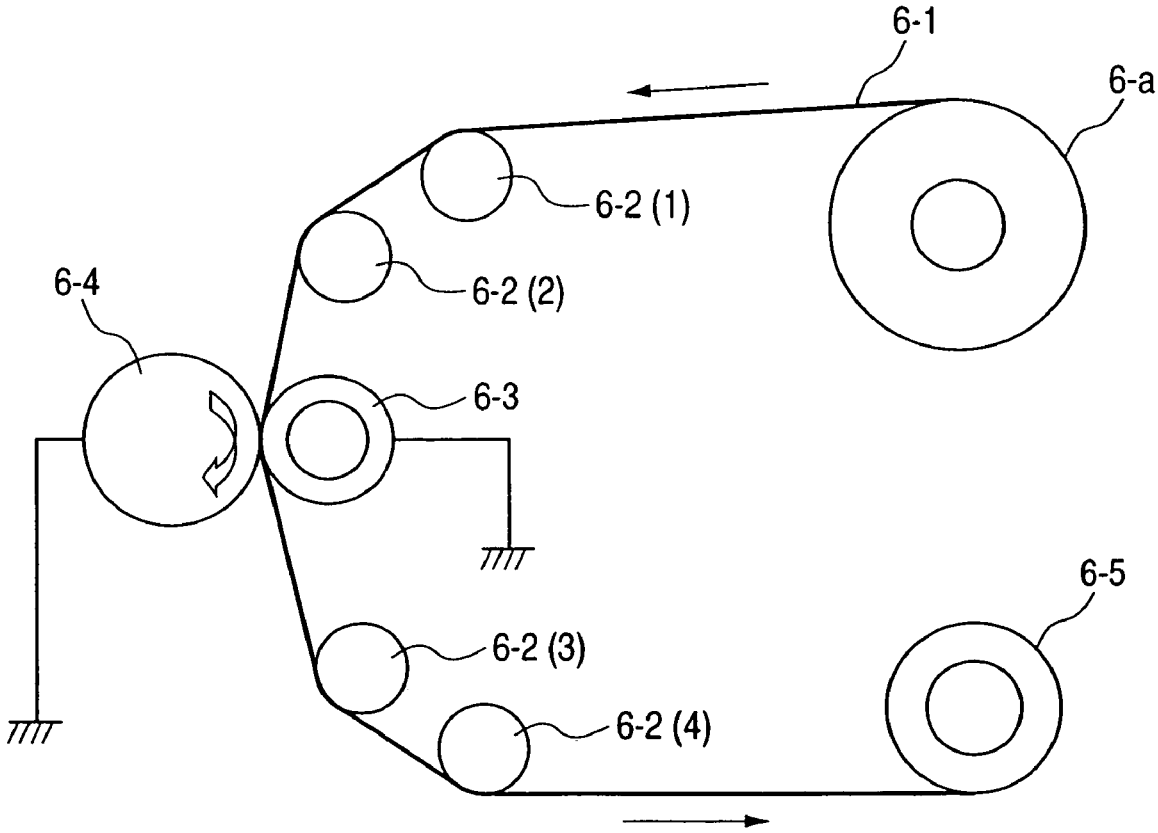
FIG. 7 is a schematic view of another roughening device.

A process up to the curing of a second charge-transporting layer was performed as in the case of the above described Example 1. Subsequently, the surface was roughened with roughening means shown in FIG. 7.

This is roughening means having a roughening mechanism using an abrasive sheet. The abrasive sheet is a sheet having a binder resin containing dispersed abrasive grains coated on a substrate. The abrasive sheet 6-1 is wound up around a hollow shaft 6-*a*, and a not-shown motor is arranged so as to apply a tensile force to the abrasive sheet 6-1 in an opposite direction to the moving sheet toward the hollow axis 6-*a*. The abrasive sheet 6-1 is supplied in the direction of the arrow, and passes through a back-up roller 6-3 after having traveled on guide rollers 6-2 (1) and 6-2 (2). The used sheet for polishing is wound up around winding means 6-5 which is driven by the not-shown motor after having traveled on guide rollers 6-2 (3) and 6-2 (4). A basically not-yet-used abrasive sheet is constantly pressed onto the surface of an electrophotographic photosensitive member, and roughens the surface of the electrophotographic photosensitive member. A part contacting with the abrasive sheet 6-1 is contacted with earth or has electroconductivity.

The surface of an electrophotographic photosensitive member was roughened under the following conditions:

abrasive sheet: article name; C-2000 (a product made by Fuji Photo Film Co., Ltd.), abrasive grain: SiC (average particle diameter: 9 μm), substrate: polyester film (thickness: 75 μm), abrasive sheet-supplying speed: 200 mm/sec, speed of rotation of electrophotographic photosensitive member: 25 rpm, abutting pressure: 3 $N/m^2$, rotational directions of sheet and electrophotographic photosensitive member: same direction (hereafter, the same direction is called "with" and a reverse direction "counter"), outer diameter of back-up roller: 40 cm, Asker C hardness of back-up roller: 40, and treatment time: 150 seconds.

When the density and width of grooves and roughness on the surface of the electrophotographic photosensitive member, of which the surface was roughened by the method, were measured, the density of grooves was 420, the width of the groove was 10.4 μm or less, Rz was 0.62 μm and Rmax was 0.83 μm.

The cross section of the electrophotographic photosensitive member was observed with a SEM and the photograph was taken to prove that the same irregular profile as was formed on a second charge-transporting layer was not formed on the interface between the first and second charge-transporting layers at all, but the interface was flat. A fitting rate could not be determined from the definition of calculation, but was 0%.

The electrophotographic photosensitive member was mounted on the same electrophotographic apparatus as the one in Example 1, and was evaluated as in the case of Example 1. The results are shown in Table 1 and Table 2.

The electrophotographic photosensitive member showed a slight cleaning failure before printing on the expected number of printable sheets, the number of sheets when having started showing a scratched image in the endurance test, did not satisfy the expected printable number of sheets.

Comparative Example 4

The electrophotographic photosensitive member prepared in the above described Example 1 was subjected the measurement of the surface profile without having the surface layer roughened by blasting treatment, was mounted on the same electrophotographic apparatus as the one in Example 1, and was evaluated with a similar method to the one in Example 1. The results are shown in Table 1 and Table 2.

The electrophotographic photosensitive member had not dimple-shaped concavities on the surface, but had a flat surface.

The electrophotographic photosensitive member was mounted on the same electrophotographic apparatus as the one in Example 1, and was evaluated as in the case of Example 1. The results are shown in Table 1.

The electrophotographic photosensitive member showed a cleaning failure after having printed 100 sheets in endurance test, and the endurance test could not be continued.

Comparative Example 5

An electrophotographic photosensitive member formed in the above described Example 1 was coated with a first charge-transporting layer, and then, the surface was roughened with a blasting method described in Example 1 and in optimized conditions so as to acquire the same surface profile as that on the surface layer of an electrophotographic photosensitive member used in Example 1. After having been roughened, an electrophotographic photosensitive member of comparative example 5 was prepared as in the case of Example 1 by coating a second charge-transporting layer and irradiating the second charge-transporting layer with electron beams, and heating it to cure the layer.

The cross section of the electrophotographic photosensitive member was observed with SEM micrographs to find out that the second charge-transporting layer had much less irregularities than the interface between the first and second charge-transporting layers, and the interface was flat, and consequently a fitting rate was 5%.

Thus prepared electrophotographic photosensitive member was mounted on the same electrophotographic apparatus as the one in Example 1, and was evaluated as in the case of Example 1. The results are shown in Table 1 and Table 2.

The electrophotographic photosensitive member showed a cleaning failure after having printed 3,000 sheets in endurance test, and the durability test could not be continued.

TABLE 1

| | Fitting rate (F:%) | Modulus of elasticity of surface layer (WeA:%) | Modulus of elasticity of surface underlayer (WeB:%) | HU of surface layer ($N/mm^2$) | HU of surface under-layer ($N/mm^2$) | Thick-ness of surface layer (μm) | Main component of surface layer (structural formula No.) | Condi-tions of preparing surface layer (curing method) |
|---|---|---|---|---|---|---|---|---|
| Example 1 | 80 | 58 | 41 | 204 | 215 | 6 | 12 | Electron beam |
| Example 2 | 78 | 58 | 41 | 203 | 215 | 10 | 12 | Electron beam |
| Example 3 | 62 | 59 | 41 | 202 | 215 | 15 | 12 | Electron beam |
| Example 4 | 80 | 58 | 41 | 205 | 215 | 4 | 12 | Electron beam |
| Example 5 | 78 | 54 | 41 | 198 | 215 | 6 | 12 | Electron beam |
| Example 6 | 75 | 50 | 41 | 192 | 215 | 6 | 12 | Electron beam |
| Example 7 | 72 | 50 | 41 | 190 | 215 | 6 | 13 | Electron beam |
| Example 8 | 69 | 50 | 44 | 194 | 240 | 6 | 12 | Electron beam |
| Example 9 | 71 | 50 | 38 | 193 | 237 | 6 | 12 | Electron beam |
| Example 10 | 62 | 50 | 47 | 194 | 210 | 6 | 16 | Electron beam |
| Example 11 | 71 | 49 | 41 | 183 | 215 | 6 | 12 | UV |
| Example 12 | 62 | 45 | 41 | 205 | 215 | 6 | 18 | Heat |
| Example 13 | 57 | 43 | 41 | 219 | 215 | 6 | 15 | Heat |
| Example 14 | 66 | 46 | 41 | 211 | 215 | 6 | 19 | Heat |
| Example 15 | 68 | 46 | 41 | 182 | 215 | 6 | 20 | UV |

TABLE 1-continued

| | | | | | | | | |
|---|---|---|---|---|---|---|---|---|
| Example 16 | 70 | 60 | 41 | 220 | 215 | 6 | 21 | Electron beam |
| Example 17 | 57 | 68 | 41 | 255 | 215 | 2 | 22 | Electron beam |
| Comparative Example 1 | 0 | 58 | 41 | 204 | 215 | 6 | 12 | Electron beam |
| Comparative Example 2 | 0 | 41 | 41 | 205 | 215 | 6 | 15 | Electron beam |
| Comparative Example 3 | 0 | 58 | 41 | 204 | 215 | 6 | 12 | Electron beam |
| Comparative Example 4 | 0 | 58 | 41 | 204 | 215 | 6 | 12 | Electron beam |
| Comparative Example 5 | 5 | 58 | 41 | 204 | 215 | 6 | 12 | Electron beam |

| | Scratch growth rate (μm/10,000 sheets) | Abrasion rate (μm/10,000 sheets) | Expected printable number of sheets (α:K sheets) | Real number of printable sheets (β:K sheets) | β/α | Evaluation result for image before reaching number of printable sheets and other special remarks |
|---|---|---|---|---|---|---|
| Example 1 | Saturated at maximum 1.1 | 0.16 | 306 | 305 | 0.99 | No problem |
| Example 2 | Saturated at maximum 1.5 | 0.16 | 530 | 510 | 0.96 | No problem |
| Example 3 | Saturated at maximum 1.9 | 0.16 | 810 | 575 | 0.71 | No problem |
| Example 4 | Saturated at maximum 1.2 | 0.16 | 175 | 170 | 0.97 | No problem |
| Example 5 | Saturated at maximum 1.4 | 0.19 | 242 | 225 | 0.93 | No problem |
| Example 6 | Saturated at maximum 2 | 0.25 | 160 | 145 | 0.91 | No problem |
| Example 7 | Saturated at maximum 2 | 0.24 | 166 | 144 | 0.87 | No problem |
| Example 8 | Saturated at maximum 2.1 | 0.13 | 300 | 258 | 0.86 | No problem |
| Example 9 | Saturated at maximum 2.1 | 0.14 | 279 | 248 | 0.89 | No problem |
| Example 10 | Saturated at maximum 2.0 | 0.13 | 308 | 228 | 0.74 | No problem |
| Example 11 | Saturated at maximum 2.6 | 0.3 | 113 | 97 | 0.86 | No problem |
| Example 12 | 0.1 | 0.43 | 113 | 85 | 0.75 | No problem |
| Example 13 | 0.8 | 0.88 | 35.7 | 25 | 0.7 | No problem (The life was defined as a time when CTL appeared due to scratches.) |
| Example 14 | 0.15 | 0.58 | 71 | 55 | 0.77 | No problem |
| Example 15 | Saturated at maximum 2.3 | 0.4 | 93 | 78 | 0.84 | No problem |
| Example 16 | 0.12 | 0.42 | 105 | 87 | 0.83 | No problem |
| Example 17 | Saturated at maximum 1.0 | 0.15 | 333 | 240 | 0.72 | No problem |
| Comparative Example 1 | 1.2 | 0.16 | 300 | 180 | 0.6 | No problem |
| Comparative Example 2 | 0.9 | 1.3 | 27.7 | 13 | 0.47 | No problem |
| Comparative Example 3 | 2.5 | 0.17 | 205 | 105 | 0.51 | Slight CLN failure at about 70K sheets |
| Comparative Example 4 | — | — | — | — | — | Occurrence of cleaning failure at 100 sheets |
| Comparative Example 5 | — | — | — | — | — | Occurrence of cleaning failure at 3,000 sheets |

TABLE 2

| | Rzjis (A) (μm) | Rzjis (B) (μm) | RSm (C) (μm) | RSm (D) (μm) | RSm(D)/ RSm(C) | Rp(F) (μm) | Rv(E)/ Rp (F) |
|---|---|---|---|---|---|---|---|
| Example 1 | 0.55 | 0.6 | 42 | 43 | 1.02 | 0.2 | 2.02 |
| Example 2 | 0.53 | 0.61 | 41 | 43 | 1.05 | 0.2 | 2.05 |
| Example 3 | 0.53 | 0.59 | 42 | 44 | 1.04 | 0.19 | 2.15 |
| Example 4 | 0.6 | 0.66 | 45 | 44 | 0.98 | 0.22 | 2.2 |
| Example 5 | 0.68 | 0.64 | 45 | 46 | 1.02 | 0.2 | 2.7 |
| Example 6 | 0.72 | 0.72 | 49 | 47 | 0.96 | 0.22 | 3.55 |
| Example 7 | 0.68 | 0.69 | 43 | 48 | 1.12 | 0.22 | 3.2 |
| Example 8 | 0.75 | 0.88 | 38 | 40 | 1.05 | 0.24 | 2.5 |
| Example 9 | 0.73 | 0.8 | 40 | 43 | 1.08 | 0.24 | 2.7 |
| Example 10 | 0.72 | 0.77 | 44 | 50 | 1.14 | 0.3 | 2 |
| Example 11 | 0.71 | 0.69 | 46 | 46 | 1 | 0.25 | 3.11 |
| Example 12 | 1.16 | 1.2 | 61 | 53 | 1.04 | 0.36 | 2.88 |
| Example 13 | 1.33 | 1.6 | 35 | 30 | 0.86 | 0.4 | 2.1 |
| Example 14 | 1.41 | 1.45 | 72 | 77 | 1.07 | 0.46 | 2.2 |
| Example 15 | 0.77 | 0.8 | 46 | 50 | 0.64 | 0.25 | 2.1 |
| Example 16 | 0.4 | 0.41 | 70 | 66 | 0.94 | 0.1 | 1.5 |
| Example 17 | 0.25 | 0.27 | 80 | 95 | 1.19 | 0.1 | 1.1 |
| Comparative Example 1 | 0.55 | 0.6 | 42 | 43 | 1.02 | 0.2 | 2.02 |
| Comparative Example 2 | 1.8 | 2.5 | 15 | 20 | 1.3 | 0.9 | 1.3 |
| Comparative Example 3 | 0.98 | 0.88 | 31 | 110 | 3.55 | 0.83 | 1.1 |
| Comparative Example 4 | 0.17 | 0.15 | — | — | — | 0.1 | 0.9 |
| Comparative Example 5 | 0.2 | 0.18 | — | — | — | 0.11 | 0.9 |

This application claims priorities from Japanese Patent Applications No. 2004-092099 filed Mar. 26, 2004, No. 2004-131660 filed Apr. 27, 2004 and No. 2004-308308 filed Oct. 22, 2004, which are hereby incorporated by reference herein.

What is claimed is:

1. An electrophotographic photosensitive member comprising: a support and an organic photosensitive layer provided on the support, wherein a plurality of dimple-shaped concavities are formed on the surface of the surface layer of the electrophotographic photosensitive member;

a plurality of recesses corresponding to the dimple-shaped concavities formed on the surface of the surface layer are formed on the interface between the surface layer and a layer directly under the surface layer; and the surface of the surface layer has an elastic deformation rate of 46% or higher.

2. The electrophotographic photosensitive member according to claim 1, wherein the dimple-shaped concavities formed on the surface of the surface layer have a rate of 50% to 100% fitting to the recesses formed on the interface between the surface layer and the layer directly under the surface layer.

3. The electrophotographic photosensitive member according to claim 2, wherein the dimple-shaped concavities formed on the surface of the surface layer have a rate of 70% to 100% fitting to the recesses formed on the interface between the surface layer and the layer directly under the surface layer.

4. The electrophotographic photosensitive member according to claim 1, wherein the surface of the surface layer has an elastic deformation rate of 50% or higher.

5. The electrophotographic photosensitive member according to claim 1, wherein the surface of the surface layer has an elastic deformation rate of 63% or lower.

6. The electrophotographic photosensitive member according to claim 1, wherein the surface of the surface layer has a universal hardness value (HU) of 150 $N/mm^2$ to 230 $N/mm^2$.

7. The electrophotographic photosensitive member according to claim 1, wherein the surface of the layer directly under the surface layer has an elastic deformation rate of 45% or lower and a universal hardness value (HU) of 230 $N/mm^2$ or smaller.

8. The electrophotographic photosensitive member according to claim 1, wherein the surface layer has a thickness of 10 μm or less.

9. The electrophotographic photosensitive member according to claim 8, wherein the surface layer has a thickness of 6 μm or less.

10. The electrophotographic photosensitive member according to claim 1, wherein the surface layer is a cured layer.

11. The electrophotographic photosensitive member according to claim 1, wherein the surface layer is a cured layer containing at least one curable resin selected from the group consisting of an acrylic resin, a phenol resin, an epoxy resin, a silicone resin and a urethane resin.

12. The electrophotographic photosensitive member according to claim 1, wherein the surface layer contains a cured material resulting by curing and polymerizing a hole-transporting compound having two or more chain-polymerizable functional groups in a molecular thereof.

13. The electrophotographic photosensitive member according to claim 12, wherein the cured material is resulting by curing and polymerizing the hole-transporting compound having two or more chain-polymerizable functional groups in a molecular thereof, by means of heating or irradiation with a radioactive ray.

14. The electrophotographic photosensitive member according to claim 13, wherein the radioactive ray is an electron beam.

15. The electrophotographic photosensitive member according to claim 1, wherein the surface layer is formed by coating.

16. The electrophotographic photosensitive member according to claim 1, wherein the surface layer is formed by dip coating.

17. The electrophotographic photosensitive member according to claim 1, wherein the photosensitive layer is a multilayer-type photosensitive layer formed by layering, in an order closer to the support, a charge-generating layer and a charge-transporting layer, and the surface layer is the charge-transporting layer and the layer directly under the surface layer is the charge-generating layer.

18. The electrophotographic photosensitive member according to claim 1, wherein the photosensitive layer is a multilayer-type photosensitive layer formed by layering, in an order closer to the support, a charge-generating layer, a first charge-transporting layer and a second charge-transporting layer, and the surface layer is the second charge-transporting layer and the layer directly under the surface layer is the first charge-transporting layer.

19. The electrophotographic photosensitive member according to claim 1, wherein the electrophotographic photosensitive member further has a protective layer arranged on the photosensitive layer, the photosensitive layer is a multilayer-type photosensitive layer formed by layering, in an order closer to the support, a charge-generating layer and a charge-transporting layer, and the surface layer is the protective layer and the layer directly under the surface layer is the charge-transporting layer.

20. A method for manufacturing the electrophotographic photosensitive member according to claim 1 comprising:

a surface-layer-forming step of forming the surface layer right on the layer directly under the surface layer; and a recess-forming step of forming a plurality of dimple-shaped concavities on the surface of the surface layer formed in the surface-layer-forming step, and a plurality of recesses corresponding to the dimple-shaped concavities on the interface between the surface layer and the layer directly under the surface layer, by dry blasting or wet honing.

21. A process cartridge comprising:

an electrophotographic photosensitive member according to claim 1 and at least one means selected from the group consisting of a charging means, a developing means, a transfer means and a cleaning means, and being detachably mountable to a main body of an electrophoto graphic apparatus.

22. An electrophotographic apparatus comprising: an electrophotographic photosensitive member according to claim 1, charging means, exposure means, developing means, transferring means and cleaning means.

23. An electrophotographic photosensitive member comprising:

a support and an organic photosensitive layer provided on the support, wherein a plurality of dimple-shaped concavities are formed on the surface of the surface layer of the electrophotographic photosensitive member;

a plurality of recesses corresponding to the dimple-shaped concavities formed on the surface of the surface layer are formed on the interface between the surface layer and a layer directly under the surface layer;

the photosensitive layer is a multilayer-type photosensitive layer formed by layering, in an order closer to the support, a charge-generating layer and a charge-transporting layer; and the surface layer is the charge-transporting layer and the layer directly under the surface layer is the charge-generating layer.

24. A method for manufacturing the electrophotographic photosensitive member according to claim 23, comprising:

forming the surface layer on the layer directly under the surface layer;

forming a plurality of dimple-shaped concavities on the surface of the surface layer; and forming a plurality of recesses corresponding to the dimple-shaped concavities on the interface between the surface layer and the layer directly under the surface layer, by dry blasting or wet honing.

25. A process cartridge comprising:

an electrophotographic photosensitive member according to claim 23 and at least one means selected from the group consisting of a charging means, a developing means, a transfer means and a cleaning means, and being detachably mountable to a main body of an electrophotographic apparatus.

26. An electrophotographic apparatus comprising:

an electrophotographic photosensitive member according to claim 23, charging means, exposure means, developing means, transferring means, and cleaning means.

27. An electrophotographic photosensitive member comprising:

a support and an organic photosensitive layer provided on the support, wherein a plurality of dimple-shaped concavities are formed on the surface of the surface layer of the electrophotographic photosensitive member;

a plurality of recesses corresponding to the dimple-shaped concavities formed on the surface of the surface layer are formed on the interface between the surface layer and a layer directly under the surface layer;

the photosensitive layer is a multilayer-type photosensitive layer formed by layering, in an order closer to the support, a charge-generating layer, a first charge-transporting layer and a second charge-transporting layer; and the surface layer is the second charge-transporting layer and the layer directly under the surface layer is the first charge-transporting layer.

28. A method for manufacturing the electrophotographic photosensitive member according to claim 27, comprising:

forming the surface layer on the layer directly under the surface layer;

forming a plurality of dimple-shaped concavities on the surface of the surface layer; and forming a plurality of recesses corresponding to the dimple-shaped concavities on the interface between the surface layer and the layer directly under the surface layer, by dry blasting or wet honing.

29. A process cartridge comprising:

an electrophotographic photosensitive member according to claim 27 and at least one means selected from the group consisting of a charging means, a developing means, a transfer means and a cleaning means, and being detachably mountable to a main body of an electrophotographic apparatus.

30. An electrophotographic apparatus, comprising:

an electrophotographic photosensitive member according to claim 27, charging means, exposure means, developing means, transferring means, and cleaning means.

31. The electrophotographic photosensitive member according to claim 1, wherein the number of dimple-shaped concavities having (a) a maximum diameter from 1 μm to 50 μm, (b) a depth of 0.1 μm or more and (c) a volume of 1 $\mu m^3$ or more, is 5 to 50 concavities per 100 μm square of the surface of the surface layer.

* * * * *

UNITED STATES PATENT AND TRADEMARK OFFICE

CERTIFICATE OF CORRECTION

PATENT NO. : 7,226,711 B2
APPLICATION NO. : 11/236691
DATED : June 5, 2007
INVENTOR(S) : Shoji Amamiya et al.

It is certified that error appears in the above-identified patent and that said Letters Patent is hereby corrected as shown below:

COLUMN 10

Line 40, “among-them” should read --among them--.

COLUMN 14

Line 17, “rate-” should read --rate--.

COLUMN 17

Lines 57-59, “ 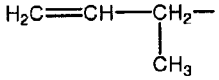 ” should read -- 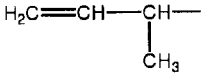 --.

COLUMN 18

Lines 39-44, “ 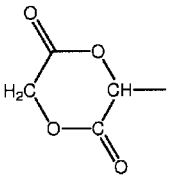 ” should read -- 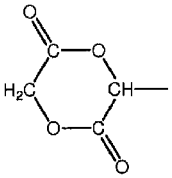 --.

COLUMN 21

Line 50, “a groups” should read --groups--.

UNITED STATES PATENT AND TRADEMARK OFFICE

CERTIFICATE OF CORRECTION

PATENT NO. : 7,226,711 B2
APPLICATION NO. : 11/236691
DATED : June 5, 2007
INVENTOR(S) : Shoji Amamiya et al.

It is certified that error appears in the above-identified patent and that said Letters Patent is hereby corrected as shown below:

COLUMN 29-30

"19

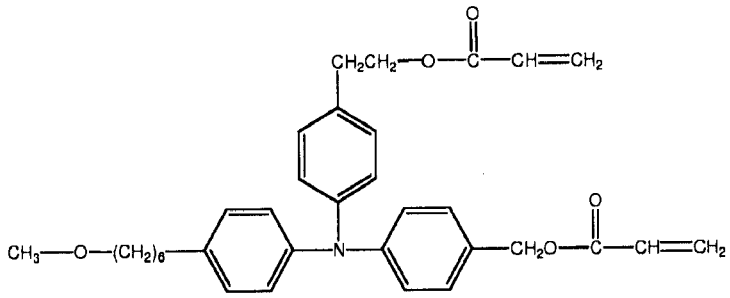

"

should read

--19

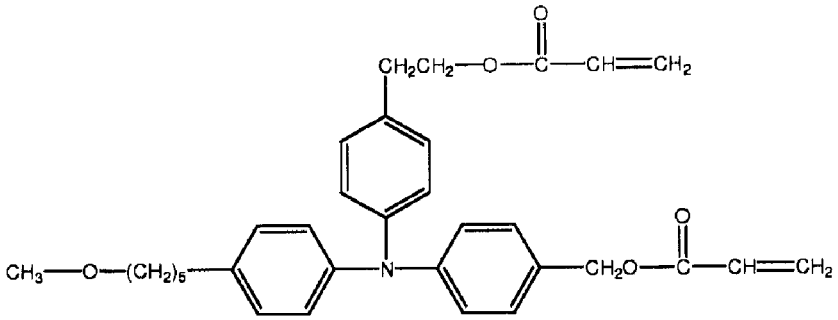

--.

UNITED STATES PATENT AND TRADEMARK OFFICE

CERTIFICATE OF CORRECTION

PATENT NO. : 7,226,711 B2
APPLICATION NO. : 11/236691
DATED : June 5, 2007
INVENTOR(S) : Shoji Amamiya et al.

It is certified that error appears in the above-identified patent and that said Letters Patent is hereby corrected as shown below:

COLUMNS 35-37

"37

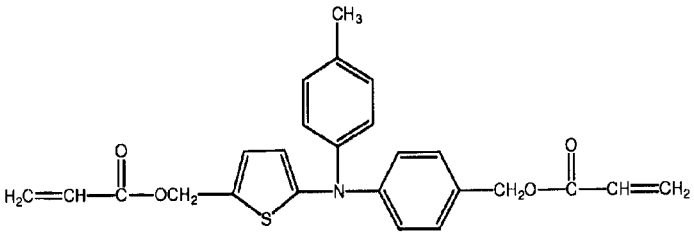

"

should read

--37

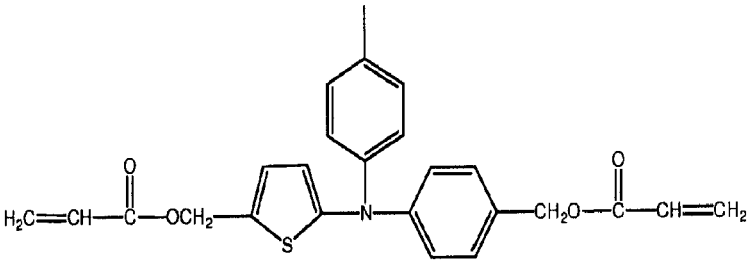

--.

UNITED STATES PATENT AND TRADEMARK OFFICE

CERTIFICATE OF CORRECTION

PATENT NO. : 7,226,711 B2
APPLICATION NO. : 11/236691
DATED : June 5, 2007
INVENTOR(S) : Shoji Amamiya et al.

It is certified that error appears in the above-identified patent and that said Letters Patent is hereby corrected as shown below:

COLUMNS 37-38

"43

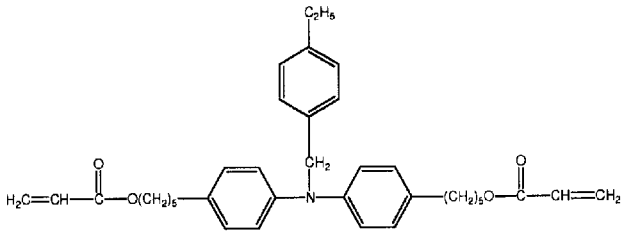

"

should read

--43

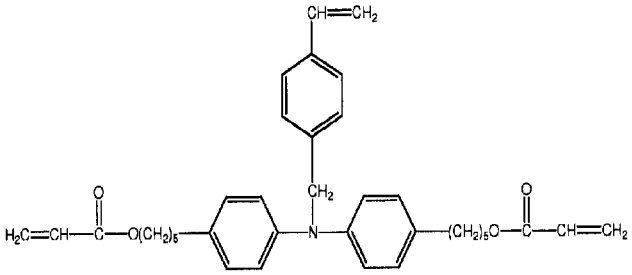

--.

UNITED STATES PATENT AND TRADEMARK OFFICE

CERTIFICATE OF CORRECTION

PATENT NO. : 7,226,711 B2
APPLICATION NO. : 11/236691
DATED : June 5, 2007
INVENTOR(S) : Shoji Amamiya et al.

It is certified that error appears in the above-identified patent and that said Letters Patent is hereby corrected as shown below:

COLUMN 84

Line 3, "as in" should read --as in Example 13.--.

Line 5, "Example 13" should be deleted.

COLUMN 91 line 19, "electrophoto graphic" should read --electrophotographic--.

Signed and Sealed this

Twenty Second Day of April, 2008

JON W. DUDAS
*Director of the United States Patent and Trademark Office*